US006061538A

United States Patent [19]

Arimitsu et al.

[11] Patent Number: 6,061,538

[45] **Date of Patent: *May 9, 2000**

[54] PROCESS CARTRIDGE, ELECTROPHOTOGRAPHIC IMAGE FORMING APPARATUS AND ELECTROPHOTOGRAPHIC IMAGE FORMING APPARATUS TRANSMISSIONS METHOD

[75] Inventors: Takeshi Arimitsu, Odawara; Jun Miyamoto, Susono; Kouji Miura, Mishima, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/917,867

[22] Filed: Aug. 27, 1997

[30] Foreign Application Priority Data

Aug. 29, 1996 [JP] Japan ..... 8-249222

[51] Int. Cl.[7] ..... G03G 15/00

[52] U.S. Cl. ..... 399/111

[58] Field of Search ..... 399/111, 110, 399/88, 167, 358; 347/138, 152

[56] References Cited

U.S. PATENT DOCUMENTS

| | | | |
|---|---|---|---|
| 3,985,436 | 10/1976 | Tanaka et al. | 399/111 |
| 4,829,335 | 5/1989 | Kanemitsu et al. | 399/111 |
| 4,975,744 | 12/1990 | Ebata et al. | 399/111 X |
| 5,023,660 | 6/1991 | Ebata et al. | 399/111 |
| 5,331,373 | 7/1994 | Nomura et al. | 399/111 |
| 5,404,198 | 4/1995 | Noda et al. | 399/107 |
| 5,452,056 | 9/1995 | Nomura et al. | 399/111 |
| 5,500,714 | 3/1996 | Yashiro et al. | 399/111 |
| 5,543,891 | 8/1996 | Setoriyama | 399/111 |
| 5,585,889 | 12/1996 | Shishido et al. | 399/113 |
| 5,617,579 | 4/1997 | Yashiro et al. | 399/114 |
| 5,734,949 | 3/1998 | Goto et al. | 399/111 |
| 5,768,658 | 6/1998 | Watanabe et al. | 399/111 |
| 5,815,644 | 9/1998 | Nishiuwatoko | 399/113 |
| 5,825,472 | 10/1998 | Araki et al. | 399/111 |

FOREIGN PATENT DOCUMENTS

| | | |
|---|---|---|
| 0 228 062 A2 | 7/1987 | European Pat. Off. . |
| 63-149669 | 6/1988 | Japan . |
| 2 180 795 | 4/1987 | United Kingdom . |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A process cartridge detachably mountable to a main assembly of an electrophotographic image forming apparatus includes a positioning portion for positioning the process cartridge when mounted to a mounting position of the main assembly. The positioning portion is engageable with a positioning member provided in the main assembly of the apparatus, and is projected from the cartridge coaxially with and at one longitudinal end side of a electrophotographic photosensitive drum. A drum driving force receiving member receives driving force for rotating the drum from the main assembly when the process cartridge is mounted, the drum driving force receiving member being juxtaposed with the positioning member coaxially with the drum and projected outwardly beyond the positioning member. A transporting member driving force receiving member receives driving force for rotating a toner transporting member from the main assembly when the process cartridge is mounted, wherein the transporting member driving force receiving member is disposed at the same side as the drum driving force receiving member disposed in a longitudinal direction of the drum.

23 Claims, 41 Drawing Sheets

(a)

(b)

PROCESS CARTRIDGE, ELECTROPHOTOGRAPHIC IMAGE FORMING APPARATUS AND ELECTROPHOTOGRAPHIC IMAGE FORMING APPARATUS TRANSMISSIONS METHOD

FIELD OF THE INVENTION AND RELATED ART

The present invention relates to a driving force transmission method, a process cartridge and an electrophotographic image forming apparatus to which a process cartridge is detachably mountable. Here, the electrophotographic image forming apparatus forms an image on a recording material using an electrophotographic image forming process. Examples of the electrophotographic image forming apparatus include an electrophotographic copying machine, an electrophotographic printer (a laser beam printer, a LED printer or the like), a facsimile machine and a word processor.

The process cartridge contains as a unit charging means, cleaning means and an electrophotographic photosensitive member, and is detachably mountable relative to a main assembly of the image forming apparatus. The process cartridge may contain an electrophotographic photosensitive member and at least one of the charging means and the cleaning means. The process cartridge can be mounted to or demounted from the main assembly of the apparatus by the users, so that maintenance operation of the apparatus can be easily carried out in effect.

In some conventional image forming apparatus using an electrophotographic image forming process, a process cartridge system is used wherein an electrophotographic photosensitive member and process means actable on said electrophotographic photosensitive member are contained in a process cartridge which is detachably mountable as a unit relative to a main assembly of the image forming apparatus. With this process cartridge system, the maintenance can be carried out in effect by the users without an expert serviceman, so that operativity is remarkably improved. Therefore, the process cartridge system is now widely used in the electrophotographic image forming apparatus.

On the other hand, in some of the process cartridge systems, developing means is in the form of an independent developing unit, which is separable from a process cartridge containing as a unit an electrophotographic photosensitive member, charging means and cleaning means. In such a system, the developing unit and the process cartridge are detachably mountable relative to the main assembly of the apparatus, independently from each other. With such a system, the respective parts can be used for their respective service lives without losing the advantage of the easy maintenance.

In such a process cartridge system, driving force for rotating the electrophotographic photosensitive drum in the process cartridge is received from the main assembly, when the process cartridge is mounted to the main assembly of the electrophotographic image forming apparatus.

Various methods have been proposed to rotate the electrophotographic photosensitive drum In one method, as disclosed in U.S. Pat. No. 5,023,660, pins fixed on a side surface of the gear provided on the main assembly are engaged with recesses formed in a side surface of a gear provided in the photosensitive drum, by which the photosensitive drum is rotated.

In another method, as disclosed in U.S. Pat. No. 4,829,335, a helical gear provided in the main assembly and the helical gear provided on the photosensitive drum, are engaged to rotation the photosensitive drum.

These methods are both very effective for transmitting the rotation force to the photosensitive drum. The present invention is a further and fundamental improvement of the conventional methods and structures.

SUMMARY OF THE INVENTION

Accordingly, it is a principal object of the present invention to provide a process cartridge, an electrophotographic image forming apparatus, a driving force transmission part, and an electrophotographic photosensitive drum, wherein rotation accuracy of the electrophotographic photosensitive drum is improved.

It is another object of the present invention to provide a process cartridge, an electrophotographic image forming apparatus, a driving force transmission part, and an electrophotographic photosensitive drum, wherein the driving force is transmitted to the electrophotographic photosensitive drum from the main assembly assuredly.

It is a further object of the present invention to provide a process cartridge comprising a first driving force receptor portion for receiving driving force for rotating an electrophotographic photosensitive drum and a second driving force receptor portion for receiving driving force for rotating a toner transporting member for transporting toner, an electrophotographic image forming apparatus to which the process cartridge is detachably mountable, and a driving force transmission method.

It is a further object of the present invention to provide a process cartridge comprising a drum driving force receiving member, for receiving driving force for rotating said electrophotographic photosensitive drum from the main assembly when the process cartridge is mounted to the mounting position of the main assembly, said driving force receiving member being juxtaposed with a positioning member coaxially with the electrophotographic photosensitive drum and projected more outwardly of the positioning member, an electrophotographic image forming apparatus to which a process cartridge is. detachably mountable, and a driving force transmission method.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the desirable embodiments of the present invention will be described in detail with reference to the drawings.

In the following descriptions, the "widthwise direction" of a process cartridge B means the direction in which the process cartridge B is inserted into, or taken out of, the main assembly 14 of an image forming apparatus, and it coincides with the direction in which a recording medium is conveyed. The "lengthwise direction" of the process cartridge B means the direction which intersects (substantially perpendicularly) with the direction in which the process cartridge B is inserted into, or taken out of, the main assembly 14 of an image forming apparatus, and it is parallel to the surface of the recording medium, intersecting (substantially perpendicularly) with the direction in which the recording medium is conveyed. As for the directions, the "left" side or "right" side of the process cartridge B means the left side or the right side of the process cartridge B as seen from above with reference to the direction in which the recording medium is conveyed.

EMBODIMENT 1

Hereinafter, the embodiments of the present invention will be described with reference to the drawings.

{General Structure of Image Forming Apparatus}

Figure 1:
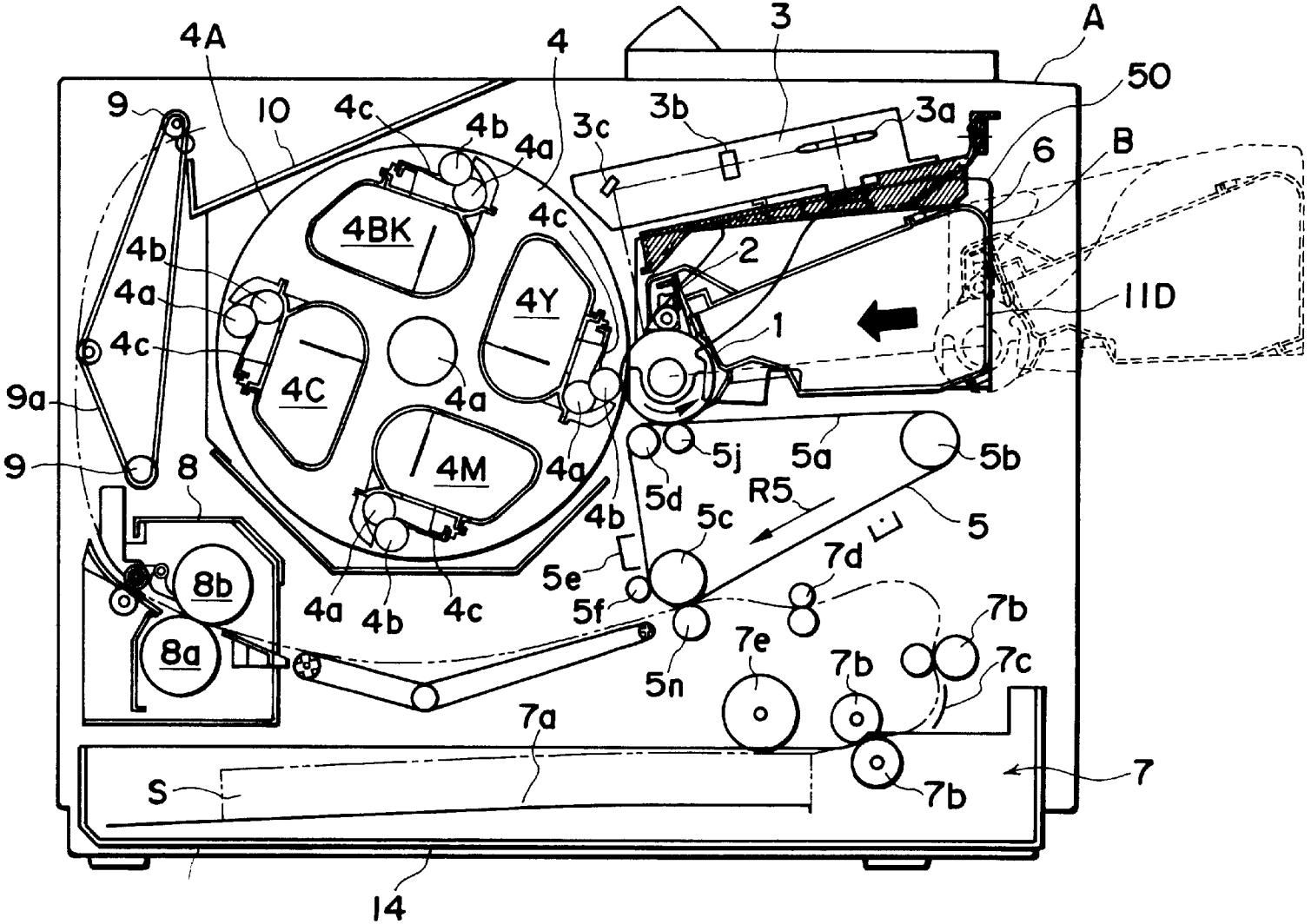
FIG. 1 is a vertical section of an electrophotographic image forming apparatus.

FIG. 1 is a vertical section of an electrophotographic image forming apparatus (hereinafter, image forming apparatus) in accordance with the present invention, and depicts the general structure of the apparatus.

First, the general features of an image forming apparatus A will be described with reference to FIG. 1. The image forming apparatus A illustrated in the drawing is a full-color laser beam printer based on four primary colors The image forming apparatus A comprises an electrophotographic photosensitive member 1 (hereinafter, "photosensitive drum"). The photosensitive drum 1 is rotatively driven by an unillustrated driving means, which will be described. later, in the counterclockwise direction of the drawing. The photosensitive drum 1 is surrounded by a charging device 2 which uniformly charges the peripheral surface of the photosensitive drum 1, an exposing means 3 which forms an electrostatic latent image on the peripheral surface of the photosensitive drum 1 by projecting a laser beam in accordance with image data, a developing device 4 which adheres toner to the electrostatic latent image to develop it into a toner image, a transfer unit 5 in which the toner image formed on the photosensitive drum 1 is transferred (primary transfer), a cleaning device 6 which removes the toner remaining on the peripheral surface of the photosensitive drum 1 after primary transfer, and the like devices, which are disposed in this order in the rotational direction of the photosensitive drum 1.

In this embodiment, the photosensitive drum 1, the charging device 2, and the cleaning device 6 for removing the residual toner are integrated into a cartridge, that is, a process cartridge B, which is removably installable in the main assembly 14 of the image forming apparatus A.

The image forming apparatus A also comprises a feeding-conveying means 7 which delivers a recording medium S to the transfer unit 5, and also carries out other recording medium S conveying chores, and a fixing device 8 which fixes the toner image to the recording medium S after secondary image transfer, in addition to the devices and components described above.

Next, the above described devices and components will be described starting from the photosensitive drum 1.

Figure 20:
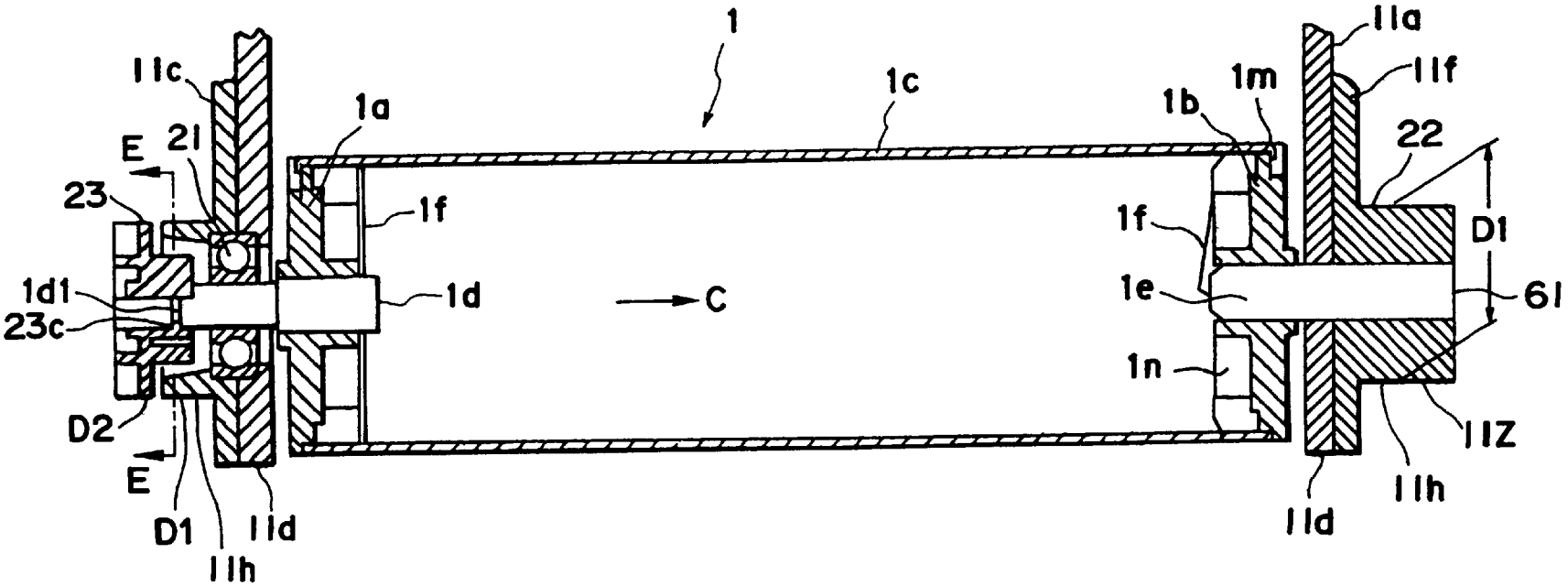
FIG. 20 is a lengthwise cross-section of a photosensitive drum and the adjacencies thereof.

Referring to FIG. 20, the photosensitive drum 1 comprises a cylinder 1*c* of, for example, aluminum, having a diameter of approximately 47 mm, and an organic photoconductor layer coated on the peripheral surface of the aluminum cylinder 1*c*. It is rotatively supported at each of the lengthwise ends by a supporting member, and is rotatively driven in the direction of an arrow in FIG. 1 as a driving force is transmitted to one of the lengthwise ends from an unillustrated driver motor.

As for the charging device 2, a contact type charging device such as the one disclosed in Japanese Patent Laid-Open Application No. 149,669/1988 may be employed. The actual charging member of the charging device 2 is an electrically conductive member in the form of a roller. The peripheral surface of the photosensitive drum 1 is uniformly charged as charge bias is applied to this roller from an unillustrated power source, with the roller being in contact with the peripheral surface of the photosensitive drum 1.

The exposing means 3 has a polygon mirror 3*a,* to which an image forming light corresponding to image signals is projected from an unillustrated laser diode. The polygon mirror 3*a* deflects the image forming light while it is rotated at high speed by an unillustrated scanner motor. The deflected image forming light is transmitted by way of an imaging lens 3*b,* a deflection mirror 3*c,* and the like, to the peripheral surface of the photosensitive drum 1, selectively exposing the surface to form an electrostatic latent image.

The developing device 4 comprises a stepping rotary member 4A, and four developing devices, that is, developing devices 4Y, 4M, 4C, and 4Bk, containing yellow, magenta, cyan, and black toner, correspondingly, mounted on the rotary member 4A.

When developing the electrostatic latent image on the photosensitive drum 1, one of the developing devices, which contains the color toner to be adhered to the latent image, is positioned at a developing station. More specifically, the rotary member 4A is rotated in steps so that the pertinent developing device is positioned at the developing station, in which the developing device squarely opposes the photosensitive drum 1, with the developing sleeve of the developing device holding a microscopic gap of approximately 300 $\mu$m from the photosensitive drum 1 to develop the electrostatic latent image on the photosensitive drum 1. A developing process follows the following steps. First, the toner within the toner container of the developing device correspondent to the color into which the latent image is developed is delivered to a coater roller 4*a* which is being rotated, by a toner conveying mechanism Then, the rotating roller 4*a* coats the delivered toner on the peripheral surface of the rotating development sleeve 4*b* in a thin layer, in coordination with a toner regulating blade 4*c*. Through this process, the toner is triboelectrically charged while being coated As development bias is applied between the development sleeve 4*b,* and the photosensitive drum 1 on which the electrostatic latent image has been formed, the toner is adhered to the electrostatic latent image, developing it into a toner image. The development sleeve 4*b* of each developing device 4Y, 4M, 4C, or 4Bk is set up to be connected to a correspondent higher voltage power source provided on the main assembly 14 of the image forming apparatus A when each developing device is positioned at the development station. Development bias is selectively applied for each color development. Further, the developing devices 4Y, 4M, 4C and 4Bk are mounted on, or dismounted from, the rotary member 4A independently from each other, and the rotary member 4A is structured to be removably mountable in the main assembly 14 of the image forming apparatus A.

The transfer unit 5 transfers all at once a plurality of toner images, which have been sequentially transferred from the photosensitive drum 1 through the primary transfer process, onto the recording medium S. The transfer unit 5 comprises an intermediary transfer belt 5*a* which runs in the direction of an arrow R5. The intermediary transfer belt 5*a* in this embodiment is approximately 440 mm in circumference, and is stretched around three rollers: a driver roller 5*b,* a secondary transfer counter-roller 5*c,* and a follower roller 5*d.* The transfer unit 5 also comprises a pressing roller 5*j,* which moves closer to the follower roller 5*d* to press the intermediary transfer belt 5*a* onto the photosensitive drum 1, or is retracted to allow the intermediary transfer belt 5*a* to be separated from the photosensitive drum 1. The intermediary transfer belt 5*a* runs in the direction of the arrow 5R as it is driven by the rotation of the driver roller 5*b.* Further, a cleaning unit 5*e,* which can be placed in contact with, or moved away from, the surface of the intermediary transfer belt 5*a,* is disposed at a predetermined location outside the loop of the intermediary transfer belt 5*a,* and plays a role in removing the toner which remains after the toner images are transferred all at once onto the recording medium S, the role of which will be described later, through the secondary transfer process. The cleaning unit 5*e* gives the residual toner reverse charge, relative to the charge given during transfer. The reversely charged residual toner is electrostatically adhered to the photosensitive drum 1, and then is recovered by the cleaning device 6 for the photosensitive drum 1, the process of which also will be described later. As for the method for cleaning the intermediary transfer belt 5*a,* it is not limited to methods employing the electrostatic cleaning means described above. For example, mechanical methods employing a blade or a fur brush, or methods employing both the electrostatic and mechanical means, are also acceptable.

The cleaning device 6 is a device which clears the photosensitive drum 1 of the so-called post-transfer residual toner, that is, the toner which remains on the peripheral surface of the photosensitive drum 1 after the toner adhered to the photosensitive drum 1 by the developing device 4 to develop the latent image is transferred onto the intermediary transfer belt 5*a* through the primary transfer process In the case of the cleaning device 6 illustrated in the drawing, the post-transfer residual toner is collected in a waste toner container portion (hereinafter, waste toner container) 11*a* of the cleaning device 6. The internal portion of the waste toner container 11*a* is not illustrated in FIG. 1, and will be described later in detail.

The feeding-conveying means 7 is a means which delivers recording media S to the image forming portion, and comprises a sheet feeder cassette 7*a,* which stores a plurality of recording media S and is installed in the bottom portion of the main assembly 14 of the image forming apparatus A. When forming images, the picker member 7*e,* and the conveyer roller 7*b,* of the feeding-conveying member 7 are rotatively driven in accordance with an image forming operation, to separate one by one the recording media S stored in the sheet feeder cassette 7*e,* guide each of the separated recording media S by the guide plate 7*c,* and deliver it to the intermediary transfer belt 5*a* by way of the registration roller 7*d.*

The fixing device 8 is a device for fixing to the recording medium S, the plurality of toner images having been transferred onto the recording medium S. As illustrated in FIG. 1, it comprises a driver roller 8*a* which is rotatively driven, and a fixer roller 8*b* which is pressed upon the driver roller 8*a* to apply heat and pressure to the recording medium S. More specifically, after passing the secondary transfer roller 5*n* which transfers all at once the toner which is on the intermediary transfer belt 5*a,* the recording medium S is passed through the fixing device 8 by the driver roller 8*a.* While the recording medium S is passed through the fixing device, heat and pressure are applied to the recording medium S by the fixing roller 86, whereby the plurality of toner images of a different color is fixed to the surface of the recording medium S.

Next, the image forming operation of an image forming apparatus structured as described above.

The photosensitive drum 1 is rotated in the direction of the arrow mark, that is, the counterclockwise direction, in FIG. 1, in synchronism with the rotation of the intermediary transfer belt 5*a* to uniformly charge the peripheral surface of the photosensitive drum 1 by the charging device 2. The charged peripheral surface of the photosensitive drum 1 is exposed to an optical image representing the yellow component of a target image, by the exposing means 3. As a result, an electrostatic latent image correspondent to the yellow component of the target image is formed on the peripheral surface of the photosensitive drum 1. While the electrostatic latent image is formed, the developing device 4 is driven to position the yellow color developing device 4Y at the developing position At the developing position, such voltage that has the same polarity as the charge on the photosensitive drum 1 and is substantially the same in potential level is applied to the development sleeve 4*b* of the developing device 4Y. As a result, the yellow toner is adhered to the electrostatic latent image, developing the latent image into a yellow toner image. The thus formed yellow toner image is transferred (primary transfer) onto the intermediary transfer belt 5*a* by applying a voltage which has the polarity opposite to the polarity of the toner, to the primary transfer roller 5*d* (follower roller).

After the above described primary transfer of the yellow toner image is completed, the next developing device is rotatively shifted and is positioned at the development position at which the developing device squarely opposes the photosensitive drum 1. Thereafter, the processes of forming an electrostatic latent image, developing the electrostatic latent image, and transferring the toner image onto the intermediary transfer belt, are sequentially repeated for the magenta, cyan, and black color components of the target image. As a result, four toner images of a different color are superimposed on the intermediary transfer belt 5*a.* Then, these color toner images are transferred (secondary transfer) all at once onto the recording medium S which is delivered from the feeding-conveying means 7.

After the secondary transfer, the recording medium S is conveyed to the fixing device 8, in which the toner images are fixed to the recording medium S. Thereafter, the recording medium S is discharged into an external delivery tray 10 of the main assembly 14 of the image forming apparatus A by a belt 9*a* which moves in the direction of an arrow mark in the drawing, and a discharge roller 9 which is rotated by the belt 9*a* which is suspended by the discharge roller 9, ending a single cycle of image formation.

Next, the general procedure for installing the process cartridge B into the image forming apparatus main assembly 14 will be described.

Figure 2:
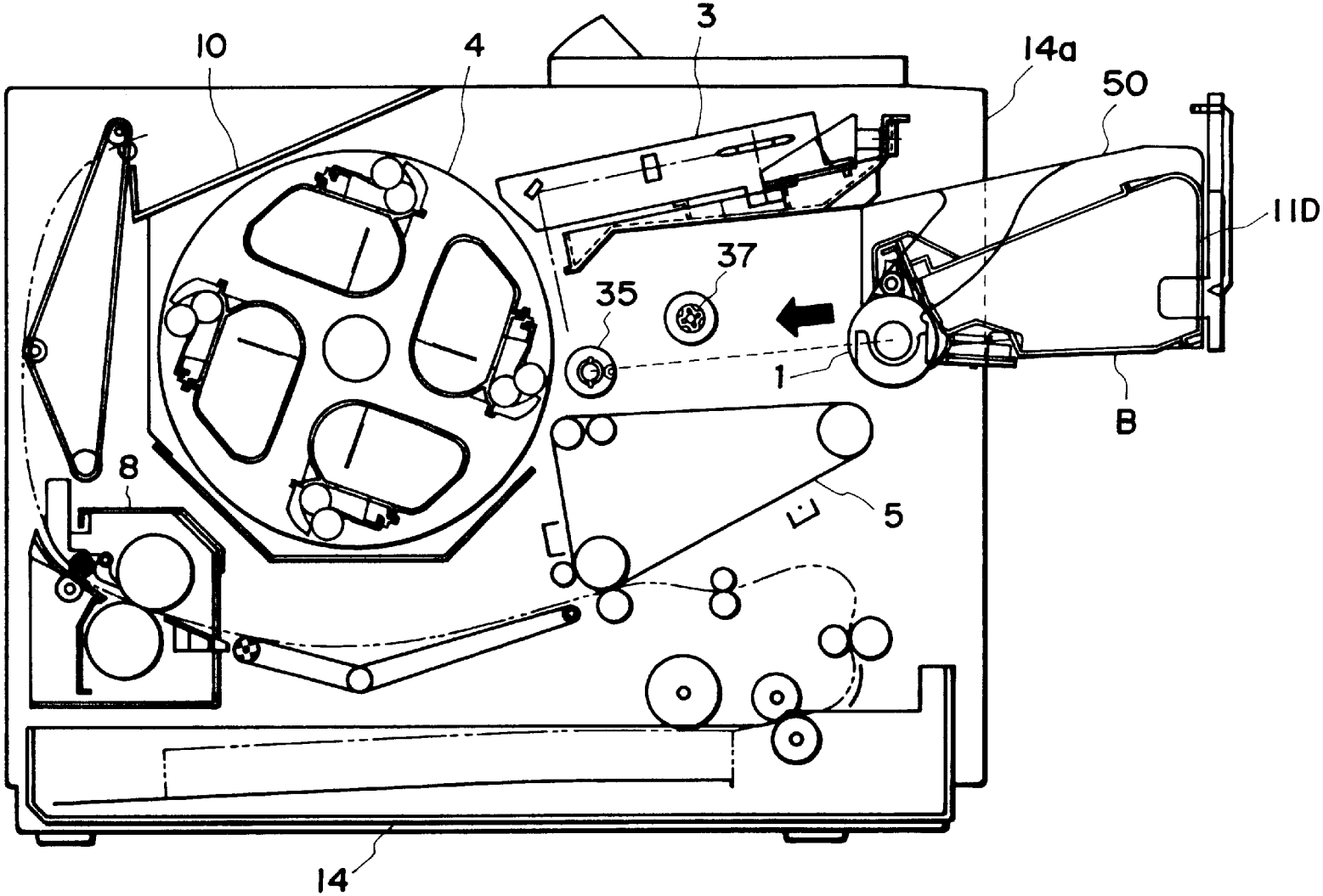
FIG. 2 is a vertical section of the same apparatus that is illustrated in FIG. 1, and depicts how a process cartridge is installed into, or removed from, the main assembly of the apparatus.
Figure 15:
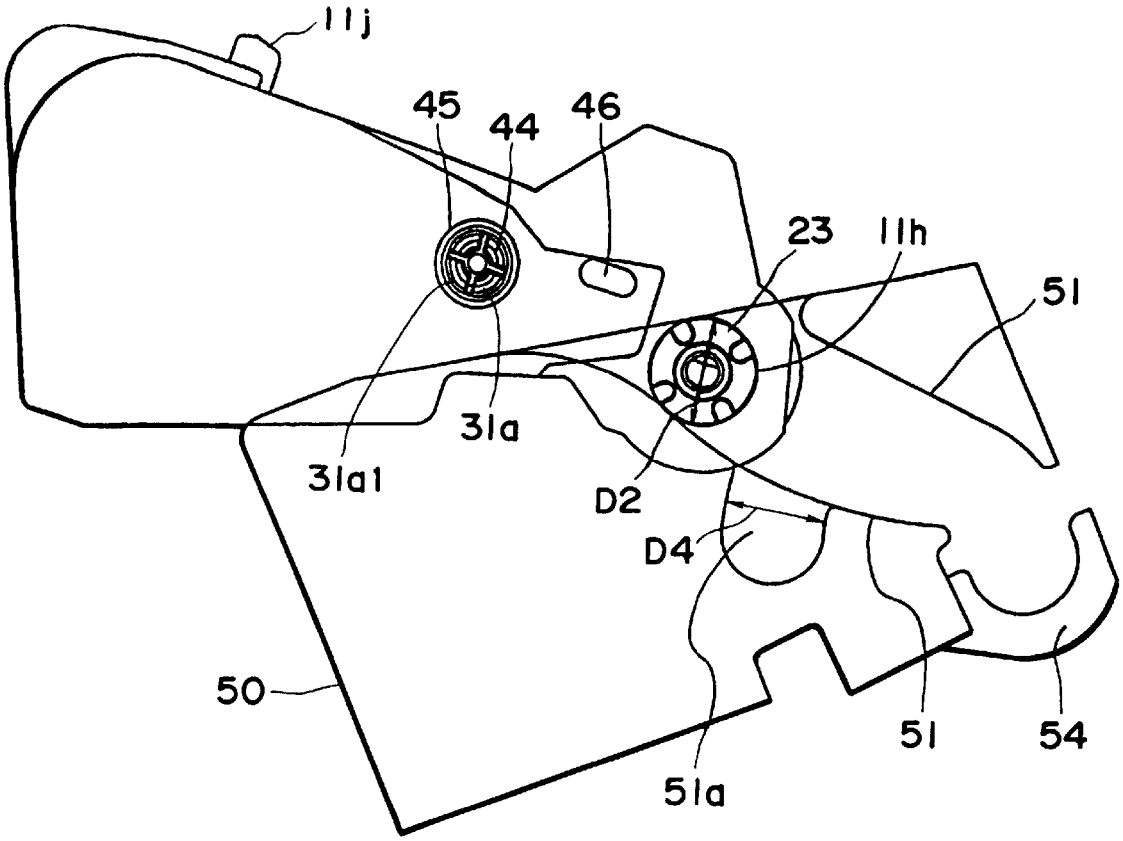
FIG. 15 is a schematic drawing which depicts the initial stage of the process cartridge installation into the cartridge guide.
Figure 16:
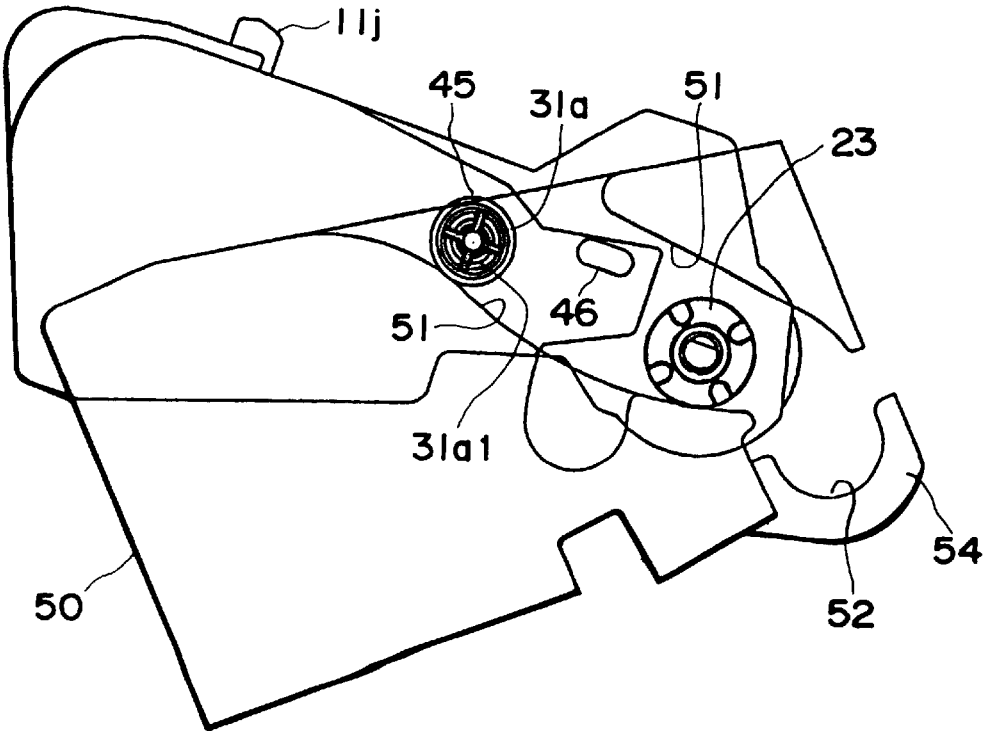
FIG. 16 is a schematic drawing which depicts the second stage of the process cartridge installation into the cartridge guide.
Figure 17:
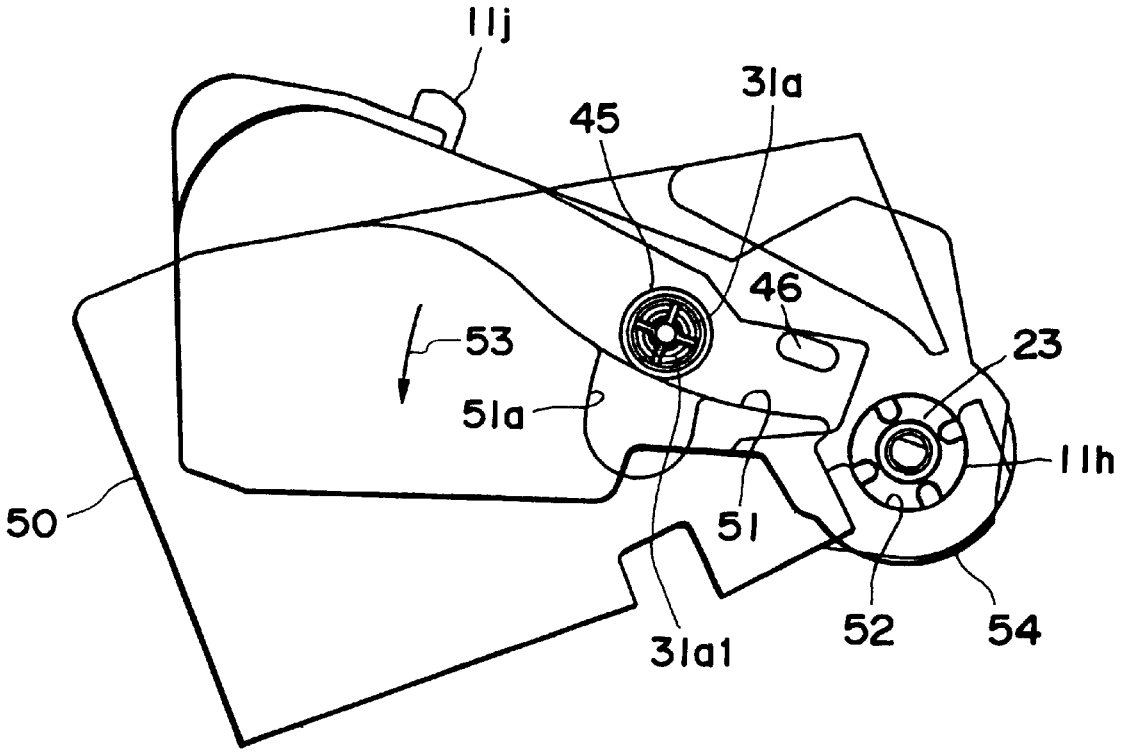
FIG. 17 is a schematic drawing which depicts the third stage of the process cartridge installation into the cartridge guide.
Figure 18:
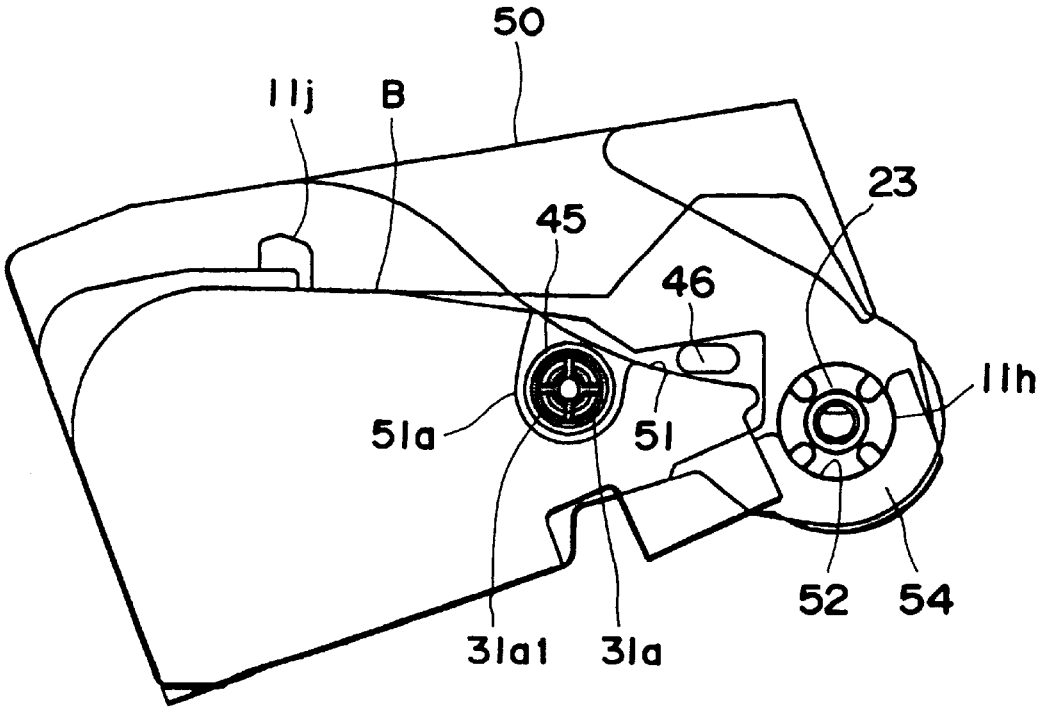
FIG. 18 is a schematic drawing which depicts the final stage of the process cartridge installation into the cartridge guide.

Referring to FIG. 2, the image forming apparatus main assembly 14 comprises a cartridge guide 50 for guiding the process cartridge B into the image forming apparatus main assembly 14. In order to install the process cartridge B, the cartridge guide 50 is pulled out, and the process cartridge B is inserted into the cartridge guide 50, with the axle coupler 23 and cylindrical guide 11Z (FIG. 47) of the process cartridge B being guided by the guiding surface 51, as illustrated in FIGS. 15 and 16. The axle coupler 23 is coaxial with the photosensitive drum 1 of the process cartridge B. Then, a cylindrical positioning boss 11*h* of the process cartridge B, which extends from the wall of the lengthwise end of the process cartridge B in the same direction as the axle coupler 23, drops into the U-shaped groove 52 of the cartridge guide 50, and the process cartridge B pivots in the direction of an arrow 53 about the cylindrical positioning boss 11*h* as shown in FIG. 17. As a result, the process cartridge B settles into the cartridge guide 50 as shown in FIG. 18.

Next, the cartridge guide 50 is pushed into the image forming apparatus A as illustrated in FIG. 1 to ready the image forming apparatus A for image formation.

{Process Cartridge Frame}

Figure 3:
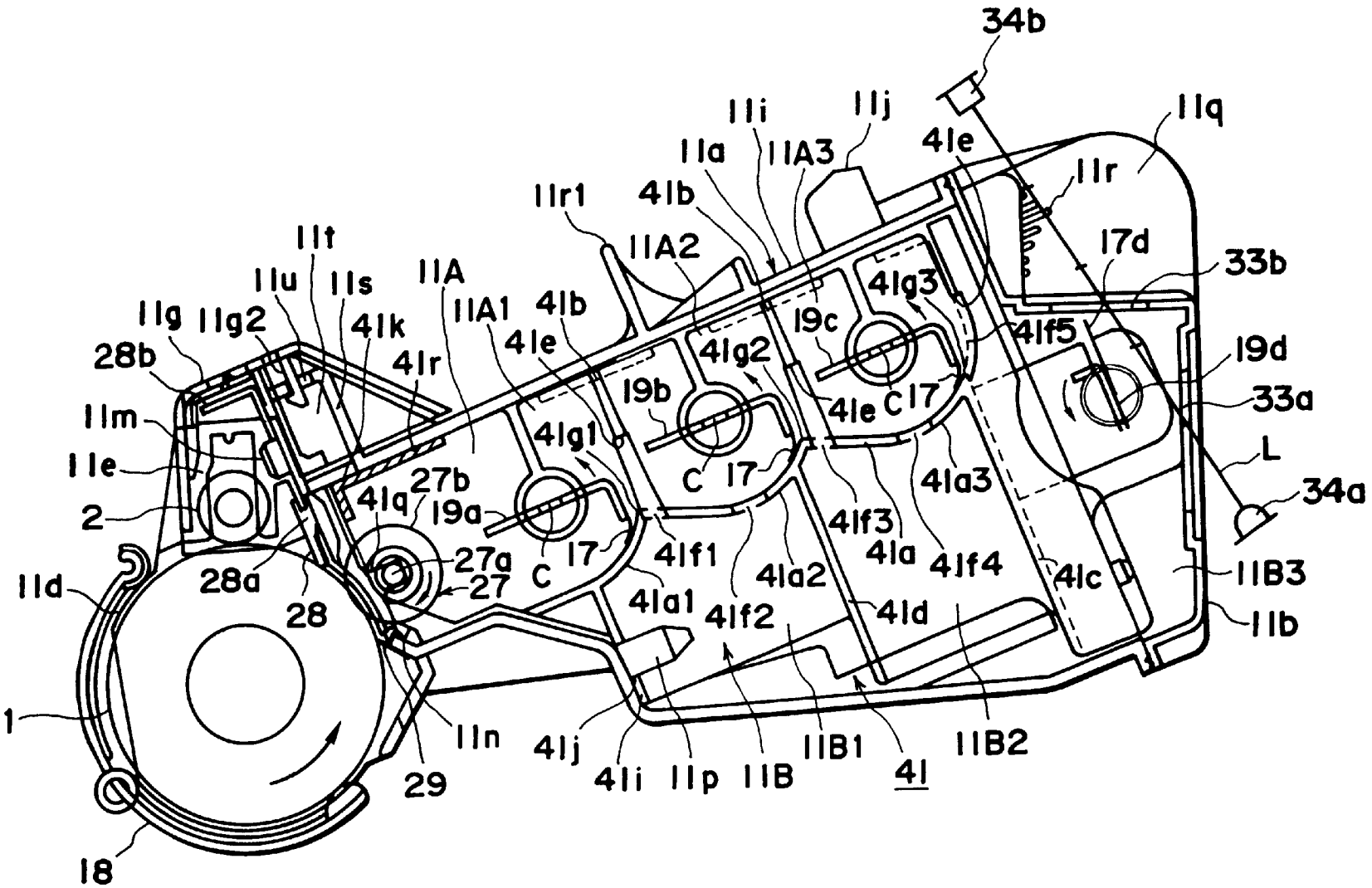
FIG. 3 is a side elevation of a process cartridge.
Figure 6:
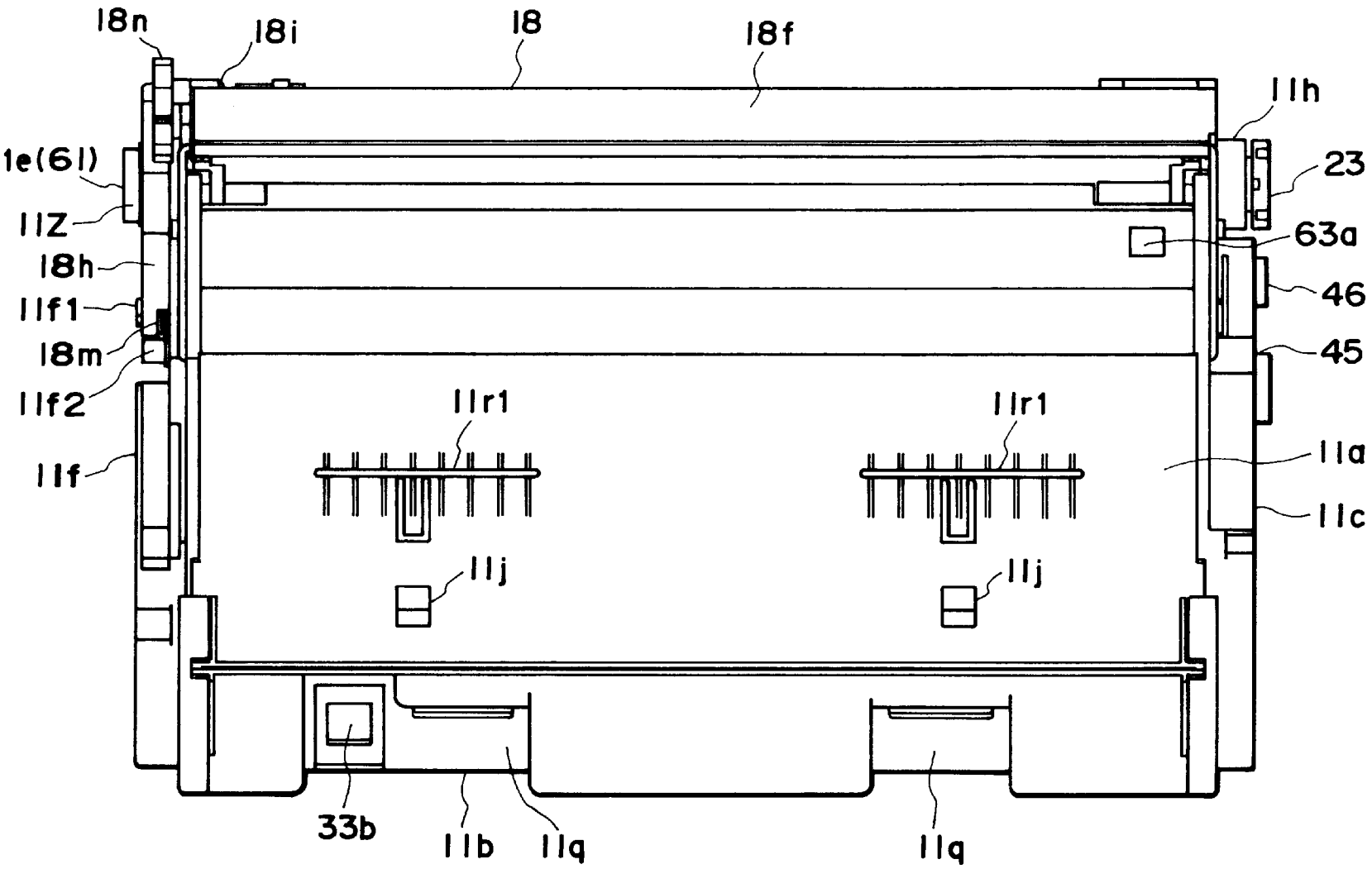
FIG. 6 is a top view of the process cartridge illustrated in FIG. 3.
Figure 7:
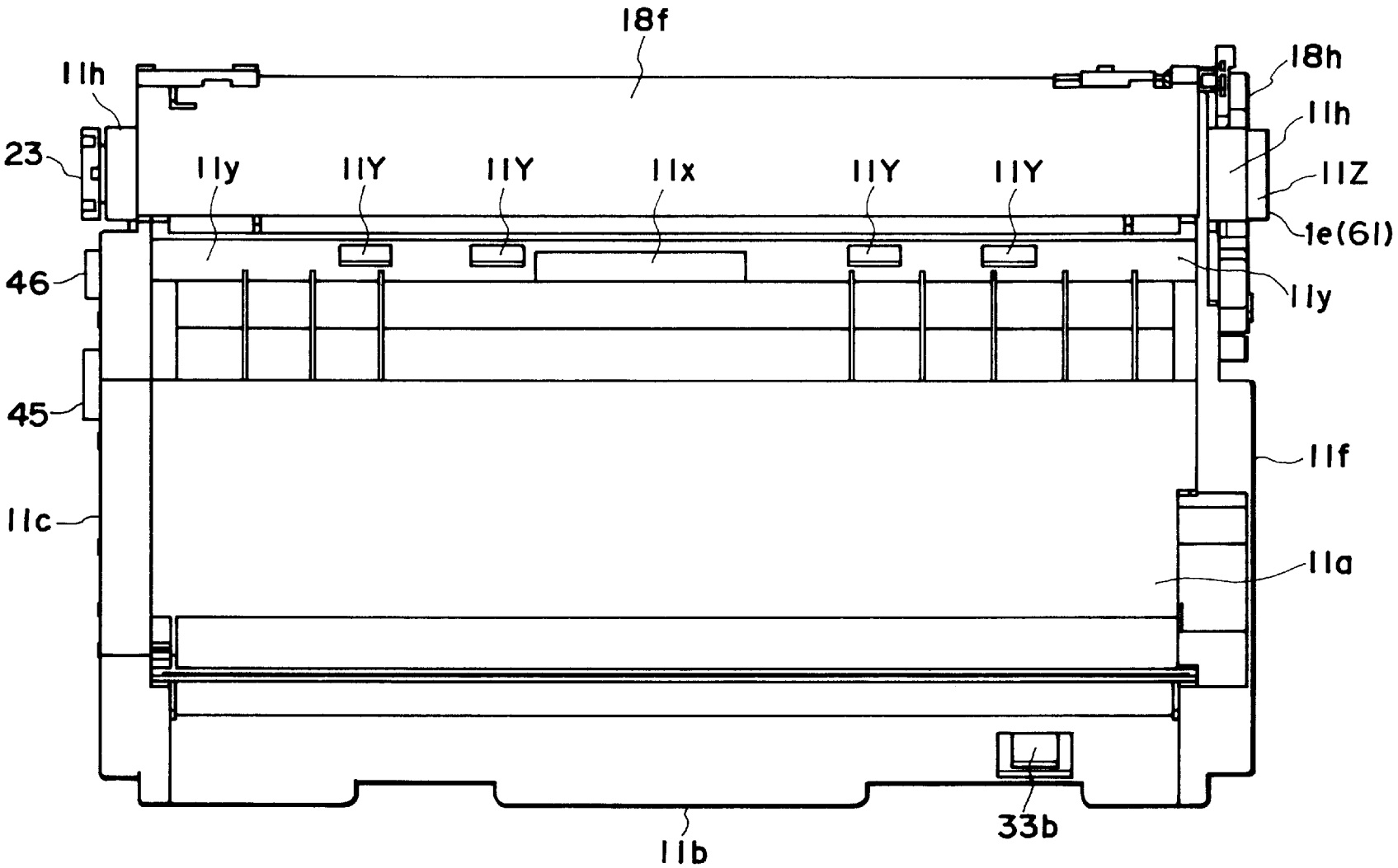
FIG. 7 is a bottom view of the process cartridge illustrated in FIG. 3.
Figure 8:
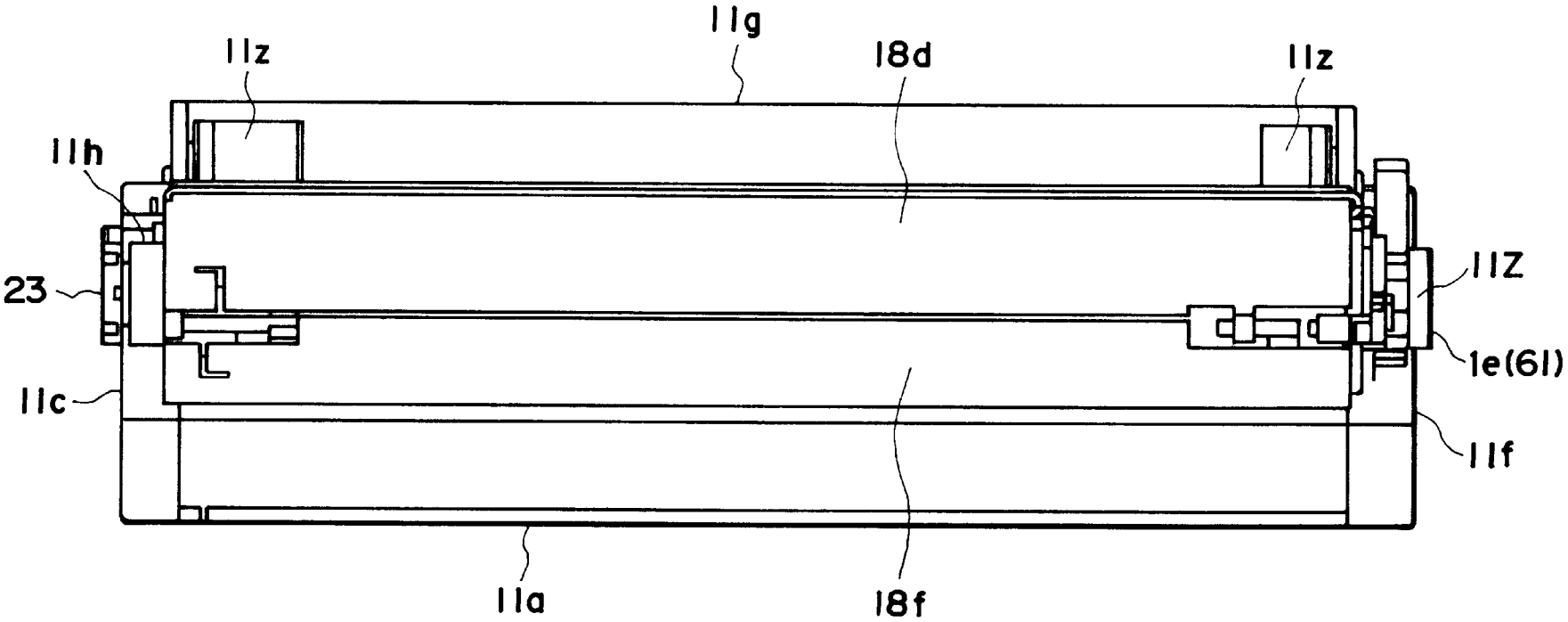
FIG. 8 is a front view of the process cartridge illustrated in FIG. 3.
Figure 9:
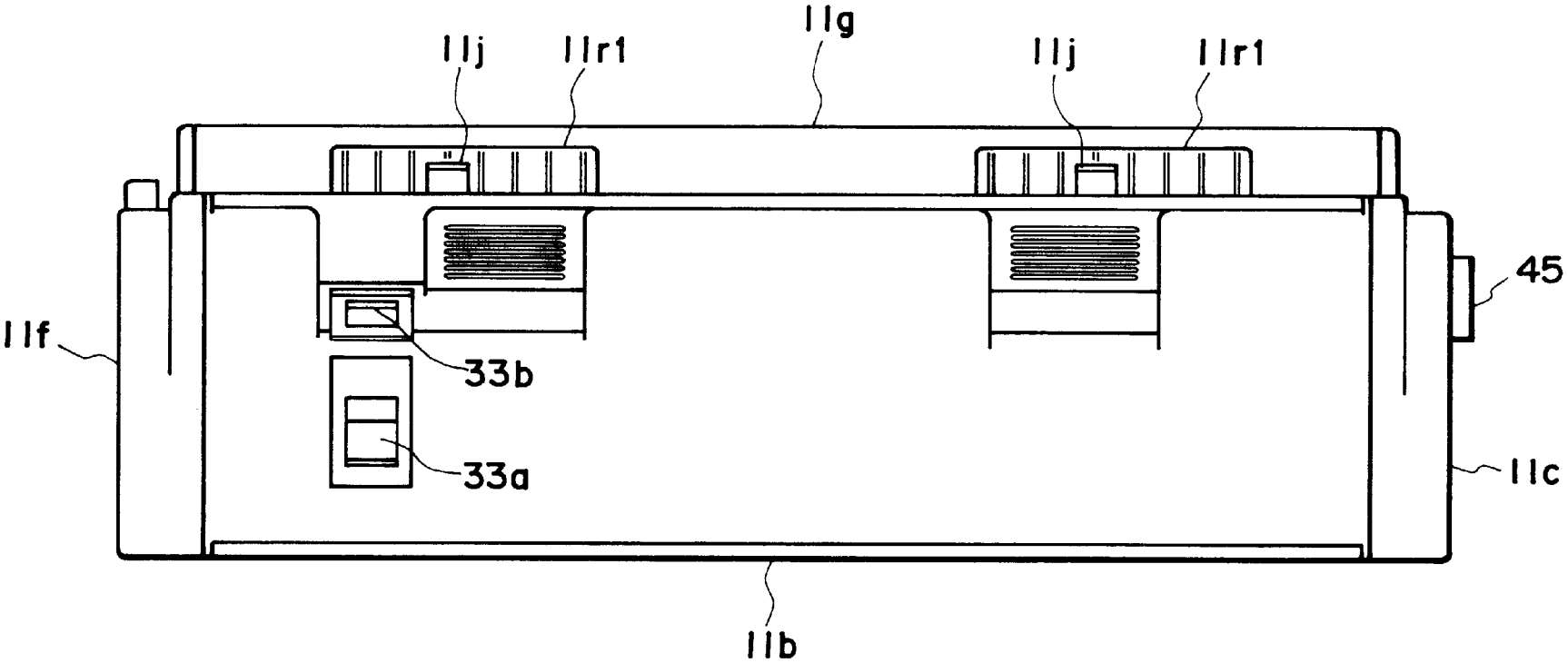
FIG. 9 is a rear view of the process cartridge illustrated in FIG. 3.

Referring to FIG. 3, the cartridge frame 11 of the process cartridge B comprises a drum support portion 11*d,* a waste toner container 11*a,* and a rear portion 11*b.* The drum support portion 11*d* is located at each longitudinal end of the photosensitive drum 1 and charging device 2, and extends from the waste toner container 11*a* in the direction perpendicular to the axial direction of the photosensitive drum 1 and the charging device 2. The waste toner container 11*a* has a cleaning member mount 11*m* and a charging device support portion 11*e.* The rear portion 11*b* is joined with the rear end portion of the waste toner container 11*a* by ultrasonic welding. Referring to FIG. 6, the cartridge frame 11 is covered with a gear cover 11*c* (one of the side covers), on the side from which the process cartridge B is driven; in other words, the waste toner container 11*a* and the rear portion 11*b* are covered by the gear cover 11*c,* on the side from which the process cartridge B is driven. To the other lengthwise end of the process cartridge B, which is the side opposite to the side from which the process cartridge B is driven, a side cover 11*f* is attached. Further, a charging device cover 11*g,* which covers the charging device 2, on the top side and both the lengthwise ends, is attached to the waste toner container 11*a.*

The waste toner container 11*a* is provided with a shutter 18 to prevent the photosensitive drum 1 from being exposed to external light and/or coming in contact with the user when the photosensitive drum 1 is taken out of, or is out of, the apparatus main assembly 14.

{Process Cartridge}

Referring to FIG. 3, the process cartridge B comprises the photosensitive drum 1, the charging device 2, and the cleaning device 6 The charging device 2 and the cleaning device 6 are disposed adjacent to the peripheral surface of the photosensitive drum 1. They are integrally mounted in the cartridge frame 11, being thereby formed into a process cartridge B removably placeable in the cartridge guide 50.

Figure 21:
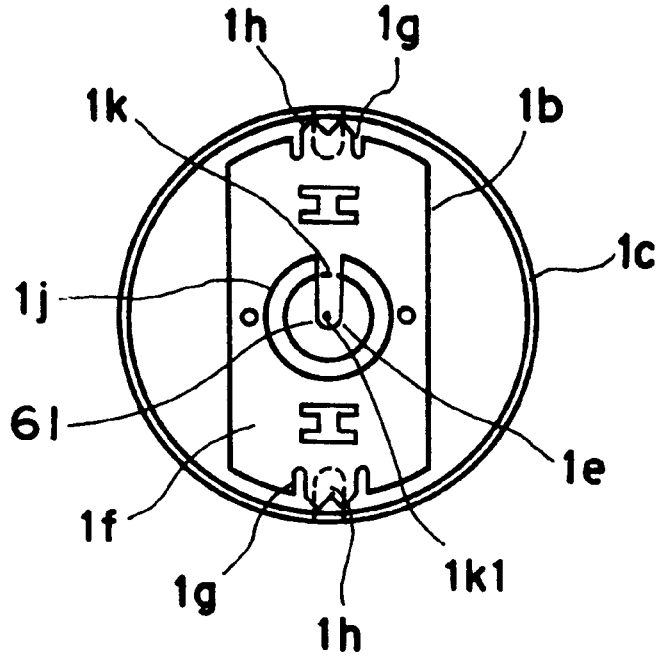
FIGS. 21 (*a*) and (*b*) are cross-sections of the photosensitive drum illustrated in FIG. 20, at the point indicated by an arrow C in FIG. 20, and at a line E—E in FIG. 20, respectively.
Figure 21:
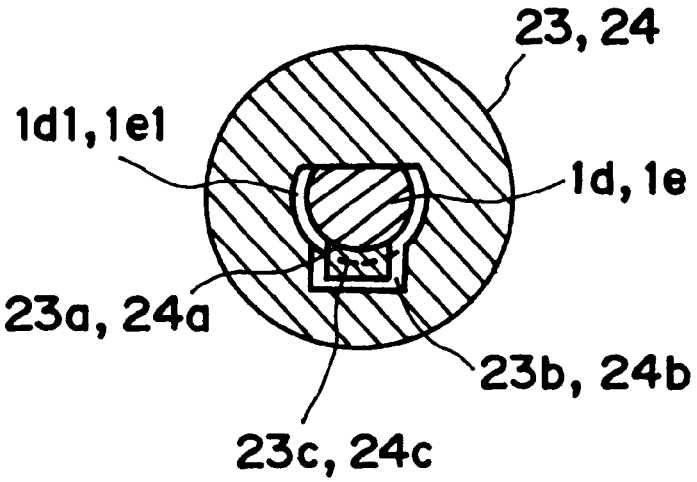

Referring to FIGS. 20 and 21, the photosensitive drum 1 is rotatively supported by the waste toner container 11*a.* At the left and right lengthwise ends of the photosensitive drum 1, drum flanges 1*a* and 1*b* are rigidly fitted within the aluminum cylinder 1*c* of the photosensitive drum 1, respectively. The drum flanges 1*a* and 1*b* are fixed to the aluminum cylinder 1*c* by crimping the lengthwise end of the aluminum cylinder 1*c* at four locations. The drum flanges 1*a* and 1*b* are fitted with drum support axles 1*d* and 1*e,* respectively, which are pressed into the drum flanges 1*a* and 1*b* by the portion with the maximum diameter. The drum support axles 1*d* and 1*e* fit in the corresponding drum support portions 11*d* of the waste toner container 11*a;* more specifically, they are fitted in a ball bearing 21 and a bushing 22 of synthetic resin, being rotatively supported. The ball bearing 21 and the bushing 22 are fixedly supported by the gear cover 11*c* and the side cover 11*f* so that they do not dislodge.

The waste toner container 11*a* is provided with the cylindrical positioning bosses 11*h* which are integral with the gear cover 11*c* and side cover 11*f,* respectively, and play a role in installing the process cartridge B into the apparatus main assembly 14. The top wall portion 11*i* of the waste toner container 11*a* is provided with a rotation stopper 11*j,* which is integrally formed with the top wall portion 11*i* (FIGS. 3, 6, 9–11, 13, and 15–19).

The positioning bosses 11*h* are coaxially disposed with the axle couplers 23 and 24, next to the axle couplers 23 and 24, which are attached to the drum supporting axles 1*d* and 1*e,* respectively The diameter of the positioning boss 11*h* is slightly larger than those of the axle couplers 23 and 24. The outward surfaces of the cylindrical positioning boss 11*h* in the lengthwise direction of the process cartridge B are even with, or slightly inward of, the outward surfaces of the gear cover 11*c* and the side cover 11*f,* respectively. The positions of the axle couplers 23 and 24 in the lengthwise direction of the process cartridge B are outward of the outward surfaces of the gear covers 11*c* and the side covers 11*f,* respectively. The external diameter D1 of the cylindrical positioning boss 11*h* is larger than the external diameter D2 of the axle coupler 23 or 24.

Figure 4:
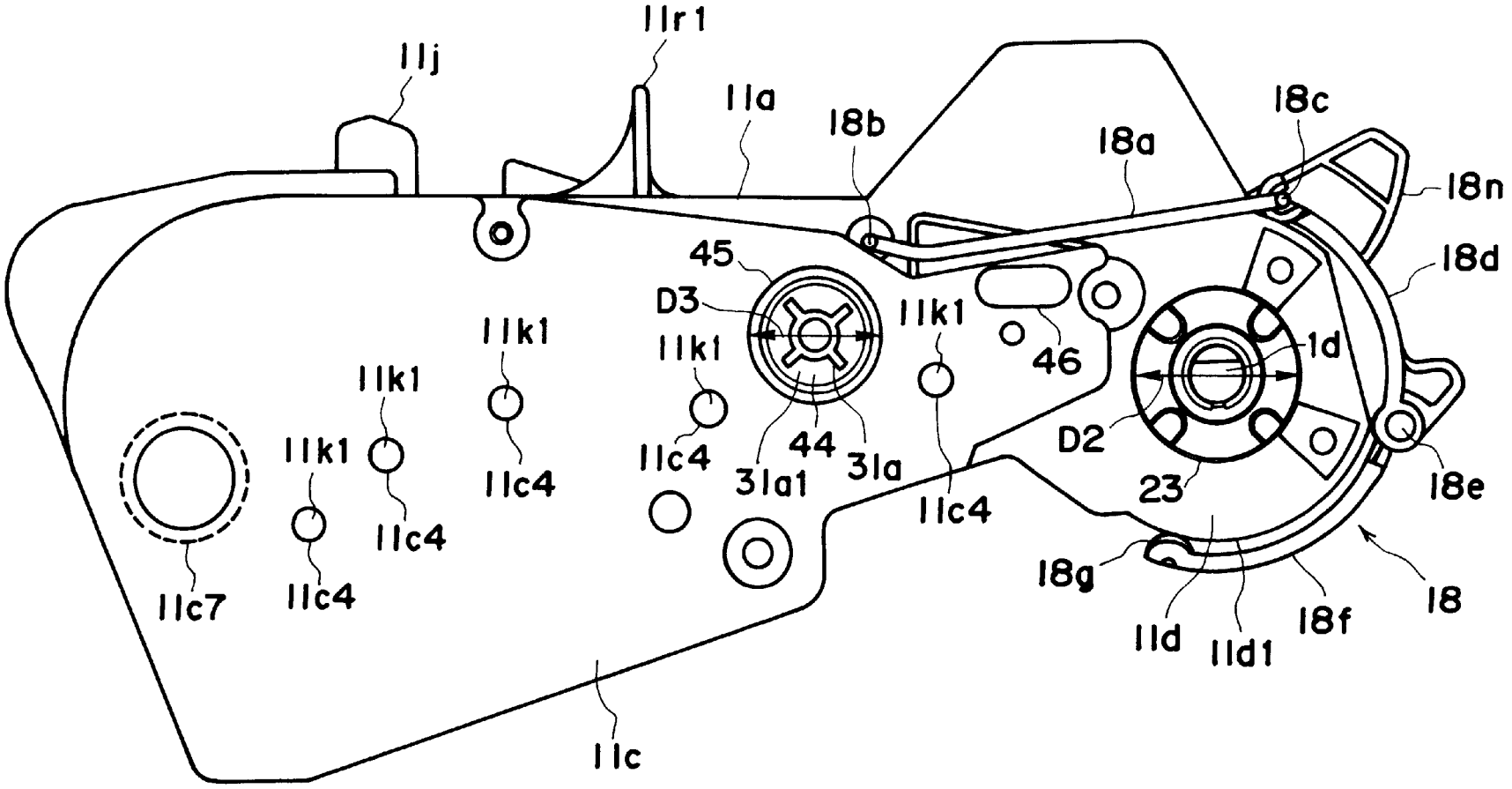
FIG. 4 is a right-hand side view of the process cartridge illustrated in FIG. 3.
Figure 10:
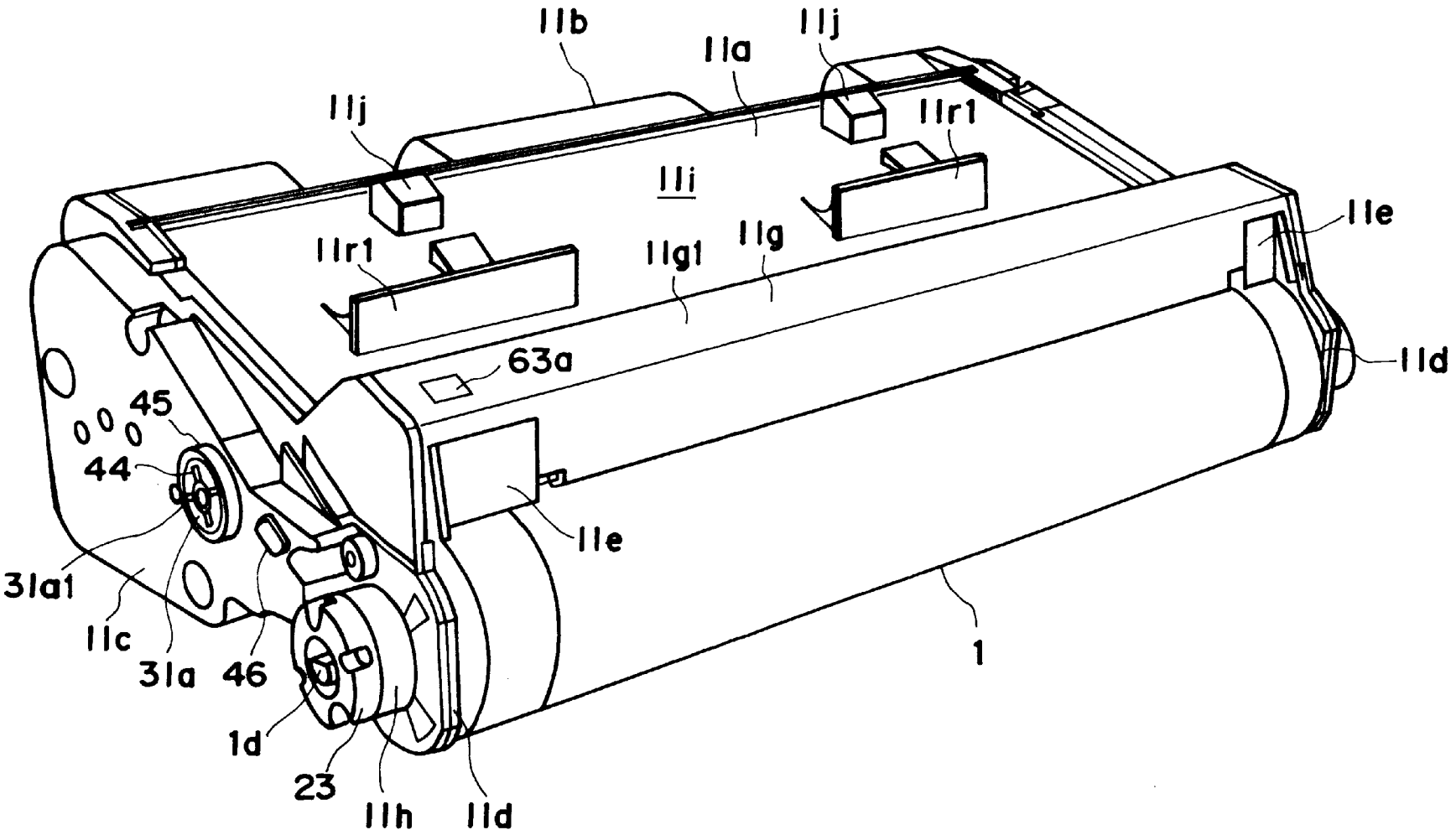
FIG. 10 is a perspective view of the process cartridge illustrated in FIG. 3 as seen from the right front.

Referring to FIGS. 4 and 10, on the upstream side of the axle coupler 23 relative to the direction in which the process cartridge B is inserted is a means 44 for transmitting the force for driving a toner conveyance system. This input force transmitting means 44 is protected by the second cylindrical boss 45, which is integral with the gear cover 11*c* fixed to the waste toner container 11*a.* The position of the second cylindrical boss 45 in the lengthwise direction is outward of the outward surface of the gear cover 11*c,* and is inward of the outermost portion of the axle coupler 23. The external diameter D3 of the second cylindrical boss 45 is smaller than the external diameter D2 of the axle coupler 23 or 24.

On the upstream side of the axle couplers 23 and 24 and on the downstream side of the second cylindrical boss 45, relative to the direction of the process cartridge B insertion, a rough guide 46 is disposed, which is integral with the gear cover 11*c.* The rough guide 46 is above the line formed by connecting the centers of the axle coupler 23 and the second cylindrical boss 45. The position of the rough guide 46 in the longitudinal direction is outward of the outward surface of the gear cover 11*c* and inward of the outermost surface of the axle coupler 23.

The top surface portion 11*i* of the waste toner container 11*a* is provided with the rotation stopper 11*j,* which is located on the upstream side of the second cylindrical boss 45 relative to the direction of the process cartridge B insertion.

{Movable Member for Removably Inserting Process Cartridge}

Figure 14:
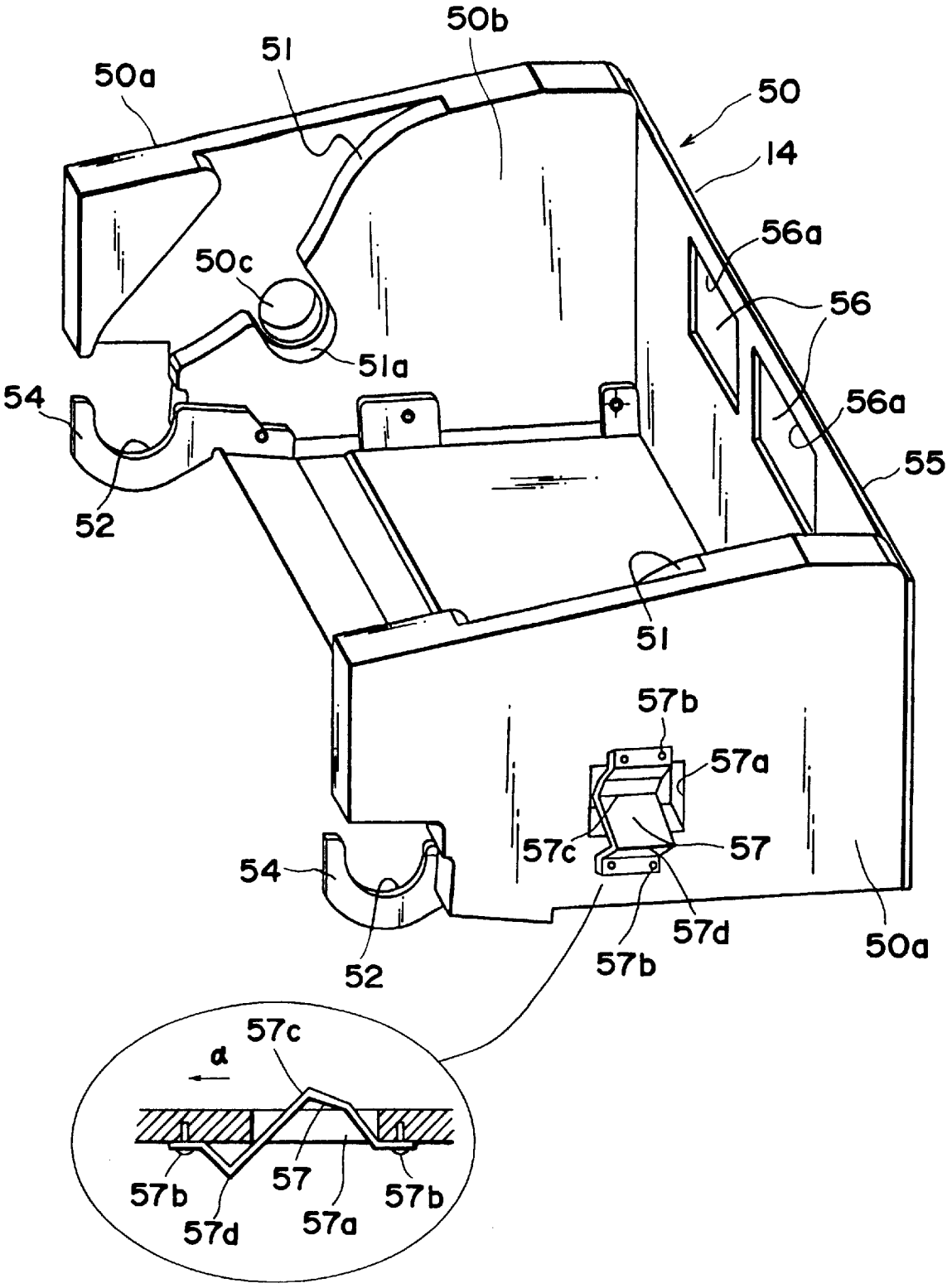
FIG. 14 is a perspective view of a cartridge guide, with an appended cross-section of the spring portion.

Referring to FIGS. 14 and 15, the cartridge guide 50 with a drawer mechanism to be used for the installation or removal of the process cartridge B will be described in detail. The internal surface 50*b* of the side plate 50*a* of the cartridge guide 50 is provided with a guiding surface 51, which is constituted of the vertical surface of the groove cut in the side plate 50*a* of the cartridge guide 50 to guide the process cartridge B. The guiding surfaces 51 on the left and right sides are symmetrical to each other. A portion of the guiding surface 51 on the side from which the process cartridge B is driven forms a substantially semicircular contour, as seen from the side, which coincides with the contour of the through hole 50*c* cut through the side plate 50*a* to transmit driving force from the apparatus main assembly 14 to a means 44 for transmitting force to drive a waste toner conveyance system. On the downstream side, relative to the direction of the process cartridge B insertion, and on the inward side, relative to the lengthwise direction, of the guiding surface 51, a latching member 54 is provided, which engages with the cylindrical positioning boss 11*h.* This latching member 54 is in the form of a half ring which opens upward; it is provided with a U-shaped groove 52.

The rear plate 55 on the most upstream side relative to the direction of the process cartridge B insertion is provided with a pressing member 56 which presses the process cartridge B, on the most upstream portion 11D of the cartridge frame 11 when the cartridge guide 50 is pushed back into the image forming apparatus main assembly 14.

Figure 19:
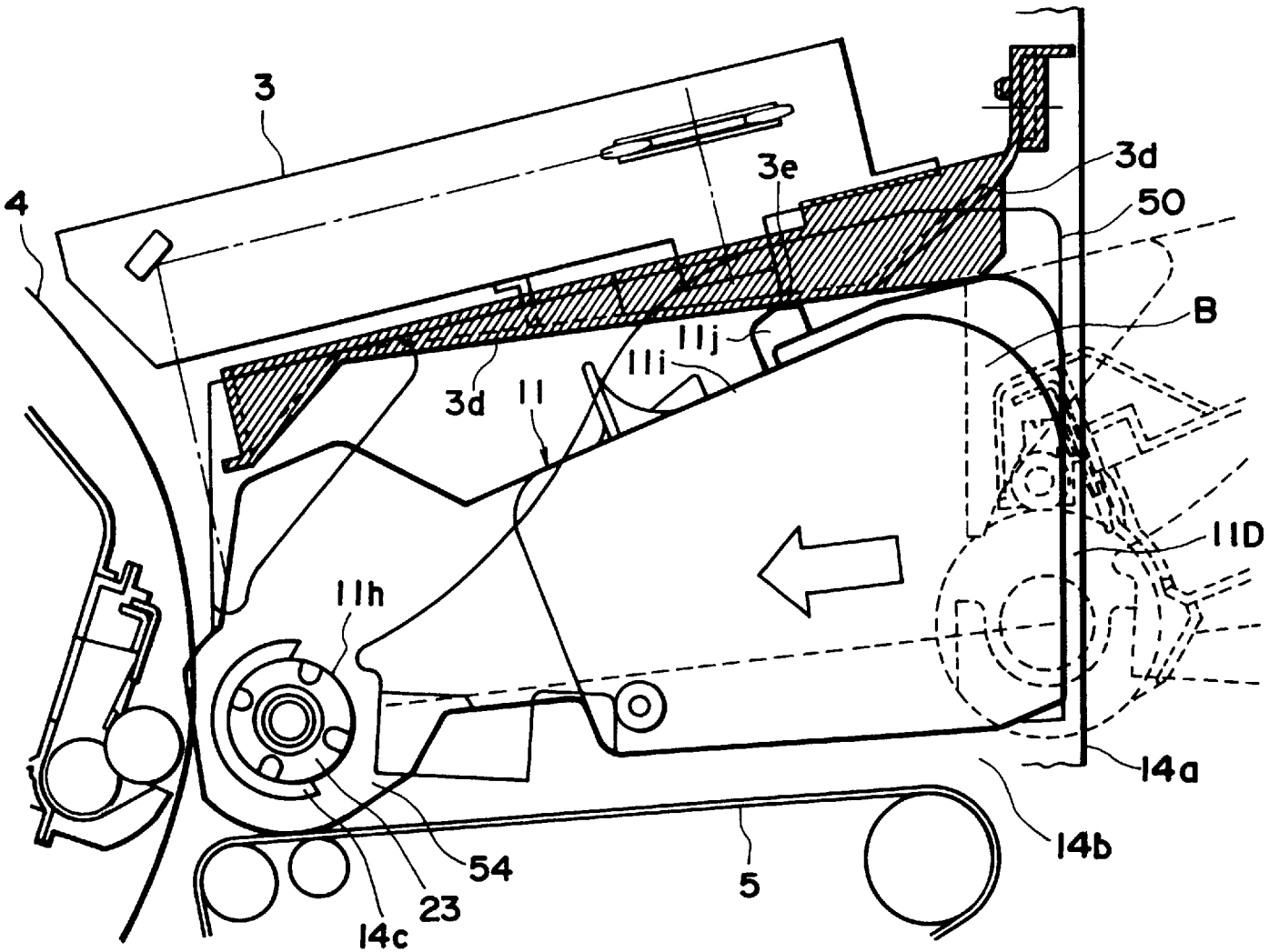
FIG. 19 is a schematic drawing which depicts how the process cartridge placed in the cartridge guide is moved into the apparatus main assembly.

The pressing member 56 is an elastic member such as a plate spring, which is provided on the inward surface of an unillustrated lid for exposing or covering the opening 14*b* of the rear wall 14*a* of the casing of the apparatus main assembly 14 (FIG. 19). The cartridge guide 50 is provided with an opening 56*a* so that the pressing member 56 is allowed to enter the cartridge guide 50 to press the rear portion 11*b* of the process cartridge B after the process cartridge B is placed in the cartridge guide 50.

The side plate 50*a* of the cartridge guide 50, on the side opposite to the side from which the process cartridge B is driven, is provided with an elastic pressing member 57, which is structured so that it comes in contact with the lengthwise end (side cover 11*f*) of the process cartridge B through the opening 57*a* of the side plate 50*a,* elastically pressing the process cartridge B in the lengthwise direction.

More specifically, the elastic pressing member 57 is a plate spring, and is attached, with small screws 57*b,* to the side plate 50*a* of the cartridge guide 50 at each end, vertically across the opening 57*a* of the side plate 50 as shown in FIG. 14. The elastic pressing member 57, exclusive of the end portions, is substantially in the form of a crankshaft, and a bend portion 57*c,* that is, one of the bends equivalent to the elbow portions of a crankshaft, protrudes into the cartridge guide 50 through the opening 57*a,* and the other bend portion 57*d* projects outward from the side plate 50*a.* Therefore, as the process cartridge B is pushed into the cartridge guide 50 in the direction of arrow d placed in the sectional view (FIG. 14) of the plate spring, the process cartridge B is pressed, on the lengthwise end, by the bend 57*c* of the elastic pressing member 57. As a result, the process cartridge B in the cartridge guide 50 pushes back the bend 57*c* of the plate spring, being pressed by the reactional force, upon the inward surface 50*b* of the cartridge guide 50 on the side from which the process cartridge B is driven. Further, when the cartridge guide is in the apparatus main assembly 14, the bend 57*d* of the plate spring is pressed by the apparatus main assembly 14. As a result, the cartridge guide 50 is pressed upon the apparatus main assembly 14, on the side from which the process cartridge B is driven, adding to the force by which the process cartridge B is pressed upon the inward surface 50*b* on the side from which the process cartridge B is driven. The side from which the process cartridge B is driven (hereinafter, "driven side") means the right-hand side, as seen from above, relative to the direction in which the process cartridge B is inserted or removed, and the cartridge guide 50 is pulled out or pushed in, and the axle coupler on the apparatus main assembly 14 is disposed on the driven side.

{Operation for Placing Process Cartridge into Movable Member and Operation for Removing Process Cartridge from Movable Member}

Referring to FIGS. 15–18, an operation for placing the process cartridge B in the movable member and an operation for removing the process cartridge B from the movable member will be described in detail. FIGS. 15–18 are phantom side views of the side plate 50*a,* on the driven side, of the cartridge guide 50, as seen from the outward side.

Referring to FIG. 15, when placing the process cartridge B in the cartridge guide 50, first, the external peripheral surface of the axle coupler 23 fixed to the photosensitive drum 1 is rested on the guiding surface 51 of the cartridge guide 50, and the process cartridge B is pushed inward of the cartridge guide 50 allowing the axle coupler 23 to slide on the guiding surface 51. Although a portion of the guiding surface 51 on the driven side forms a U-shaped recess 51*a,* the axle coupler 23 does not drop into the U-shaped recess 51*a* during the insertion of the process cartridge B. This is because the width D4 of the recess 51*a* is smaller than the external diameter D2 of the axle coupler 23. Further, the guide surface 51 on which the axle coupler 24 on the side from which the process cartridge 3 is not driven (hereinafter, "non-driven" side) rides does not have a U-shaped recess like the U-shaped recess 51*a.* Therefore, the process cartridge B can be smoothly placed in the cartridge guide 50 simply by holding the handholds 11*r* and 11*r*1 at the rear and top portions (FIG. 3), respectively, of the process cartridge B by hand (FIG. 16).

As the process cartridge B is inserted as far as the position illustrated in FIG. 16, the second cylindrical boss 45 as well as the rough guide 46 begin to be guided by the guiding surface 51. The second cylindrical boss 45 functions to prevent the rear portion of the process cartridge B, relative to the direction of the insertion, from rotating downward about the center of the axle coupler 23, and the rough guide 46 functions to prevent the same rear portion of the process cartridge B from rotating upward about the axle coupler 23. Therefore, it is unlikely that the process cartridge B will be erroneously inserted.

Referring to FIG. 17, as the process cartridge B is farther inserted, the axle coupler 23 moves beyond the guiding surface 51, and the cylindrical positioning boss 11*h* engages with the latching member 54, fixing thereby the position of the axial line of the photosensitive drum 1 of the process cartridge B relative to the cartridge guide 50. Since the external diameter of the cylindrical positioning boss 11*h* is larger than that of the axle coupler 23, it does not occur that the driving force for the process cartridge B is affected by the interference between the latching member 54 and the axle coupler 23 as it is transmitted into the process cartridge B.

At the same time, the second cylindrical boss 45 drops into the U-shaped recess 51*a* located at substantial mid portion of the guiding surface 51, temporarily fixing the orientation of the process cartridge B relative to the cartridge guide 50. At this point in time, the elastic pressing member 57 of the cartridge guide 50 begins to press the side cover 11*f* fixed to the waste toner container 11*a,* on the non-driven side. As a result, the process cartridge B is pressed toward the driven side, causing the gear cover 11*c* on the driven side to be placed in contact with the inward surface 50*b* of the cartridge guide 50. Consequently, the position of the process cartridge B in the lengthwise direction is fixed.

Since the axle coupler 23 is disposed most outward in the lengthwise direction, the distance the driving force has to be transmitted from the apparatus main assembly 14 to the process cartridge B is short, which is desirable. Further, since the axle coupler 23 is guided by the guiding surface 51, it is unnecessary to provide the side wall of the process cartridge B, on the lengthwise ends, with a dedicated guide for the axle coupler 23, and therefore, space in the lengthwise direction can be reduced. In addition, the cylindrical boss 45, which constitutes the second guide, and the rough guide 46, are also guided by the guiding surface 51 when the process cartridge B is placed in-the cartridge guide 50. Therefore, the rotational movement of the process cartridge B about the axle coupler 23 is regulated. As a result, the process cartridge B is prevented from being erroneously inserted, improving the operational efficiency. The latching member 54 of the cartridge guide 50 is disposed to be engaged with the cylindrical positioning boss 11*h* located inward of the axle coupler 23 in the lengthwise direction, and therefore, the space which the cartridge guide 50 occupies in the lengthwise direction can be reduced.

In the foregoing paragraphs, the operation was described with reference to the driven side. In this paragraph, the operation of the axle coupler 24 on the non-driven side will be described The axle coupler 24 plays substantially the same role as the one played by the axle coupler 23 on the driven side. More specifically, the guiding surface 51 with which the axle coupler 24 on the non-driven side engages does not have a U-shaped recess like the U-shaped recess 51*a.* Further, the guiding surface 51 on the left and the guiding surface 51 on the right-hand side are symmetrical as seen from the direction from which the process cartridge B is inserted. The axle couplers 23 and 24 are the same in diameter and are coaxial with the photosensitive drum 1.

Therefore, the axle coupler 24 on the non-driven side slides on the guiding surface 51 which is without a U-shaped recess, and drops into the U-shaped positioning groove 52 at the same time as the axle coupler 23. It should be noted here that the axle coupler 24 may be constituted of a circular plate as long as it is symmetrical with the axle coupler 23 in terms of external diameter and width. This is because it does not function as a "real" coupler.

{Portions Related to Installation and Removal of Process Cartridge of Image Forming Apparatus}

Next, referring to FIG. 19, the portions related to the installation and removal of the process cartridge of an image forming apparatus will be described.

Among the lateral walls of the image forming apparatus main assembly 14, the rear wall 14*a*, which is located on the opposite side of the developing device 4 as seen from the photosensitive drum 1, is provided with the opening 14*b* through which the cartridge guide 50 holding the process cartridge B is pushed in. On both sides of the opening 14*b* in the lengthwise direction, an unillustrated rail is disposed, which extends in the direction of the process cartridge B insertion and guides an unillustrated guide provided on the cartridge guide 50, on each lateral wall in the lengthwise direction. A reference numeral 14*c* designates a latching member on the main assembly side, which has a semicircular cross-section, opening toward the direction from which the process cartridge B is inserted. It is disposed to engage with the cylindrical positioning boss 11*h* of the cartridge frame 11 of the process cartridge B as the cartridge guide 50 holding the process cartridge B is inserted into a predetermined position in the image forming apparatus main assembly 14. Further, the downward facing surface of the scanner cover 3*d* integrally forms a rotation stopper 3*e*, which controls the rotation of the process cartridge B about the axial line of the photosensitive drum 1.

{Operation for Pushing Movable Member and Process Cartridge into Image Forming Apparatus Main Assembly and Operation for Pulling out Movable Member and Process Cartridge therefrom}

In order to install the process cartridge B into the image forming apparatus main assembly 14, first, the cartridge guide 50 is pulled out of the image forming apparatus main assembly 14 to a predetermined position along the unillustrated rail. Then, the process cartridge B is placed in the cartridge guide 50. Next, the cartridge guide 50 holding the process cartridge B is pushed back into the image forming apparatus main assembly 14 by pushing on the rear plate 55 located on the upstream side in the direction of the process cartridge B insertion. As the cartridge guide 50 reaches the predetermined position, the cylindrical positioning boss 11*h* of the process cartridge B engages with the semicircular latching member 14*c* on the apparatus main assembly side, which opens toward the direction from which the process cartridge B is installed. In this state, the latching member 54 of the cartridge guide 50 and the latching member 14*c* of the apparatus main assembly 14 are disposed adjacent to each other in terms of the lengthwise direction, and are in contact with the peripheral surface of the cylindrical positioning boss 11*h*. Therefore, the process cartridge B is positionally fixed relative to the image forming apparatus main assembly 14 as far as a single point (axial line of the photosensitive drum 1) of the process cartridge is concerned; at this point in time, it is not positionally fixed as far as the rotational direction about the lengthwise axial line of the photosensitive drum 1 is concerned. Further, as the cartridge guide 50 reaches the predetermined position, the elastic pressing member 57 comes in contact with the inward surface (unillustrated) of the image forming apparatus main assembly 14, on the non-driven side, being thereby pressed toward the driven side of the image forming apparatus main assembly 14. As a result, the cartridge guide 50 is pressed toward the driven side, coming in contact with inward surface of the image forming apparatus main assembly 14, on the driven side. Consequently, the position of the cartridge guide 50 in the lengthwise direction is fixed. At this point in time, the position of the process cartridge B relative to the cartridge guide 50 in the lengthwise direction is already fixed, and therefore, the position of the process cartridge B relative to the image forming apparatus main assembly 14 in the lengthwise direction is also fixed as the cartridge guide 50 comes in contact with the inward surface of the image forming apparatus main assembly 14, on the driven side.

Further, the rear plate 55 of the cartridge guide 50, on the upstream side in the direction of the process cartridge B insertion becomes a part of the rear wall 14*a* of the image forming apparatus main assembly 14. As the process cartridge B is pushed, on a point of the rear end relative to the direction of the process cartridge B insertion, by the pressing member 56 provided on the rear plate of the cartridge guide 50 in the direction in which the cartridge guide 50 is pushed into the apparatus main assembly 14, the rear portion of the process cartridge B rotates upward about the lengthwise axial line of the photosensitive drum 1, because the direction of the push does not align with the lengthwise axial line of the photosensitive drum 1. Further, this direction of the process cartridge B rotation coincides with the direction in which the photosensitive drum 1 is driven, and therefore, the rotation stopper 11*j* on the top surface of the process cartridge B is placed in contact with the rotation stopper 3*e* of the image forming apparatus main assembly 14, fixing thereby the position of the process cartridge B in the apparatus main assembly 14.

With the provision of the above described structure, not only does the engagement between the latching member 14*e* on the apparatus main assembly 14 side and the cylindrical positioning boss 11*h* on the process cartridge B side fix the position of the process cartridge B relative to the apparatus main assembly 14, but also it fixes the position of the process cartridge B relative to the cartridge guide 50 at the same point, rendering it unnecessary to provide an additional positioning member for aligning the lengthwise axial line of the photosensitive drum 1 relative to both the apparatus main assembly 14 and the cartridge guide 50, therefore contributing to the reduction of apparatus size. Further, not only does the single elastic pressing member provided on the cartridge guide 50 fix the position of the process cartridge B relative to the cartridge guide 50 by placing the process cartridge B in contact with the driven side of the cartridge guide 50 when the process cartridge B is inserted into the cartridge guide 50, but also it fixes the position of the cartridge guide 50 relative to the apparatus main assembly 14 by placing the cartridge guide 50 in contact with the driven side of the apparatus main assembly 14 when the cartridge guide 50 is pushed into the apparatus main assembly 14; in other words, the means for transmitting the force for driving the photosensitive drum 1 is pressed toward the driven side to reliably transmit the force, and the distance the force must be transmitted can be minimized, with the use of this simple structure. Further, the process cartridge B is given rotational momentum by the pressing member 56 of the cartridge guide 50 in the same direction as the rotational direction of the photosensitive drum 1 about the center of the means for transmitting driving force to the photosensitive drum 1, to cause the rotation stopper 11*j* to come in contact with the rotation stopper 3*e* of the apparatus main assembly 14, so that the orientation of the process cartridge B relative to the apparatus main assembly 14 is fixed. Therefore, the position of the process cartridge B relative to the apparatus main assembly 14 is reliably fixed.

Regarding the process cartridge B and the cartridge guide 50, because the means for transmitting driving force to the photosensitive drum 1 is disposed outermost in the lengthwise direction, the distance the driving force must be transmitted from the apparatus main assembly 14 is short, which is desirable. Further, the means for transmitting driving force to the photosensitive drum 1 is guided by the cartridge guide 50, rendering it unnecessary to provide the side wall of the cartridge guide 50 in the lengthwise direction with a dedicated guide for the driving force transmitting means, contributing thereby to size reduction in the lengthwise direction. Further, since the cylindrical boss, that is, the second guide portion, and the rough guide, are also guided by the guiding surface when the process cartridge B is inserted, the rotation of the process cartridge B about the center of the means for transmitting driving force to the photosensitive drum 1 can be regulated to prevent erroneous insertion of a process cartridge, and therefore, operational efficiency is improved. Further, the latching member of the cartridge guide is disposed to engage with the cylindrical positioning boss which is located on the inward side of the means for transmitting driving force to the photosensitive drum, relative to the lengthwise direction, which contributes to the reduction of the size of the cartridge guide in the lengthwise direction.

When a process cartridge mounted in a cartridge guide is inserted into, or pulled out of, the main assembly of an image forming apparatus, the latching member, that is, the cartridge positioning member, of the apparatus main assembly engages with the cylindrical positioning boss of the process cartridge, fixing not only the position of the process cartridge, but also the position of the cartridge guide which is in engagement with the cylindrical positioning boss of the process cartridge, relative to the apparatus main assembly Therefore, it is unnecessary to provide a dedicated positioning member to fix the positional relationship between the apparatus main assembly and the cartridge guide, contributing to size reduction. Further, not only does a single elastic pressing member provided on the cartridge guide fix the position of a process cartridge relative to the cartridge guide by placing the process cartridge in contact with the driven side of the cartridge guide when the process cartridge is inserted into the cartridge guide, but also it fixes the position of the cartridge guide relative to the apparatus main assembly by placing the cartridge guide in contact with the driven side of the apparatus main assembly when the cartridge guide is pushed into the apparatus main assembly; in other words, the means for transmitting driving force to a photosensitive member is pressed toward the driven side to reliably transmit the force, and the distance the driving force must be transmitted can be minimized, with the use of this simple structure. Further, the process cartridge is given rotational momentum by the pressing member of the cartridge guide in the same direction as the rotational direction of the photosensitive drum about the center of the means for transmitting driving force to the photosensitive drum, to cause the rotation stopper of the process cartridge to come in contact with the rotation stopper 3*e* of the apparatus main assembly, so that the orientation of the process cartridge relative to the apparatus main assembly is fixed. Therefore, the position of the process cartridge relative to the apparatus main assembly is reliably fixed.

Next, an additional description will be given of the structure of a process cartridge.

With each of the lengthwise ends of the drum support axles 1*d* and 1*e,* the axle couplers 23 and 24 are engaged, respectively. Between the two, the axle coupler 23 is the member which receives the rotational force from the apparatus main assembly 14. The axle coupler 24 is constituted of the same member as the axle coupler 23, but is not involved with the driving means on the apparatus main assembly side, functioning only as a guide member used to guide the process cartridge B in the cartridge guide 50. Referring to FIG. 21, (b), the cross-sections of the joints between the drum support axle 1*d* and 1*e,* and the axle couplers 23 and 24, respectively, are both D-shaped. The supporting shafts 1*d* and 1*e* and the shaft coupling members 23 and 24 have "D" cross-sections. The drum supporting shafts 1*d* and 1*e* has a peripheral surfaces provided with a round grooves 1*d*1 and 1*e*1. The shaft coupling members 23 and 24 are provided on the inner surfaces of the "D" hole with projections 23*a* and 24*a*. More particularly, the projections 23*a* and 24*a* are formed on projections 23*c* and 24*c* constituting side walls of the grooves 23*b* and 24*b* extended in the longitudinal direction between the "D" hole and ends of the shaft coupling members 23 and 24. Therefore, the projections 23*c* and 24*c* have small thickness and are resilient. By the resiliency of the projections 23*c* and 24*c,* the projections 23*a* and 24*a* are elastically snapped into the grooves 1*d*1 and 1*e*1, so that the drum supporting shafts 1*d* and 1*e* are assuredly coupled with the shaft coupling members 23 and 24.

Figure 22:
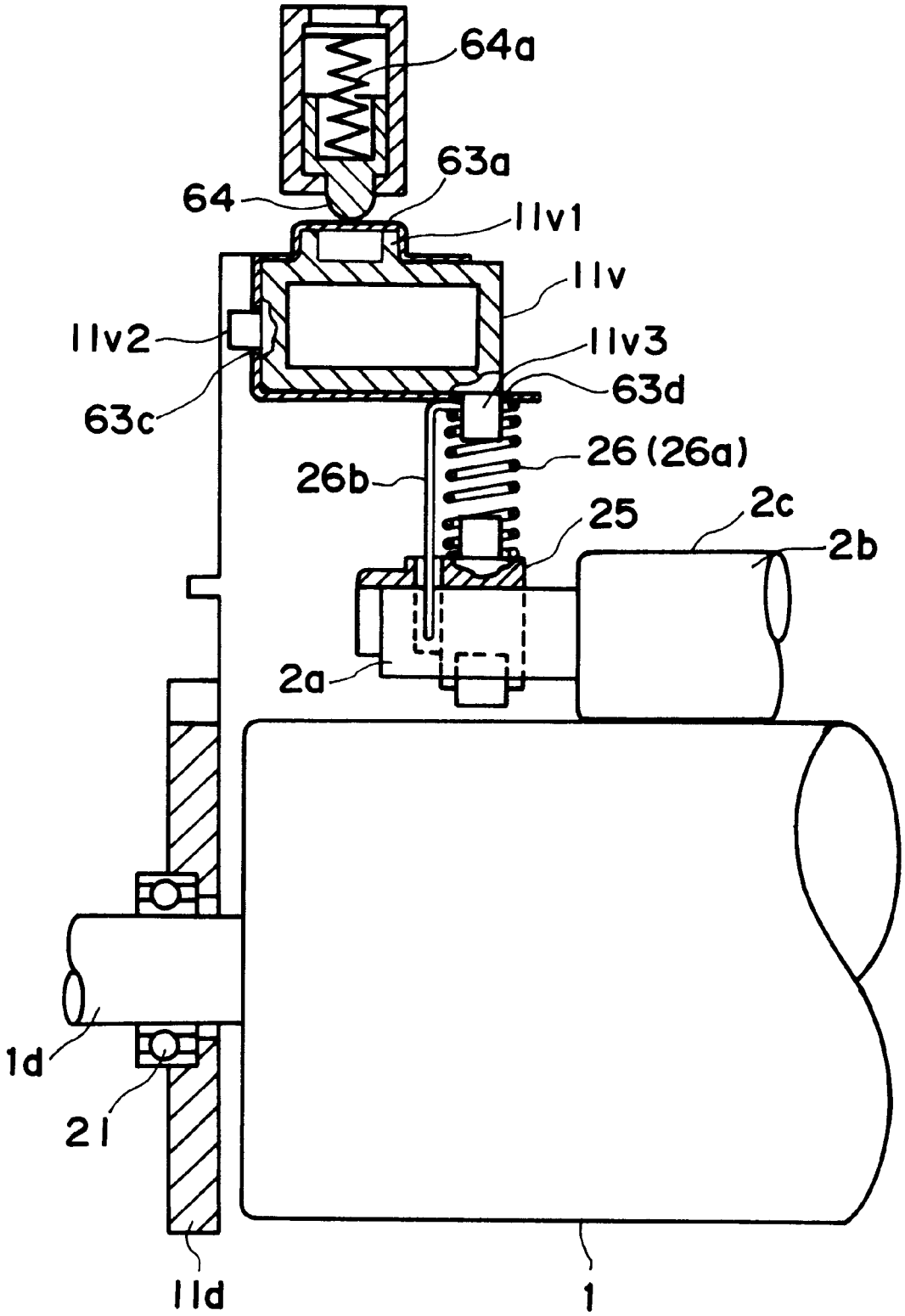
FIG. 22 is a vertical section of the charge roller, the photosensitive drum, and the adjacencies thereof.
Figure 23:
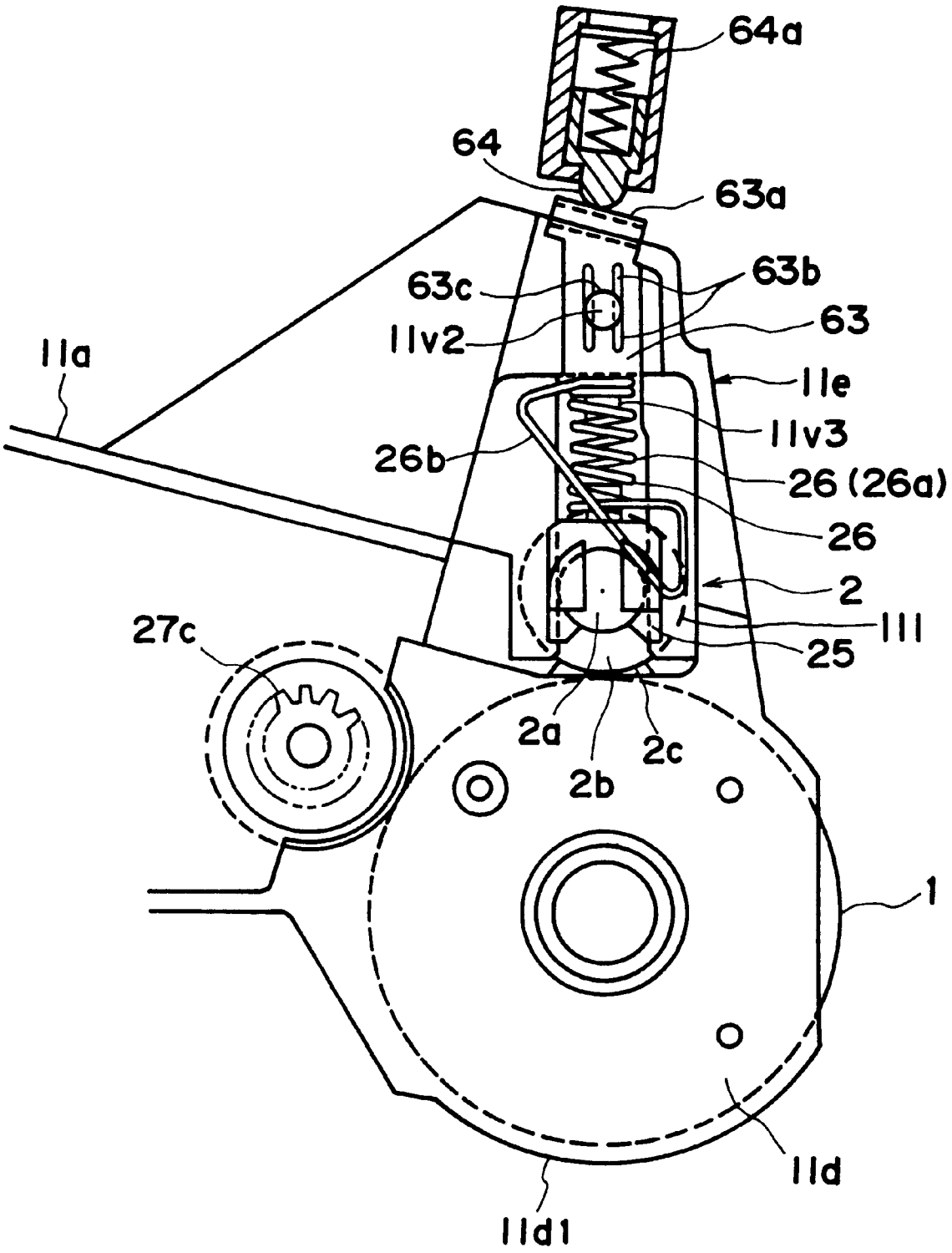
FIG. 23 is a vertical section of the charge roller supporting portion and the adjacencies thereof.

Referring to FIGS. 22 and 23, the charging device 2 is based on a contact type charging method, and employs a charging roller 2*c* which comprises a metallic shaft 2*a,* and an electrically conductive rubber layer 2*b* placed on the peripheral surface of the metallic shaft 2*a*. It is placed in parallel to the photosensitive drum 1. Each lengthwise end of the metallic shaft 2*a* is rotatively engaged with a charge roller bearing 25, which is floatingly engaged with a bearing guide 111. The charge roller 2*c* is placed in contact with the generatrix of the photosensitive drum 1 by a compound spring 26 compressively placed between the charge roller bearing 25 and the closed end portion of the bearing guide 111, and is rotated by the rotation of the photosensitive drum 1.

The cleaning device 6 is a device for cleaning the toner which remains on the peripheral surface of the photosensitive drum 1 after the toner which has been formed into a visible image on the photosensitive drum 1 by the developing device 4 is transferred onto the intermediary transfer belt 5*a*. The waste toner removed by the cleaning device 6 is collected in the waste toner container 11*a*. The amount of the waste toner is not large enough to fill up the waste toner container 11*a* before the service life of the photosensitive drum 1 expires, and therefore, the waste toner container 11*a* has only to be replaced along with the photosensitive drum 1 when the photosensitive drum 1 has an expired service life and is exchanged with a fresh one.

Referring to FIG. 3, the cleaning device 6 comprises a cleaning roller 27 and a cleaning blade 28, which are disposed in this order in the rotational direction of the photosensitive drum 1, next to each other along the peripheral surface of the photosensitive drum 1. The cleaning roller 27 comprises a cleaning roller shaft 27*a,* and a soft cleaning member 27*b* formed of rubber sponge or the like integrally fitted around the cleaning roller shaft 27*a*. The cleaning member 27*b* is in parallel and in contact with the photosensitive drum 1, pressing on the photosensitive drum 1 across substantially the entire length of the photosensitive drum 1. The cleaning roller shaft 27*a* projects from both lengthwise ends of the cleaning member 27*b*. These portions of the cleaning roller shaft 27*a*, which project from the cleaning member 27, are given a D-shaped cross-section, and are fitted with a cleaning roller gear 27*c* and cleaning roller journal 27*d*, respectively, which are provided with a D-shaped hole which matches the D-shaped cross-section of the end portion of the cleaning roller shaft 27, and are rotatively supported by the left and right side plates 11*k* (FIGS. 27 and 31) of the waste toner container 11*a*.

Referring to FIG. 3, the cleaning blade 28 is substantially in the form of a plate, and is in parallel to the photosensitive drum 1. It comprises a rubber blade 28*a*, and a blade supporting metallic plate 28*b* to which the rubber blade 28*a* is fixed by gluing, welding, or the like method. The cleaning blade 28 is tilted in a manner to counter the movement of the peripheral surface of photosensitive drum 1, with the lengthwise edge of the rubber blade 28*a* being pressed upon the photosensitive drum 1. The length of the cleaning blade 28 is substantially the same as the length of the cleaning member 27*b* of the cleaning roller 27. The blade supporting metallic plate 28*b* is given an L-shaped cross-section, and is fixed to the waste toner container 11*a* with unillustrated small screws, with a notch cut in the lengthwise end of the metallic plate 28*b* being fitted to a cleaning member mount 11*m* to accurately position the blade 28 relative to the waste toner container 11*a*. The cleaning member mount 11*m* is integrally formed with the waste toner container 11*a*.

A squeegee sheet 29 is an elastic sheet. It is placed in contact with the photosensitive drum 1, with gentle pressure, so that the toner which remains on the photosensitive drum 1 after transfer is allowed to pass, but the toner removed from the photosensitive drum 1 by the cleaning roller 27 and cleaning blade 28 is reliably guided into the waste toner container 11*a*.

Figure 44:
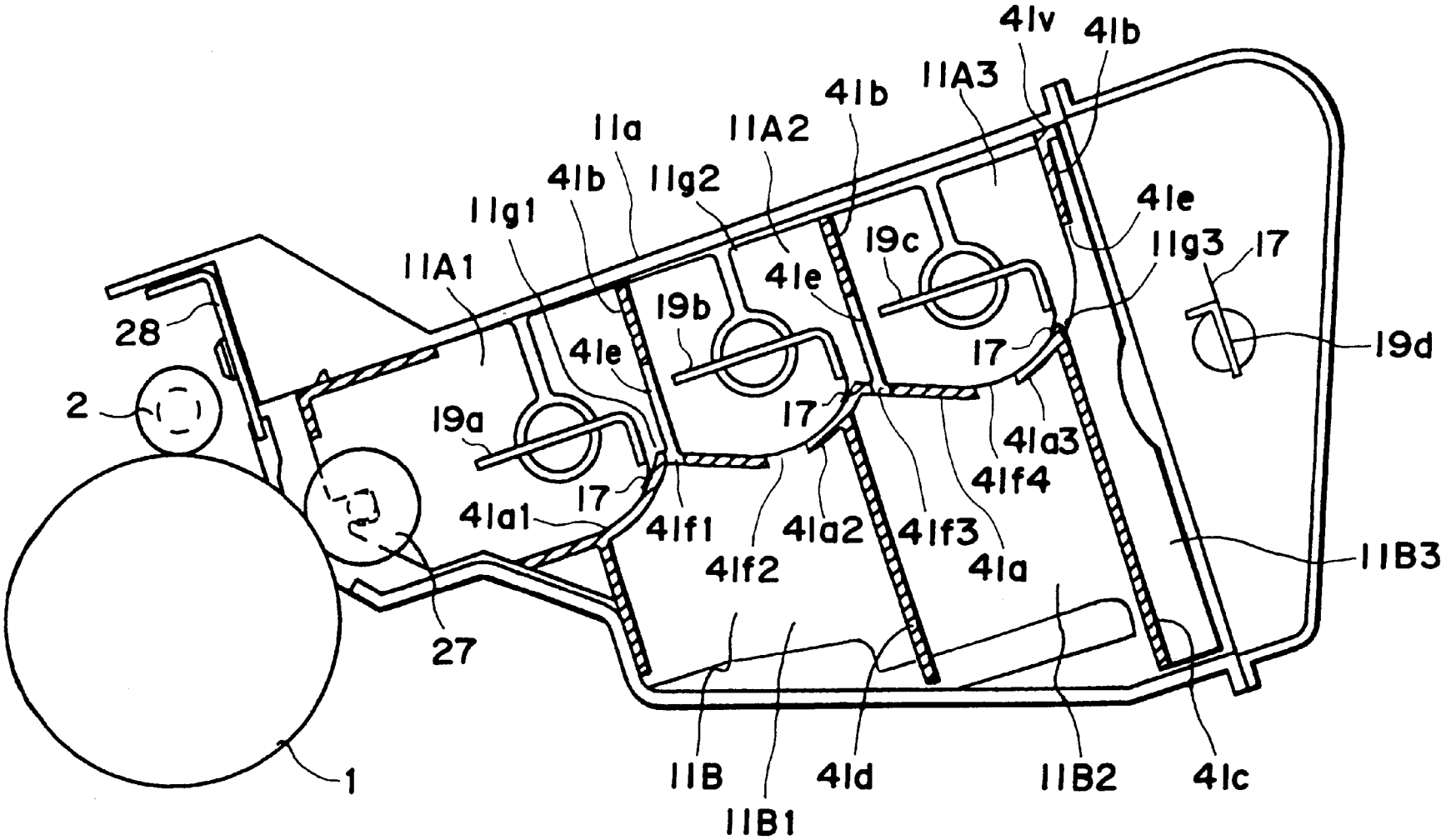
FIG. 44 is a vertical section of the waste toner container portion of the process cartridge illustrated in FIG. 3.

As described before, the waste toner container 11*a* is a substantially sealed container, having an opening 11*n* which faces the photosensitive drum 1. The rear portion of the waste toner container 11*a*, relative to the process cassette inserting direction; constitutes the rear container 11*b*. The internal space of the waste toner container 11*a* is partitioned with internal partitioning member 41 into a toner conveying portion 11A which will be located at the top when the process cartridge B is in the apparatus main assembly 14, and a toner storage portion 11B which will be at the bottom. The toner conveying portion 11A and the toner storage portion 11B are separated by the partitioning member 41*a*. Roughly speaking, when the process cartridge B is in the apparatus main assembly 14, the partitioning member 41*a* is slanted so as to rise toward the rear, that is, in the direction away from the photosensitive drum 1 (FIGS. 3 and 44).

The toner conveying portion 11A comprises Nos. 1, 2 and 3 toner conveyance portions 11A1, 11A2 and 11A3, which are separated by partitioning member 41*b*. The space between the rear plate 41*c* of the partitioning member 41 and the rear container 11*b* belongs to the toner storage portion 11B.

The toner storage portion 11B is partitioned with the partitioning member 41*d*. Practically speaking, the rear plate 41*c* of the partitioning member 41 is a member which partitions the toner storage portion 11B. In other words, the toner storage portion 11B comprises the first, second, and third toner storing portions 11B1, 11B2 and 11B3, which are separated with the partitioning member 41*d* and the rear plate 41*c*.

Each toner conveying portion 11A1, 11A2, or 11A3 is provided with a rotational plate 19*a*, 19*b*, or 19*c* as a toner sending member (toner conveying member), correspondingly, which rotates counterclockwise about its own axle C, and the rear container 11*b* is provided with a rotational plate 19*d*. With this arrangement, the toner removed from the photosensitive drum 1 is conveyed by the rotational plate 19*a*, 19*b*, and 19*c* away from the photosensitive drum 1.

Figure 31:
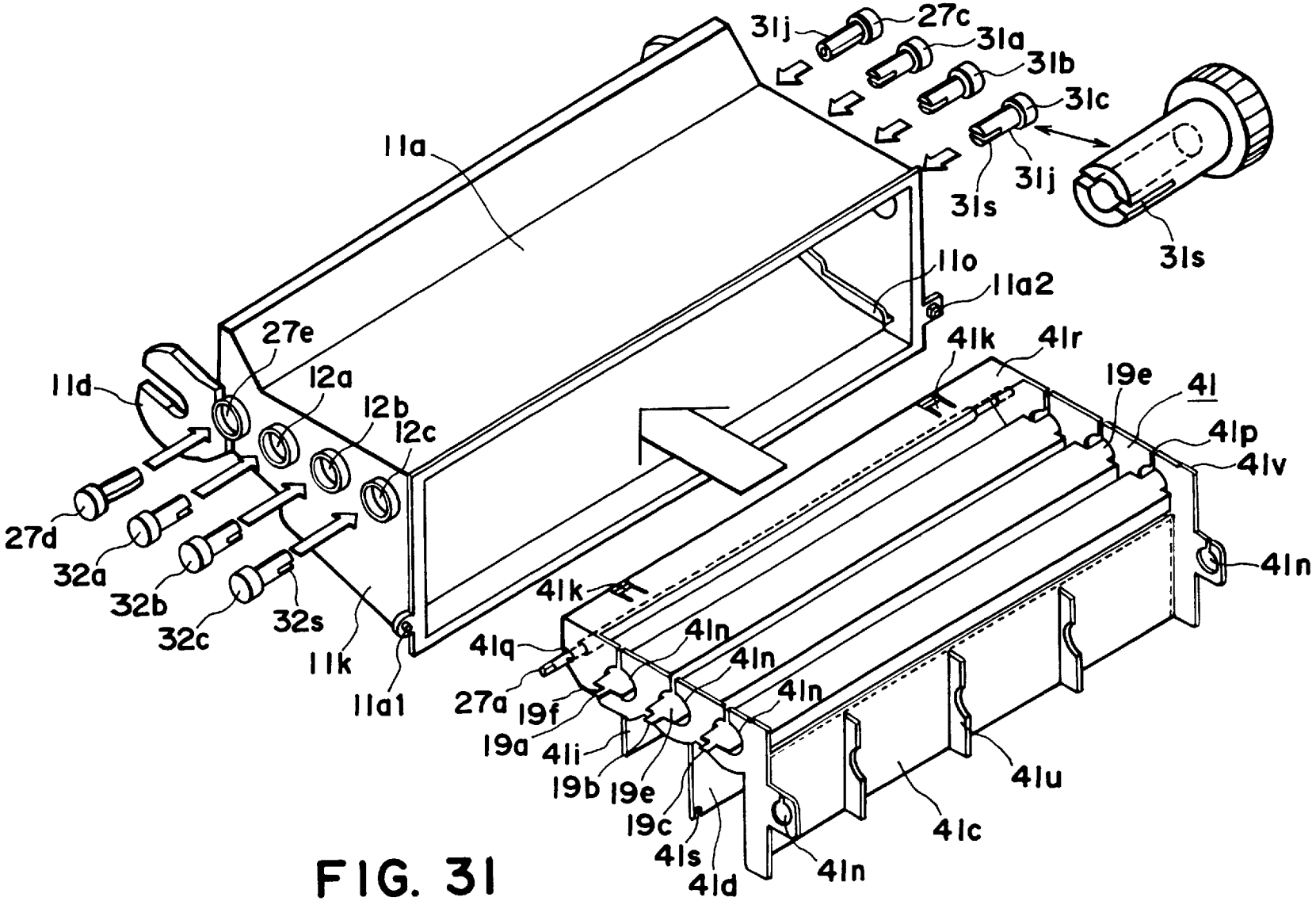
FIG. 31 is an exploded perspective view of the waste toner container portion of the process cartridge in accordance with the present invention.

Referring to FIG. 31 in which the toner conveying portion 11A is illustrated excluding the partitioning member 41*b* (FIGS. 3 and 44), the rotational plate 19 (rotational plates 19*a*, 19*b*, 19*c*, and 19*d*) is loosely fitted in a round hole 41*n* cut in the side plate 41*m* of the partitioning member 41, at each lengthwise end portion. Each lengthwise end portion of the rotational plate 19 is narrowed in steps; the first section extending outward past the round hole 41*n* constitutes an extension 19*e* which is slightly narrower than the portion within the toner conveying portion 11, and the second section extending farther outward from the extension 19*e* constitutes a centering extension 19*f*. On the driven side, the extension 19*e* is fit in the slit 31*s* of a driving gear 31 (31*a*, 31*b*, 31*c* and 31*d*), and the centering extension 19*f* is tightly fit in a hole cut deeper inside the driving gear 31 below the slit 31*s*. On the non-driven side, the extension 19*e* is fit in the slit 32*s* of a journal 32 (32*a*, 32*b*, 32*c* and 32*d*), and the centering extension 19*f* is tightly fit in a hole cut deeper inside the journal 32 below the slit 32*s*. Therefore, after each driving gear 31 is put through a corresponding hole (bearing) 12 (12*a*, 12*b*, 12*c* and 12*d*); the extension 19*e* of the rotational plate 19 is fitted in the corresponding 31*s* or 32*s*; and the centering extension 19*f* is pressed into the corresponding hole 30 of the journal 32, the extension 19*e* of the rotational plate 19 does not contact the edge of the round hole 41*n* cut in the side plate 41*m* of the partitioning member 41.

Each rotational plate 19*a*, 19*b*, or 19*c* has a sweeper blade 17 formed of approximately 50 μm thick flexible sheet, at the edge of the plate. In order to allow the sweeper blade 17 to desirably flex and sweep the partitioning member 41*a* as the rotational plate 19 (19*a*, 19*b*, and 19*c*) is rotated, the bottom walls of the first, second, and the third toner conveyance portions 11A1, 11A2, and 11A3 are provided with circularly curved portions 41*a*1, 41*a*2, and 41*a*3, correspondingly. The circularly curved portion 41*a*1 which constitutes less than one quarter of the bottom wall of the toner conveying portion 11A1 is located on the right-hand side, and the circularly curved portions 41*a*2 and 41*a*3 which constitute substantially one quarter of the bottom walls of the toner conveying portions 11A2 and 11A3, respectively, are located slightly off to the rear from the center.

The positions of the axes of the members, such as the rotational plates 19*a*, 19*b*, and 19*c*, which convey the waste toner, are such that the farther they are from the photosensitive drum 1, the farther from they are the bottom.

There is an opening 41*e* (toner passage) below the partitioning member 41*b* which divides the toner conveying portion 11A, connecting the adjacent toner conveying portions.

Figure 45:
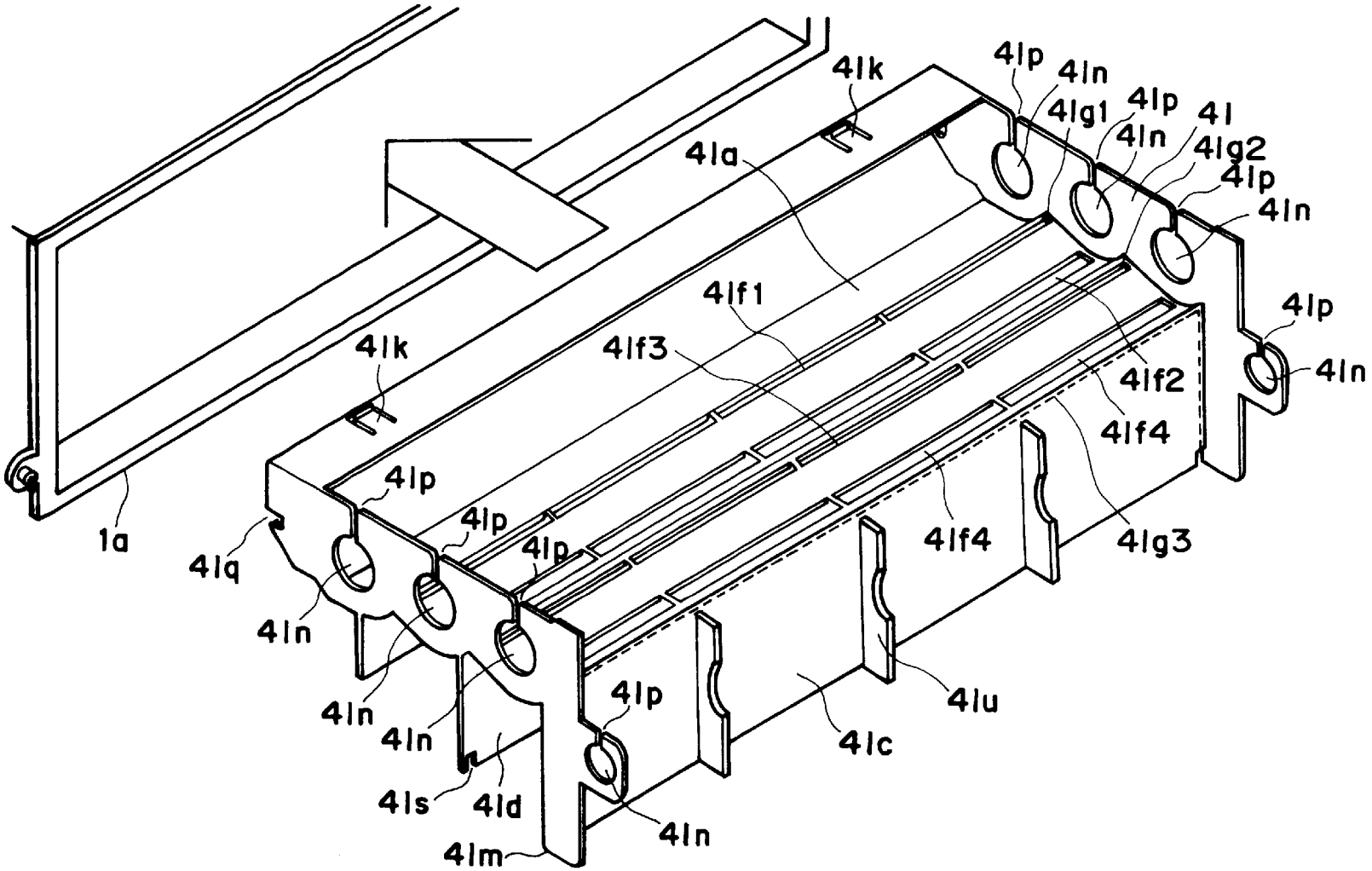
FIG. 45 is a perspective view of the partitioning member of the waste toner container portion.

The partitioning member 41*a* is provided with openings 41*f*1, 41*f*2, 41*f*3, 41*f*4, and 41*f*5, providing passages between the toner conveying portion 11A and the toner storage portion 11B, through which waste toner falls from the toner conveying portion 11A into the toner storage portion 11B (FIGS. 3, 44 and 45). The toner storage portion 11B is disposed so that it is below the toner conveying portion 11A when the process cartridge B is in the apparatus main assembly 14. The opening 41*f*1 is located on the rear side of the ridge 41*g*1 of the partitioning member 41*a*, that is, the ridge which is between the first and second toner conveying portion 11A1 and 11A2 (ridge 41*g*1 coincides with the rearward end of the circularly curved portion 41*a*1, and is almost directly below the opening 41*e*). The waste toner discharged into the first toner conveying portion 11A1 is first sent into the toner storage portion 11B1 through the opening 41*f*1 between the toner conveying portion 11A1 and the toner storage portion 11B1.

The openings 41*f*2 and 41*f*3 are located at the lowest portion of the circularly curved portions 41*a*2 and 41*a*3 of the second and third toner conveying portions 11A2 and 11A3, respectively, leading to the first and second toner holding portions 11B1 and 11B2. The location of the opening 41*f*3 of the second toner conveying portion 11A2 coincides with the location of the front portion the toner storage portion 11B2; in other words, it is cut on the rearward side of the partitioning member ridge 41*g*2 between the second and third toner conveying portions 11A2 and 11A3.

The opening 41*f*5 of the third toner conveying portion 11A3 is located at a position which allows the waste toner swept up to the ridge 41*g*3 along the circularly curved portion 41*a*3 by the sweeper blade 17 of the counterclockwise rotating rotational plate 19*c*, to fall into the third toner storage portion 11B3.

The partitioning member 41*a*, the partitioning member 41*b*, the rear plate 41*c*, the partitioning member 41*d*, and a top member 41*r*, which are illustrated in FIG. 3, are united with the side plate 41*m*, at both lengthwise ends as illustrated in FIG. 31 (which excludes the partitioning member 41*b*), constituting the partitioning member 41 for the waste toner container 11*a*. The top member 41*r* will be described later.

Referring to FIG. 31 which is an exploded perspective view of the waste toner container 11*a*, there is a large opening between the waste toner container 11*a* and the rear container 11*b*. The partitioning member 41 is inserted into the waste toner container 11*a* through this opening after it is assembled outside.

The inward surface of each side plate 11*k* of the waste toner container 11*a* is provided with an internal guide 11*o*. The left and right internal guides 11*o* are parallel to each other. During the insertion of the partitioning member 41 into the waste toner container 11*a*, a guide groove 41*s* cut in the partitioning member 41*d*, at the bottom and adjacent to each lengthwise end, engages with the internal guide 11*o*, with the bottom of the guide groove 41*s* riding on the top edge of the internal guide 11*o*, to guide the partitioning member 41.

Referring to FIG. 3, a reference numeral 41*i* designates a bracket plate, which is integral with the partitioning member 41, and is parallel to the partitioning member 41*d*. It has a positioning hole 41*j*. A reference numeral 11*p* designates a positioning projection integrally formed with the waste toner container 11*a*. It has a pointed tip, and is fitted in the positioning hole 41*j* all the way to the base portion as the partitioning member 41 is inserted into the waste toner container 11*a*. Then, a snap-fitting positioning portion 41*k* provided on the top wall of the partitioning member 41 snaps into the corner located at the front end of the top wall 11*i* of the waste toner container 11*a*. In this state, a portion 41*v*, which is the most rearward portion of the top wall of the partitioning member 41, is in contact with the inward surface of the waste toner container 11*a*, as shown in FIG. 44 Referring to FIG. 31, the aforementioned snap-fitting positioning portion 41*k* comprises a rectangular portion formed by cutting a substantially U-shaped slit in the portion 41*r* of the top wall of the partitioning member 41, and a claw inversely attached to the free end of the rectangular portion.

Figure 42:
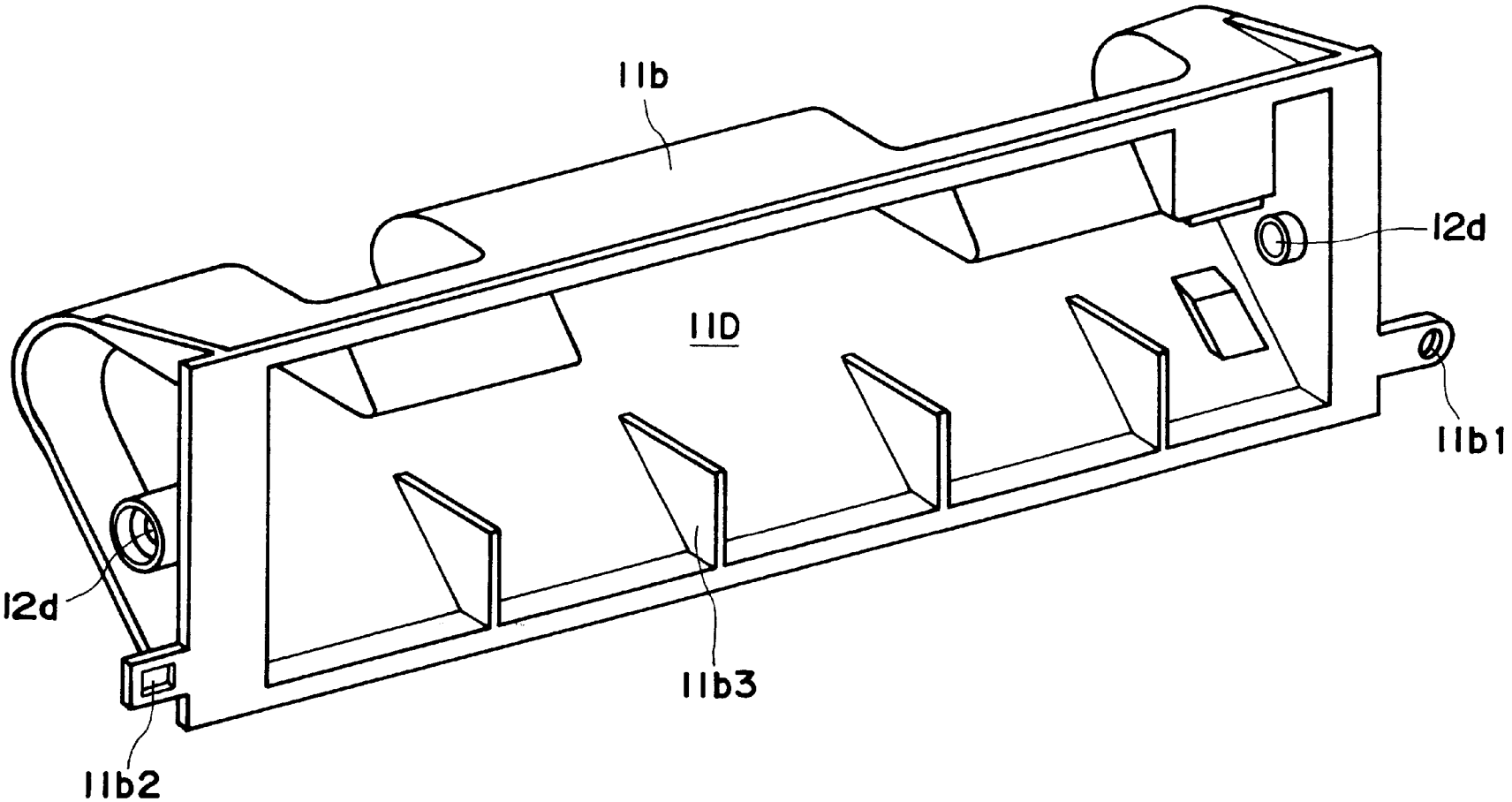
FIG. 42 is a perspective view of the rear portion of the waste toner container.

Each side plate 11*k* of the waste toner container 11*a* is provided with the hole (bearing) 12*a*, 12*b*, 12*c*, and 27*e*, which are aligned in a substantially straight line. Also, each side plate of the rear container 11*b* is provided with the hole (bearing) 12*d* (FIG. 42). On the driven side, the journal portions of 31*j* of the driving gears 31*a*, 31*b*, 31*c* and 31*d* (31*d* is not illustrated), and the journal portion of the cleaning roller gear 27*c*, are rotatively fitted in these holes 12*a*, 12*b*, 12*c* and 27*e*, correspondingly, with the gear portions being outside the waste toner container 11*a*. On the non-driven side, the journals 32*a*, 32*b*, 32*c*, 32*d* (32*d* is not illustrated), and 27*d*, are rotatively fitted in the holes 12*a*, 12*b*, 12*c* and 27*e*. The inward end of each of the driving gear 31*a*, 31*b*, 31*c* and 31*d* is provided with a slit 31*s*, and the inward end of each of the journals 32*a*, 32*b*, 32*c* and 32*d* is provided with a slit 32*s*. The slits 31*s* and 32*s* are cut in the axial direction.

Each of the two side plates 41*m* of partitioning member 41 is provided with holes 41*n* for the rotational plate 19. After the partitioning member 41 is assembled, these holes 41*n* align with holes (bearing) 12*a*, 12*b*, and 12*c* of side plate 11*k* of the waste toner container 11*a*, and the hole (bearing) 12*d* of the side plate of the rear container 11*b*, correspondingly, and the rotational plates 19*a*, 19*b*, 19*c* and 19*d* are rotatively supported to loosely fit in these holes 41*n*. Further, the side plate 41*m* is provided with slits, each of which extends upward from the highest point of the edge of the hole 41*n* to the top edge of the side plate 41*m*, making the hole 41*n* open. These slits are slightly wider than the thickness of the rotational plate 19, and are used during the assembly of the rotational plate 19.

The side plate 41*m* is also provided with a positioning guide 41*q*, which is at the front edge, that is, the edge on the photosensitive drum side, of the side plate 41*m*. When assembling the process cartridge B, the cleaning roller shaft 27*b* is fitted in this guide 41*q*, and then, the partitioning member 41 to which the rotational plates 19*a*, 19*b*, and 19*c*, and the cleaning roller 27, have been attached, is inserted into the waste toner container 11*a* in the direction of an arrow mark in the FIG. 31. Therefore, the process for assembling the process cartridge B is simplified.

As described before, the rotational plate 19*d* is rotatively supported in the rear container 11*b*, and is rotated in the clockwise direction in FIG. 3. As the rotational plate 19*d* is rotated clockwise, the thin and flexible leveling blade 17*d* of the rotational plate 19*d* comes in contact with a translucent window 33*a* at first, being flexed, and then sweeps across the inward surface of the translucent window 33*a*, clearing the translucent window 33*a* to secure a light path L for detecting whether or not the rear container 11*b* is filled up with the waste toner. The leveling blade 17*d* and the conveying blade 17 extend from one side plate 41*m* to the other side plate 41*m*.

To the apparatus main assembly 14, a lamp 34*a*, and a light detector element 34*b* which detects the light emitted from the lamp 34*a*, are fixed. The translucent windows 33*a* and 33*b* are disposed in the path L of this light. The translucent windows 33*a* and 33*b* are formed of translucent synthetic resin material. The window 33*a* is in the rear wall of the rear container 11*b*, being located below one of the recessed portions 11*q*, that is, the handhold portions, of the rear container 11*b* of the process cartridge B, and the translucent window 33*b* is in the horizontal wall of the same recessed portions 11*q*, being aligned with the window 33*a* to form the light path L. Further, the window side portion of the vertical wall of said recessed portion 11*q*, is not provided with the ribs 11*r* as handholds, in order to clear the light path L.

As is evident from the above description, the translucent windows 33*a* and 33*b* are located in the downstream portion of the main toner container 11*a,* relative to the direction in which the waste toner is conveyed.

The waste toner filled into the toner storage portion 11B3, which is the toner holding portion located on the downstream side relative to the toner conveyance direction, accumulates in the toner storage portion 11B3, and eventually, the amount of the accumulated water toner in the toner storage portion 11B3 reaches a level at which the light path L through the windows 33*a* and 33*b* remains blocked in spite of the window clearing rotation of the rotational plate 19*d.* In other words, at this point of the waste toner accumulation process, the light detector element 34*b* is prevented from receiving the light from the lamp 34*a.* As a result, the engine controller 131 of the process cartridge B begins to receive an active signal L, instead of an active signal H which is generated by the light detector element 34*b* through the photoelectric conversion process when it receives the light. Consequently, the engine controller 131, which will be described later, informs the user that the waste toner container 11*a* of the process cartridge B has been filled up. The rear plate 41*c* of the cleaning container 6*a* is provided with ribs 41*u,* which erect rearward from the rear plate 41*c,* and the rear container 11*b* is provided with ribs 11*b*3, which erect inward from the lower portion of the rear wall having a D-shaped cross-section. These ribs 41*u* and 11*b*3 are positioned alternately and in parallel to each other, relative to the lengthwise direction, cooperating to prevent the waste toner from shifting in the lengthwise direction. With this arrangement, the waste toner within the process cartridge B is prevented from settling on the side of the translucent windows 33*a* and 33*b* when the process cartridge B is handled after it is taken out of the apparatus main assembly 14; in other words, it is possible to prevent occurrence of such a situation that the engine controller erroneously signals the filling up of a rear container with the waste toner as the process cassette, in which the waste toner has settled on the window side after the cassette is removed from the main assembly of an image forming apparatus, is reinstalled in the apparatus main assembly.

The photosensitive drum 1, the cleaning roller 27, and the rotational plate 19 rotate at the same time as they receive driving force. The structure of the driving mechanism for these components will be described later, and next, the operation of the cleaning device 6 will be described.

{Operation of Cleaning Device}

The cleaning device 6 collects the waste toner, which is the toner remaining on the peripheral surface of the photosensitive drum 1 after image transfer, into the waste toner container 11*a* with the use of the cleaning roller 27 and the cleaning blade 28.

Referring to FIG. 3, the cleaning roller 27 rotates in the counterclockwise direction, that is, the same direction as the rotational direction of the photosensitive drum 1; at the contact nip where the peripheral surfaces of the cleaning roller 27 and the photosensitive drum 1 meet, the two surfaces move in the directions opposite to each other. Therefore, the peripheral surface of the cleaning roller 27 removes the post-transfer residual toner on the photosensitive drum 1 by rubbing the peripheral surface of the photosensitive drum 1 while moving in the direction opposite to the direction in which the peripheral surface of the photosensitive drum 1 moves, and scatter the removed waste toner rearward of the first toner conveying portion 11A1, that is, away from the photosensitive drum 1. The scattered waste toner lands near the waster toner container opening 11*n* which faces the photosensitive drum 1, and the partitioning member 41*a* of the waste toner container 11*a.* The toner which accumulates adjacent to the opening 11*n* is prevented by the function of the squeegee sheet 29, from leaking out of the waste toner container 11*a* through the gap between the squeegee sheet 29 and the photosensitive drum 1. The waste toner which accumulates on the partitioning member 41*a* of the first toner conveying portion 11A1 are pushed toward the second conveying portion 11A2 by the sweeper blade 17 of the first rotational plate 19*a,* being thereby lifted over the ridge 41*g*1 and reaching the opening 41*f*1. As the waste toner is lifted over the ridge 41*g*1 and reaches the opening 41*f*1, it falls through the opening 41*f*1 into the first toner storage portion 11B1, accumulating on the front side relative to the waste toner conveyance direction. Due to the momentum given to the waste toner by the rotation of the rotational plate 19*a* and the resiliency of the sweeper blade 17 having just gone over the ridge 41*g*1, a small amount of the waste toner is sent into the second toner conveying portion 11A2. Since the partitioning member 41*a* of the second toner conveying portion 11A2 tilts downward from the ridge 41*g*1 to the opening 41*f*2, the waste toner slides down toward the opening 41*f*2. The waste toner which hangs up and accumulates midway between the ridge 41*g*1 and the opening 41*f*2 is swept into the first toner storage portion 11B1 through the opening 41*f*2 by the sweeper blade 17 as the second rotational plate 19*b* rotates.

As a result, the waste toner accumulates in the first toner storage portion 11B1, creating a peak substantially directly below the opening 41*f*1 through which the major portion of the waste toner falls. After the peak of the waste toner accumulated in the first toner storage portion 11B1 reaches the opening 41*f*1, all the waste toner which is removed thereafter from the photosensitive drum 1 and discharged into the first toner conveying portion 11A1 is sent into the second toner conveying portion 11A2 by the sweeper blade 17 of the first rotational plate 19*a* through the opening 41*c,* and falls into the first toner storage portion 11B1 through the opening 41*f*2 to fill the space left therein. As the first toner storage portion 11B1 is filled up with the waste toner, the opening 41*f*2 is filled with the waste toner. Therefore, the waste toner created through the cleaning of the photosensitive drum 1 and sent into the second toner conveying portion 11A2 through the first toner conveying portion 11A1 is swept by the sweeper blade 17 of the rotational plate 19*b* toward the ridge 41*g*2 which is located between the second and third toner conveying portions 11A2 and 11A3 and frontward of the opening 41*e,* and eventually is pushed over the ridge 41*g*2, and falls through the opening 41*f*3 into the second toner storage portion 11B2, on the side closer to the photosensitive drum 1. As soon as the blade 17 goes over the ridge 41*g*2, a small amount of the waste toner is sent into the third toner conveying portion 11A3 due to the momentum given to the waste toner by the rotation of the sweeper blade 17 of the rotational plate 19*b,* and the resiliency of the released blade 17.

The waste toner which falls into the second toner storage portion 11B2 cannot form a peak directly below the opening 41*f*3. This is because the opening 41*f*3 is close to the toner storage partitioning member 41*d* which separates the first and second toner storage portions 11B1 and 11B2. As a result, as the waste toner falls into the second toner storage portion 11B2 and accumulates therein, it forms a slope which has the highest point directly below the opening 41*f*3 and descends rearward in the direction away from the photosensitive drum 1. As the waste toner accumulates, the level of the slope gradually rises. Eventually, the highest point of the slope reaches the opening 41f3, and the opening 41f3 is blocked by the waste toner. Thereafter, all the waste toner conveyed through the first and second conveying portions 11A1 and 11A2 is sent over the ridge 41g2 located between the second and third toner conveying portion 11A2 and 11A3, through the opening 41e, and into the third toner conveying portion 11A3 In the third toner conveying portion 11A3, the waste toner is moved on the partitioning member 41a from the ridge 41g2 to the opening 41f3, by the downward inclination of the partitioning member 41a, and the movement of the sweeper blade 17 of the third rotational plate 19c, and falls into the second toner storage portion 11B2 through the opening 41f4 located at the lowest point of the partitioning member 41a, accumulating in the second toner storage portion 11B2. Eventually, the second toner storage 11B2 is filled up with the waste toner, and the opening 41f4 is blocked with the waste toner. Thereafter, the waste toner delivered to the third toner conveying portion 11A3 is moved from the ridge 41g2, which is the ridge closer to the photosensitive drum 1, to the ridge 41g3, past the opening 41g3, and then, on the circularly curved portion 41a3 of the partitioning member 41a, by the sweeper blade 17 of the rotational plate 19c, and then, is pushed over the ridge 41g3 by the sweeper blade 17 of the rotational plate 19c. The ridge 41g3 coincides with the bottom edge of the opening 41f5, and therefore, the waste toner pushed over the ridge 41g3 falls into the third toner storage portion 11B3. This opening 41f5 doubles as the toner drop opening 41e, allowing the waste toner to fall into the toner storage portion 11B3 while allowing the waste toner to be conveyed out of the third toner conveying portion 11A3.

The waste toner which falls into the third toner storage portion 11B3 accumulates therein, forming a slope which is highest on the side of the rear plate 41c, and descends rearward. The surface of this slope formed by the accumulated waste toner is flat and is angled according to the angle of repose for the toner. The level of the slope of the waste toner gradually rises, and eventually reaches the sweeping range of the leveler blade 17d of the rotational plate 19d. Then, the waste toner comes in contact with the leveler blade 17d, and is sent flying toward the rear plate 41 by the rotational force of the leveler blade 17d. The leveler blade 17d is rendered wide enough in the radial direction to reach and keep always clean the translucent window 33a which the light path L crosses, and the adjacencies thereof. As the third toner storage portion 11B3 is nearly filled up with the waste toner sent flying toward the rear plate of the third toner storage portion 11B3, it is no longer possible for the leveler blade 17d of the rotational plate 19d to keep always clean the translucent window 33a. Eventually, the translucent window 33a is blocked by the waste toner; in other words, the light path L is blocked. Therefore, the light from the lamp 34a does not reach the light detector element 34b. As the light stops reaching the light detector element 34b, the light detector element 34b sends out a "non-reception" signal to the controller of the apparatus main assembly 14. Upon receiving the signal, a message which informs the user of the filling up of the process cartridge B with the waste toner, that is, a message which prompts cartridge exchange, is displayed Then, the apparatus is stopped after a predetermined number of copies are produced.

{Driving Mechanism for Waste Toner Conveying Members of Process Cartridge}

Figure 24:
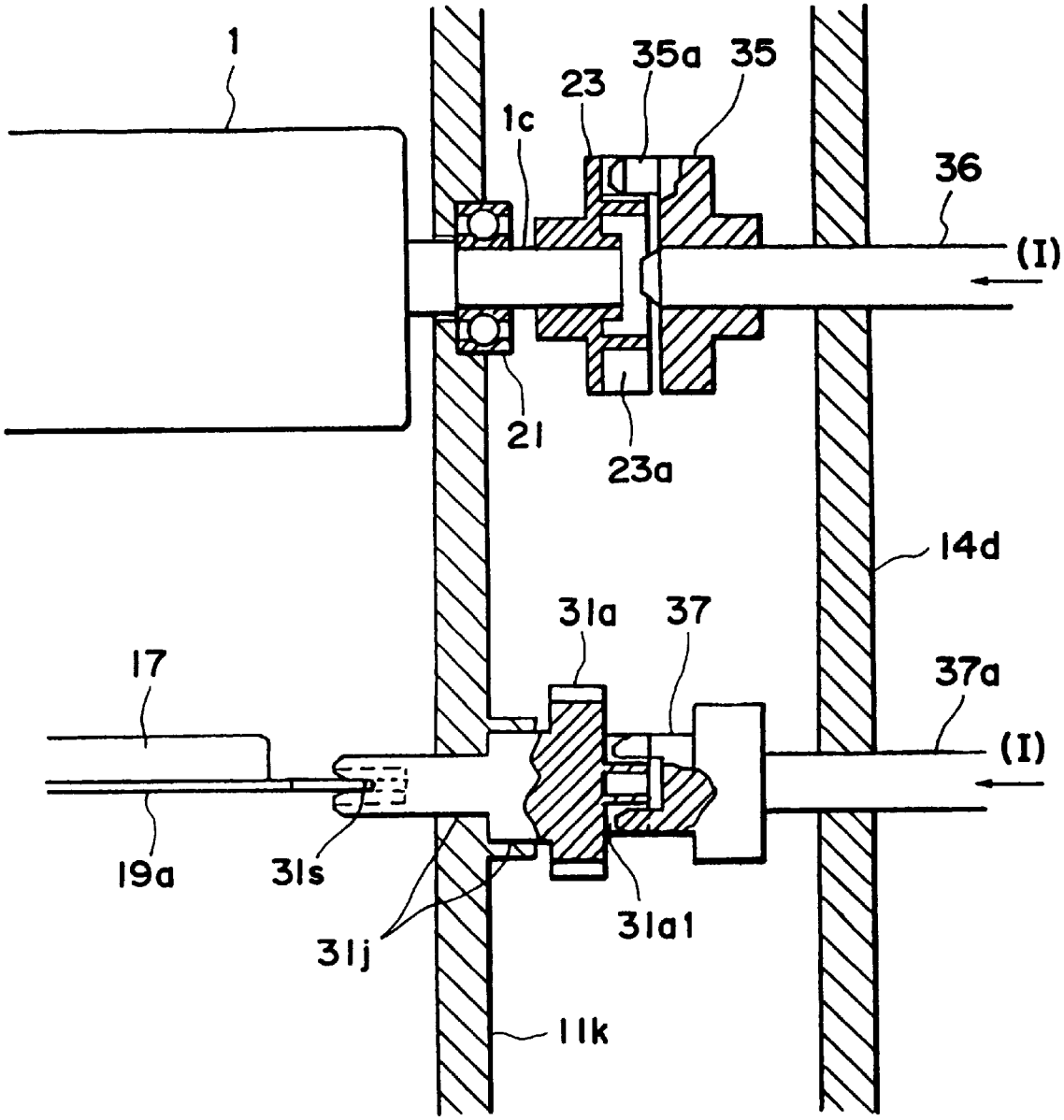
FIG. 24 is a lengthwise schematic section of the drive train junction between the main assembly of an electrophotographic image forming apparatus and a process cartridge.
Figure 25:
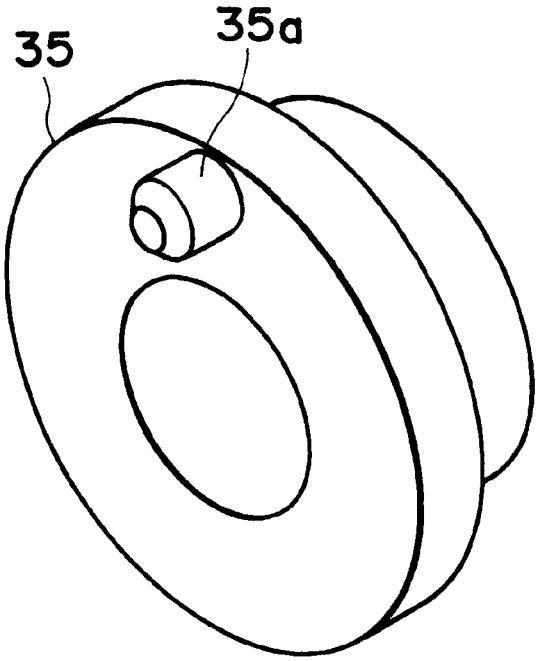
FIG. 25 is a perspective view of the axle coupler on the apparatus main assembly side.
Figure 26:
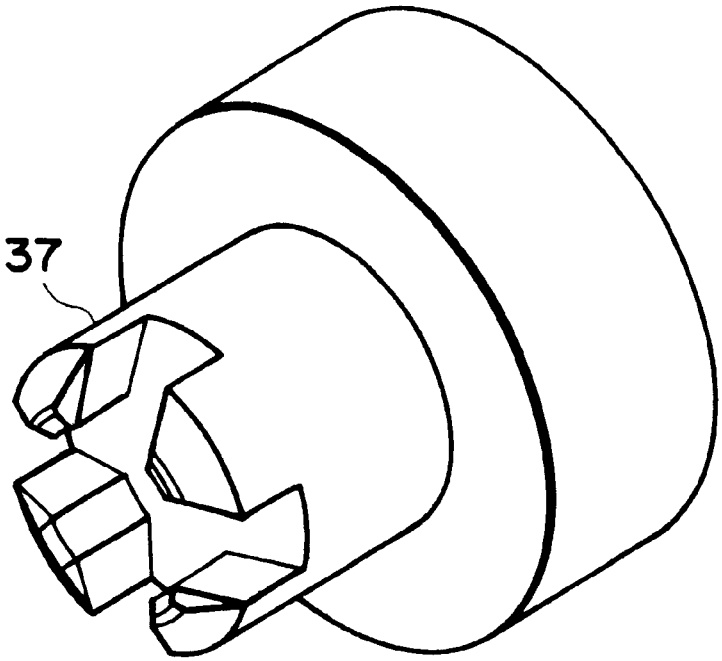
FIG. 26 is a perspective view of the clutch on the apparatus main assembly side.
Figure 27:
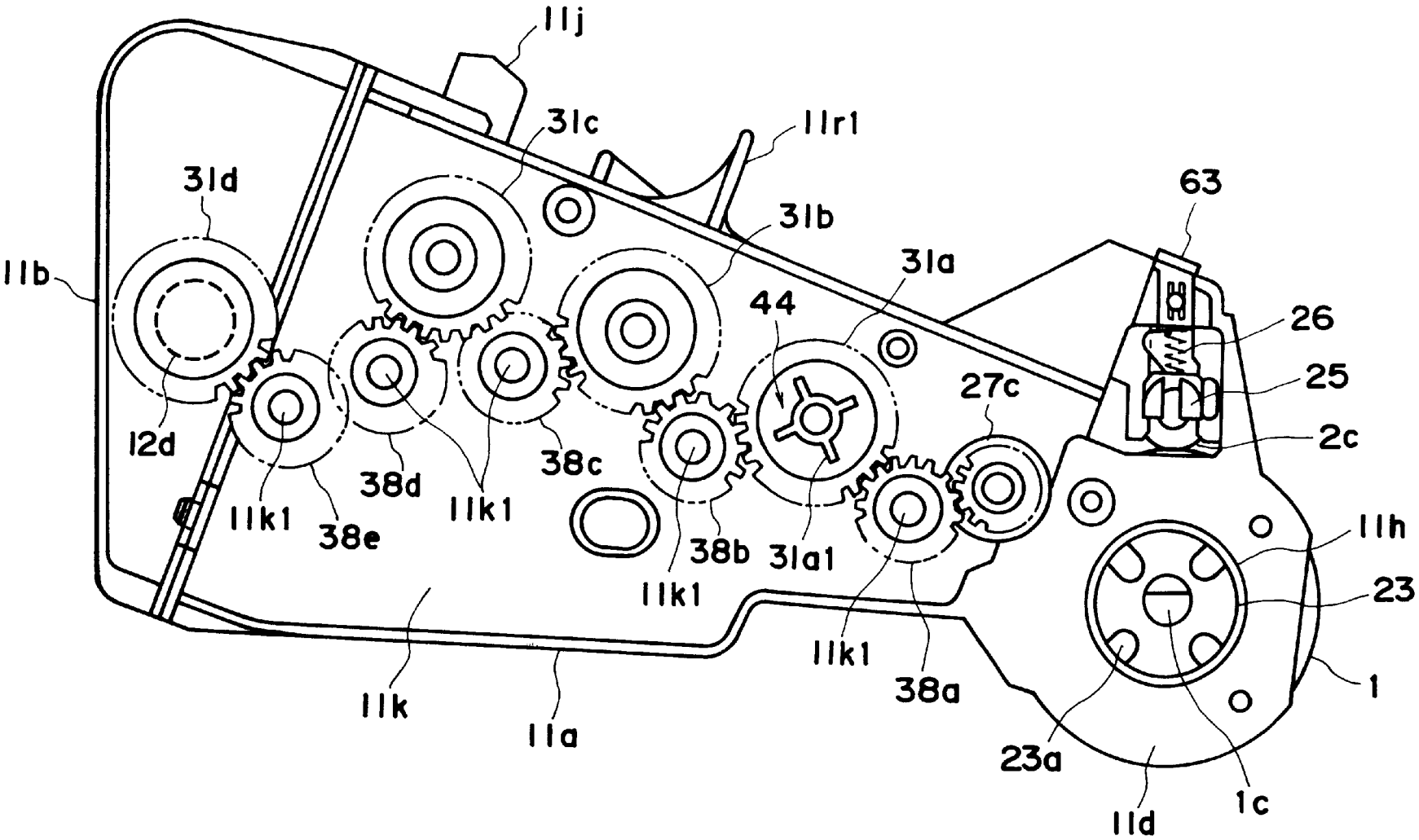
FIG. 27 is a side view of a process cartridge, with the gear cover removed revealing the internal gear train which transmits driving force.

FIG. 27 is a side elevation of the process cartridge B, with the gear cover 11c (side cover on the driven side) removed. FIG. 24 is a schematic section of the photosensitive drum 1 and the first rotational plate 19a, on the driven side of the main container 11a.

The drum support axle 1c of the photosensitive drum 1 is provided with the axle coupler 23, which is provided with four grooves 23a radially disposed in a manner to divide the axle coupler 23 into four equal portions. Each groove 23a is capable of accommodating a round pin 35a which extends in the axial direction of the photosensitive drum 1. On the apparatus main assembly side, an axle coupler 35 is provided, which comprises the pin 35a. The pin 35a is attached to the axle coupler 35 in such a manner that the pin 35a can move in the axial direction to fit into, or retract from, the groove 23a. The axle coupler 35 is fixed to the driving shaft 36 which is coaxial with the drum support shaft 1c and movable in the axial direction. The driving shaft 36 is supported by the frame 14d of the apparatus main assembly 14, rotatively, and movably in the axial direction. The groove 23a has such a shape that allows the pin 35a to freely move in the radial direction; for example, it is a groove having an even width.

As described before, one of the lengthwise ends of the first rotational plate 19a is fitted in the slit 31s of the driving gear 31a, and the journal portion 31j of the driving gear 31a is rotatively fitted in the hole of the side plate 11k of the waste toner container 11a. The outward surface of the driving gear 31a is provided with four pieces of plate-like ribs, which radially extend to form a cross-like shape, and constitute a male clutch type 31a1 which couples with a female type clutch 37 with a cross-shaped groove which matches the cross-like arrangement of the ribs of the male type clutch 31a1. The female type clutch 37 is attached to the driving shaft 37a which is supported by the frame 14d of the apparatus main assembly 14, rotatively, and movably in the axial direction. This female type clutch 37 engages or disengages with the male type clutch 31a1 through the through hole 50c cut in the side plate 50a in alignment with the recessed portion 51a of the guiding surface 51. The driving shafts 36 and 37a on the apparatus main assembly side, which are correspondent to the driving portion for the photosensitive drum 1, and the driving force transmitting means 44 for the removed toner conveying system, respectively, are placed under the pressure generated by unillustrated springs in the direction of (I) in the drawing, and are allowed to retract in the direction opposite to the direction (I) by a releasing means, the description of which will be omitted. The clutch 37 is in the form of a two- or four-pronged fork.

Referring to FIG. 27, the driving gear 31a with the male type clutch 31a1 indirectly meshes with the cleaning roller gear 27c and the driving gear 31b through idler gears 38a and 38b, respectively. The driving gear 31b indirectly meshes with a driving gear 31c through an idler gear 38c. The driving gear 31c indirectly meshes with a driving gear 31d through idler gears 38d and 38e which mesh with each other.

Figure 43:
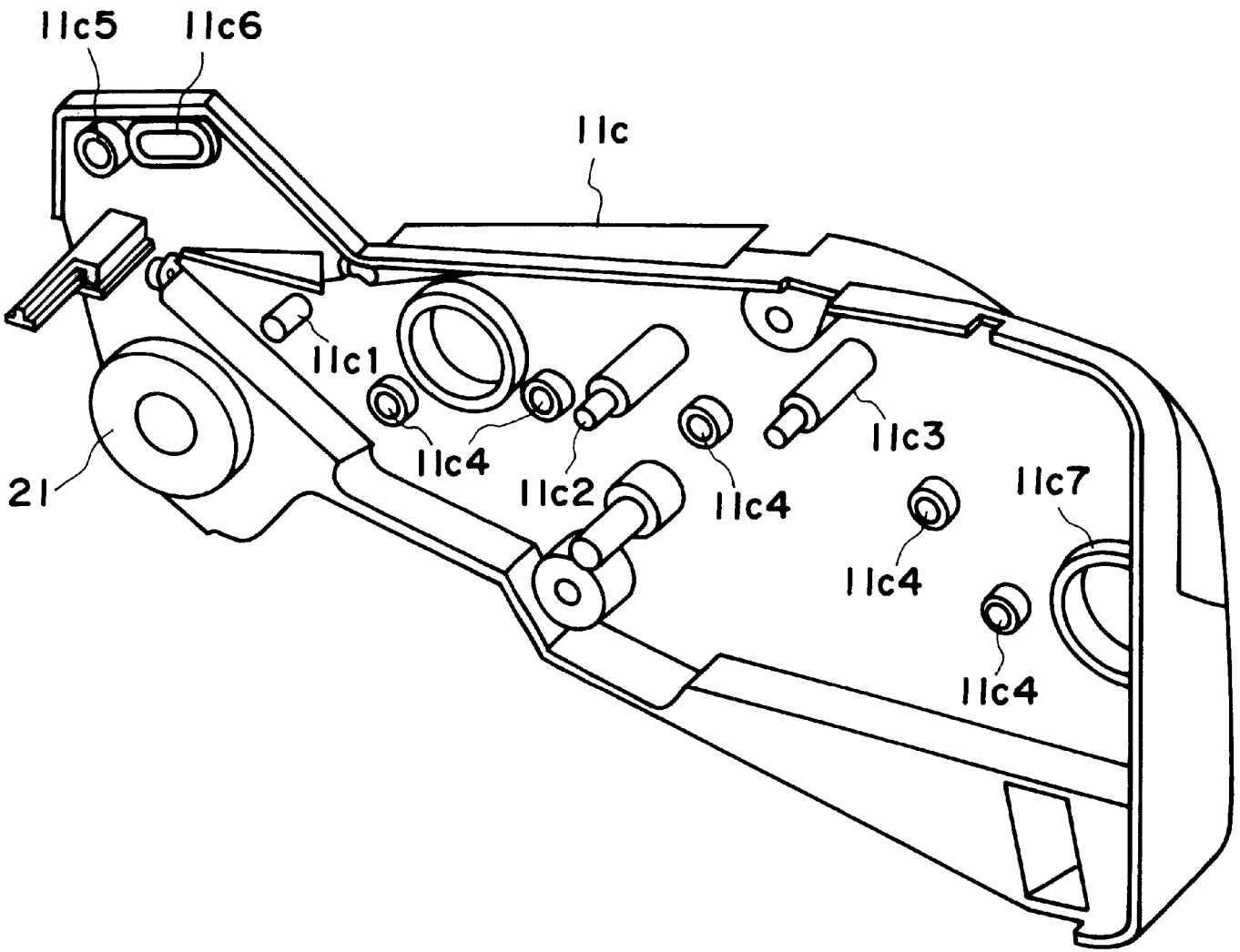
FIG. 43 is a perspective view of the gear cover as seen from the inward side.

Referring to FIG. 43, dowels 11c1–11c3 projecting from the inward side of the gear cover 11c fit in the central holes of the cleaning roller gear 27c, and the driving gears 31b and 31c, correspondingly, rotatively supporting the cleaning roller gear 27c, the driving gears 31b and 31c. The dowels 11c2 and 11c3 comprise a stepped portion which prevents the outward movement of the driving gear 31b and 31c in the axial direction. Each of the idler gears 38a–38e is rotatively supported correspondingly by one of the dowels 11k1 which project from the side plate 11k of the waste toner container 11a (FIG. 4). These dowels 11k1 are fitted correspondingly in the holes 11c4 cut in the gear cover 11c. The driving gear 31d attached to the rotational plate 19d which has the leveler blade 17d is rotatively fitted around the cylindrical dowels 11c7 projecting from the inward surface of the gear cover 11c.

As the process cartridge B is inserted into the apparatus main assembly 14 along the cartridge guide 50, the axle coupler 35 attached to the driven side end of the driving shaft 36, and the female type clutch 37 attached to the driven side end of the driving shaft 37*a,* engage with the axle coupler 23 and the male type clutch 31*a*1, respectively, so that the photosensitive drum 1 and the driving gear 31 receive the driving force from the apparatus main assembly 14, independently from each other (FIG. 24).

In the cleaning device 6 described above, in order to power the operation for conveying the post-transfer residual toner removed from the photosensitive drum 1 with the use of the cleaning roller 27 and the cleaning blade 28, that is, the waste toner, into the waste toner container 11*a* in which the waste toner fills up in step from the first to third toner storage portions 11B1–11B3 in this order, rotational force is transmitted from a driving power source (unillustrated) on the apparatus main assembly side to the female type clutch 37, which drives the driving gear 31*a*.

With the above arrangement, the cleaning roller gear 27*c* is indirectly driven by the driving gear 31*a* through the idler gear 38*a,* causing the cleaning roller 27 to rotate in the same direction as the photosensitive drum 1, as described before, when the photosensitive drum 1 rotates. On the other hand, the driving gear 31*a,* the idler gear 38*b,* the driving gear 31*b,* the idler gear 38*c,* the driving gear 31*c,* the idler gears 38*d* and 38*e,* and the driving gear 38*d,* which mesh with the adjacent gears in this order, rotate at the same time, wherein the cleaning roller gear 27*c,* and the driving gear 31*a*–31*c* rotate in the same direction, and the driving gear 31*d* rotates in the direction opposite to the rotational directions of the gears 27*c,* and 31*a*–31*c*.

A process cartridge described with foregoing comprises:

an electrophotographic photosensitive drum 1;

a cleaning member (e.g. cleaning roller 27 and/or cleaning blade 28) for removing toner deposited on said electrophotographic photosensitive member drum 1;

a charging roller 2*c* for charging said electrophotographic photosensitive drum, said charging roller being contacted to said electrophotographic photosensitive drum 1;

toner transporting members (e.g. rotatable plates) 19*a*–19*d,* arranged in the toner transportation direction, for transporting the toner removed from said electrophotographic photosensitive member drum by said cleaning member 27, 28 away from said electrophotographic photosensitive member drum 1;

a toner transporting portion 11A for transporting the toner away from said electrophotographic photosensitive member drum 1 by said toner transporting member;

a plurality of separation members 41*b,* arranged along the toner transportation direction, for separating inside of said toner transporting portion 11A in the toner transportation direction, wherein each of said separation members 41*b* is provided with a toner opening for passing toner in the toner transportation direction;

a toner accommodating portion 11B for accommodating the toner removed from said electrophotographic photosensitive member drum 1, wherein said toner accommodating portion takes a position below said toner transporting portion when said process cartridge B is mounted to the main assembly of electrophotographic image forming apparatus 14, and wherein said toner accommodating portion is separated into a plurality of portions in the toner transportation direction;

a plurality of falling openings (e.g. accommodation opening) 41*f*1–41*f*5, arranged in the toner transportation direction, for permitting the toner transported in said toner transporting portion by said toner transporting member 19*a*–19*d* to fall into said toner accommodating portion;

a downstream toner accommodating portion (e.g. third toner accommodating portion) disposed downstream in the toner transportation direction;

first 33*a* and second 33*b* light transmission openings, for permitting the main assembly 14 of said apparatus to detect that predetermined amount of the toner is substantially accommodated in said downstream toner accommodating portion 11B3, when said process cartridge is mounted to the main assembly;

a drum driving force receptor portion (e.g. shaft coupling member) 23 for receiving driving force from the main assembly to rotate said electrophotographic photosensitive drum 1 when said process cartridge is mounted to the main assembly 14 of said electrophotographic image forming apparatus;

a transporting member driving force receptor portion (e.g. driving force inputting means) 44 for receiving driving force from the main assembly to rotate said toner transporting member when said process cartridge is mounted to the main assembly, wherein toner transporting member 19*a*–19*d* is rotated by the driving force received from the main assembly 14 by said transporting member driving force receptor portion.

The process cartridge B described in the foregoing comprises:

a cartridge frame 11;

an electrophotographic photosensitive drum 1;

a charging member (e.g., charging roller) 2*c* for charging said electrophotographic photosensitive drum;

a cleaning member (e.g., cleaning roller 27 or cleaning blade 28) for removing toner deposited on said electrophotographic photosensitive drum;

a toner transporting member (e.g., rotatable members 19*a*–19*d*) for transporting the toner removed from said electrophotographic photosensitive drum by said cleaning member away from said electrophotographic photosensitive drum;

a first positioning portion (e.g., boss) 11*h* for positioning said process cartridge when said process cartridge B is mounted to a mounting position of the main assembly 14 of said process cartridge, said positioning portion being engageable with a main assembly positioning member (e.g., U-groove) 52 provided in the main assembly of said apparatus, and is projected outwardly from said cartridge frame 11 coaxially with said electrophotographic photosensitive drum at one longitudinal end side of said electrophotographic photosensitive drum, wherein said first positioning portion is integrally molded with said cartridge frame 11;

a second positioning portion (e.g. boss) 11*h* for positioning said process cartridge when said process cartridge B is mounted to a mounting position of the main assembly 14 of said process cartridge, said positioning portion being engageable with a main assembly positioning member (e.g. U-groove) 52 provided in the main assembly of said apparatus, and is projected outwardly from said cartridge frame 11 coaxially with said electrophotographic photosensitive drum at the other longitudinal end side of said electrophotographic photosensitive drum, wherein said second positioning portion is integrally molded with said cartridge frame 11;

a drum driving force receiving member (e.g. coupling member) 23 for receiving driving force for rotating said electrophotographic photosensitive drum 1 for the main assembly when said process cartridge B is mounted to the mounting position of the main assembly 14, said drum driving force receiving member being juxtaposed with said first positioning member 11*h* coaxially with said electrophotographic photosensitive drum 1 and is projected outwardly beyond said first positioning member 11*h;* a toner transporting member driving force receiving member drive input means 44 for receiving driving force for rotating said toner transporting members 19*a*–19*d* from the main assembly of said apparatus when said process cartridge B is mounted to the mounting position of the main assembly 14, wherein said toner transporting member driving force receiving member 44 is disposed at the same cartridge frame side as a side where said drum driving force receiving drum;

a cleaning member (e.g., cleaning roller 27 or cleaning blade 28) for removing toner deposited on said electrophotographic photosensitive drum;

a toner transporting member (e.g., rotatable members 19*a*–19*d*) for transporting the toner removed from said electrophotographic photosensitive drum by said cleaning member away from said electrophotographic photosensitive drum;

a first positioning portion (e.g., boss) 11*h* for positioning said process cartridge when said process cartridge B is mounted to a mounting position of the main assembly 14 of said process cartridge, said positioning portion being engageable with a main assembly positioning member (e.g., U-groove) 52 provided in the main assembly of said apparatus, and is projected outwardly from said cartridge frame 11 coaxially with said electrophotographic photosensitive drum at one longitudinal end side of said electrophotographic photosensitive drum, wherein said first positioning portion is integrally molded with said cartridge frame 11;

a second positioning portion (e.g. boss) 11*h* for positioning said process cartridge when said process cartridge B is mounted to a mounting position of the main assembly 14 of said process cartridge, said positioning portion being engageable with a main assembly positioning member (e.g. U-groove) 52 provided in the main assembly of said apparatus, and is projected outwardly from said cartridge frame 11 coaxially with said electrophotographic photosensitive drum at the other longitudinal end side of said electrophotographic photosensitive drum, wherein said second positioning portion is integrally molded with said cartridge frame 11;

a drum driving force receiving member (e.g. coupling member) 23 for receiving driving force for rotating said electrophotographic photosensitive drum 1 for the main assembly when said process cartridge B is mounted to the mounting position of the main assembly 14, said drum driving force receiving member being juxtaposed with said first positioning member 11*h* coaxially with said electrophotographic photosensitive drum 1 and is projected outwardly beyond said first positioning member 11*h;* a toner transporting member driving force receiving member drive input means 44 for receiving driving force for rotating said toner transporting members 19*a*–19*d* from the main assembly of said apparatus when said process cartridge B is mounted to the mounting position of the main assembly 14, wherein said toner transporting member driving force receiving member 44 is disposed at the same cartridge frame side as a side where said drum driving force receiving member 23 is disposed in a longitudinal direction of said electrophotographic photosensitive drum;

a circular portion (e.g. cylindrical boss) 45 projected from said cartridge frame along a circumference of an end portion of said toner transporting member driving force receiving member 44, wherein said circular portion 45 is integrally molded with said cartridge frame 11;

wherein an outer end of said drum driving force receiving member 23 is projected outwardly from said cartridge frame 11 beyond an outer end of said toner transporting member driving force receiving member 44, wherein said drum driving force receiving member is disposed upstream of said toner transporting member driving force receiving member in a direction of mounting of said process cartridge B to the main assembly 14, and wherein said process cartridge is mounted to the main assembly in a direction crossing with the longitudinal direction of said electrophotographic photosensitive drum.

In an example, the outer end of the drum driving force receiving member is beyond the outer end of the toner transporting member driving force receiving member by approx. 1.0–5.0 mm.

It should be noted here that the aforementioned cartridge frame 11 is formed of plastic material such as polystyrene, ABS resin, polycarbonate, polyethylene, polypropylene, or the like.

Assembly Method for Cleaning Device

Next, the assembly method for the cleaning device 6 structured as described above will be described.

Referring to FIG. 31, when assembling the cleaning device 6, first, the shaft 27*a* of the cleaning roller 27 is inserted into the positioning guide 41*q* cut in the side plate 41*m* of the partitioning member 41. The positioning guide 41*q* which accommodates the cleaning roller shaft 27*a* is substantially U-shaped. The width of the positioning guide 41*q* is less than the diameter of the cleaning roller shaft 27*a,* except for the deepest end where the width is rendered wide enough to allow the cleaning roller shaft 27*a* to fit loosely.

Next, the rotational plate 19*a,* 19*b* and 19*c* are fitted in the corresponding holes 41*n* through the corresponding slits 41P, and then, the partitioning member 41 is assembled into the waste toner container 11*a.*

Next, the journal 27*d* and cleaning roller gear 27*c* of the cleaning roller 27 are inserted from the corresponding side of the waste toner container 11*a.*

At this point, the position of the cleaning roller 27 relative the waste toner container 11*a* is only temporarily fixed by the partitioning member 41, being substantially coaxial with the journal 27*d* and the gear 27*c* which are to be attached to the cleaning roller 27. Therefore, the journal 27*d* and the gear 27*c* can be easily fitted around the shaft 27*a* of the cleaning roller 27.

As the journal 27*d* and the gear 27*c* are fitted around the shaft 27*a,* the cleaning roller 27 is properly positioned in the waste toner container 11*a,* and at the same time, the cleaning roller shaft 27*a* comes in contact with a part of the positioning guide 41*q* of the partitioning member 41, beginning to receive the reactive force which generated as the cleaning roller 27 is pressed on the photosensitive drum 1 with the provision of this arrangement, it is possible to prevent the cleaning roller 27 from flexing, without increasing the diameter of the shaft 27*a* of the cleaning roller 27.

Next, the round and square dowels 11*a*1 and 11*a*2 of the waste toner container 11*a* are fitted in the positioning holes 11*b*1 and 11*b*2 of the rear container 11*b,* and the flanges around the openings of waste toner container 11*a* and the rear container 11*b* are welded to each other by ultrasonic welding.

Then, the photosensitive drum 1, the charging device 2, and the cleaning blade 28 are attached to the waste toner container 11*a,* and the charging device cover 11*g* is attached before covering the side walls of the waste toner container 11*a* by attaching the gear cover 11*c* and the side cover 11*b* to the corresponding side walls of the waste toner container 11*a* with the use of screws.

Figure 28:
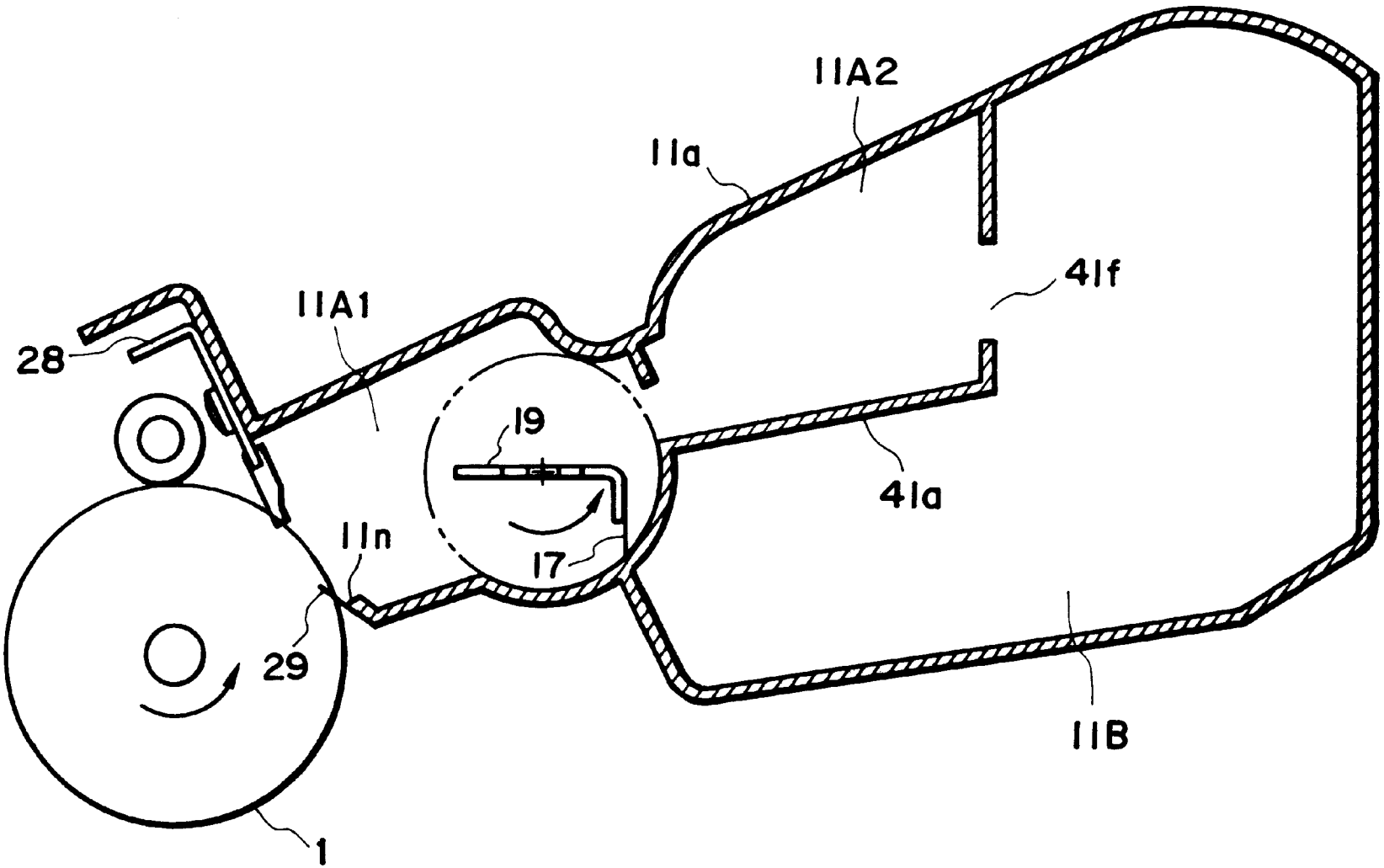
FIG. 28 is a schematic section of the cleaning apparatus in another embodiment of the present invention.

Next, referring to FIG. 28, the second embodiment of the cleaning device 6 in accordance with the present invention will be described in detail. In this cleaning device 6, the toner remaining on the photosensitive drum 1 is removed by the cleaning blade 28, and is collected as waste toner in the waste toner container 11*a.* After being removed from the photosensitive drum 1, the waste toner first settles and accumulates in the first toner conveying portion 11A1, adjacent to the opening 11*n* which faces the photosensitive drum 1. At the bottom end of the opening 11*n,* a squeegee sheet 29 is placed in contact with the photosensitive drum 1, with a predetermined pressure, and at a predetermined angle. The toner which remains on the photosensitive drum 1 after transfer slips past the squeegee sheet 29, and enters the first toner conveying portion 11A1. Then, it is scraped away from the photosensitive drum 1 by the cleaning blade 28, and accumulates in the first toner conveying portion 11A1, without falling down through the gap formed between the squeegee sheet 29 and the photosensitive drum 1. In the first toner conveying portion 11A1, the toner sweeper blade 17 rotates together with a rotational plate 19 in the counterclockwise direction in the drawing. Then, the toner sweeper blade 17 rotates by receiving driving force directly from an unillustrated driving shaft located on the rear side relative to the direction perpendicular to the surface of FIG. 28, and pushes, rearward and then upward, the waste toner which accumulates in the first toner conveying portion 11A1. Located at the approximate center of the waste toner container 11*a* relative to the vertical direction is a partitioning member 41*a* which divides the waste toner container 11*a* into a toner conveying portion 11A and a toner storage portion 11B. The vertical rearward portion of the partitioning member 41*a* is provided with an opening 41*f* through which the waste toner having been sent into the toner conveying portion 11A2 by the sweeper blade 17 is sent into the toner storage portion 11*b.* The partitioning member 41*a* doubles as the bottom wall portions of the waste toner conveying portions 11A1 and 11A2. The bottom portion of the toner conveying portion 11A2 gradually ascends, starting from the photosensitive drum side to the rear end. With this arrangement, it is possible to locate the opening 41*f* at the approximate center relative to the widthwise direction, and slightly above the center relative to the vertical direction, of the toner storage portion 11B, and therefore, the waste toner delivered through the opening 41*f* is evenly accumulated, rendering dead space less liable to be created. Further, the opening 41*f* is located above the center of the waste toner container 11*a,* and therefore, even if the process cartridge B removed from the apparatus main assembly 14 is handled in such a manner that the photosensitive drum side of the process cartridge B is positioned at the bottom, the waste toner in the waste toner container 11*a* does not go back from the toner storage portion 11B to the toner conveying portion 11A2. Therefore, it is possible to always keep the waste toner away from the photosensitive drum side opening 11A1 of the toner conveying portion 11A1, and the adjacencies thereof; the waste toner pressure can be kept away from the opening 11A1 and the adjacencies thereof. Thus, it is assured that the cleaning performance of the cleaning device 6 is optimally maintained throughout the service life of the photosensitive drum 1.

Next, the third embodiment of the cleaning device 6 in accordance with the present invention will be described In this third embodiment, only the difference between the second and third embodiment will be described.

Figure 29:
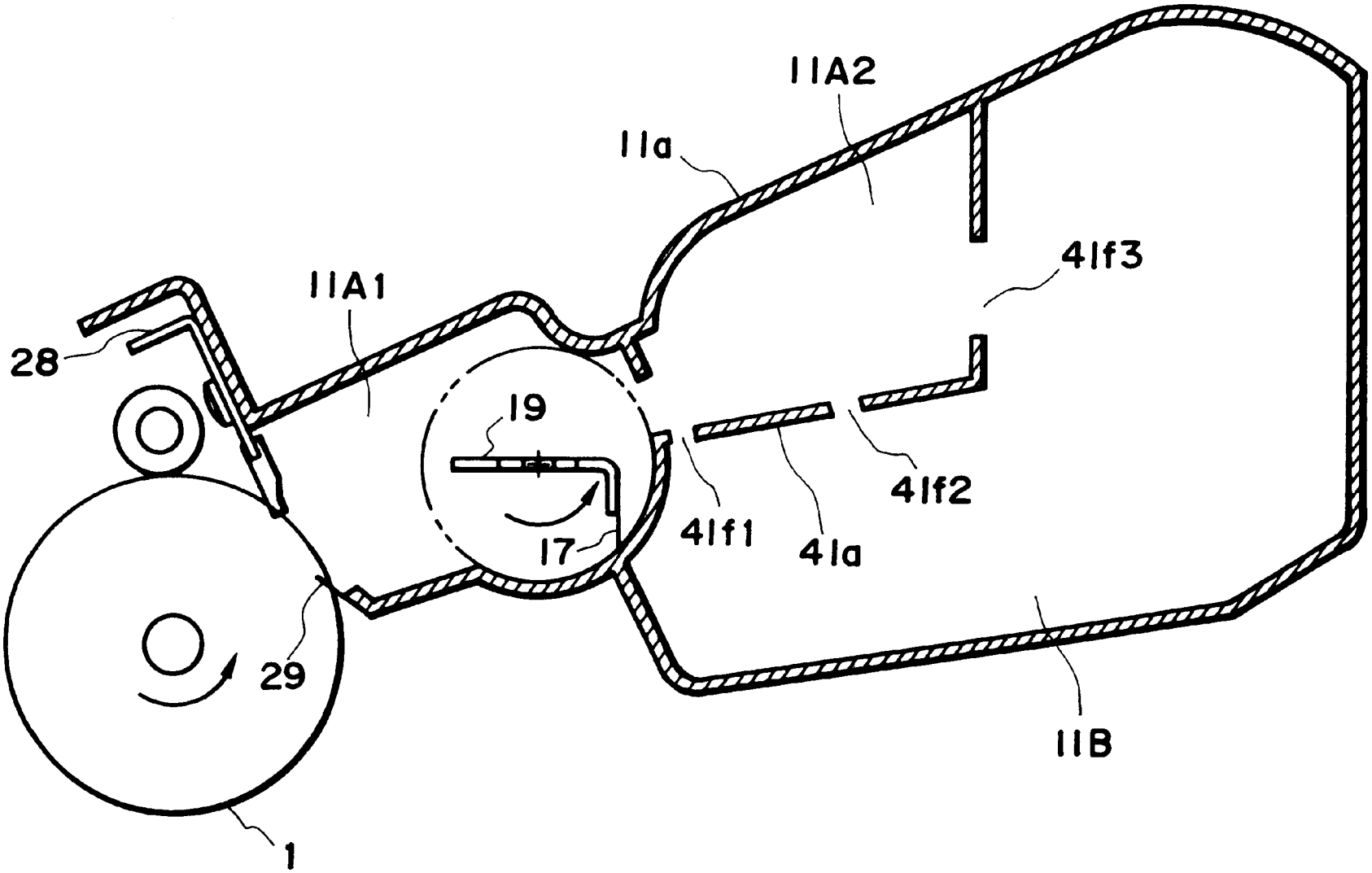
FIG. 29 is a schematic section of the cleaning apparatus in another embodiment of the present invention.

Referring to FIG. 29, the partitioning member 41*a* which divides the toner conveying portion of the waste toner container 11*a* is provided with a plurality of openings 41*f*1, 41*f*2 and 41*f*3. These openings are substantially the same in length as the sweeper blade 17. The waste toner swept by the sweeper blade 17 first falls into the toner storage portion 11B through the first opening 41*f*1, accumulating therein. After the waste toner accumulates as high as the first opening 41*f*1, the waste toner is conveyed farther rearward past the first opening 41*f*1. Then, as the waste toner reaches the second opening 41*f*2, it falls into the toner storage portion 11 B, accumulating therein, as it did through the first opening 41*f*1. Next, after the waste toner accumulates as high as the second opening 41*f*2 as it did in the case of the first opening 41*f*1, the waste toner delivered thereafter is sent farther rearward of the second opening 41*f*2, to the third opening 41*f*3, through which it falls into the toner storage portion 11B. With this arrangement, the waste toner can be delivered in steps to the photosensitive drum side, the mid portion, and the rear side of the toner storage portion 11B in this order, to accumulate the waste toner substantially evenly across the toner storage portion 11B. Therefore, dead space is less liable to be created in the toner storage portion 11B. Further, according to this arrangement, the amount of the waste toner which remains in the toner conveying portion 11A1 can always be kept small. Thus, it can be assured that the cleaning performance of the cleaning device 6 is reliably maintained throughout even the greatly increased service life of a latest photosensitive member, and also, it is easier for the user to maintain the apparatus.

Next, referring to FIG. 30, the fourth embodiment of the cleaning device 6 in accordance with the present invention will be described. Also in this case, only the difference between this embodiment and the second embodiment will be described.

Figure 30:
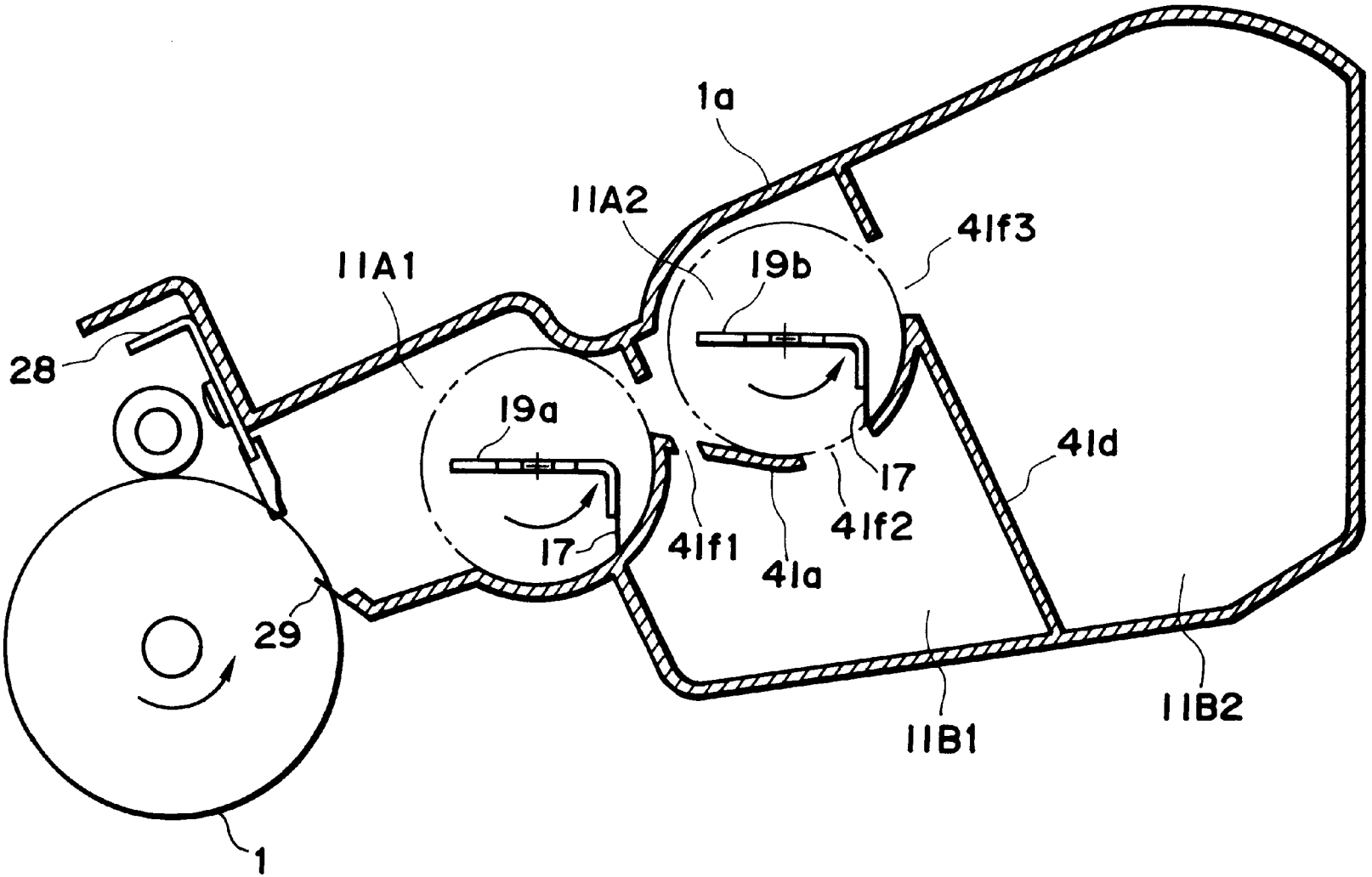
FIG. 30 is a schematic section of the cleaning apparatus in another embodiment of the present invention.
Figure 46:
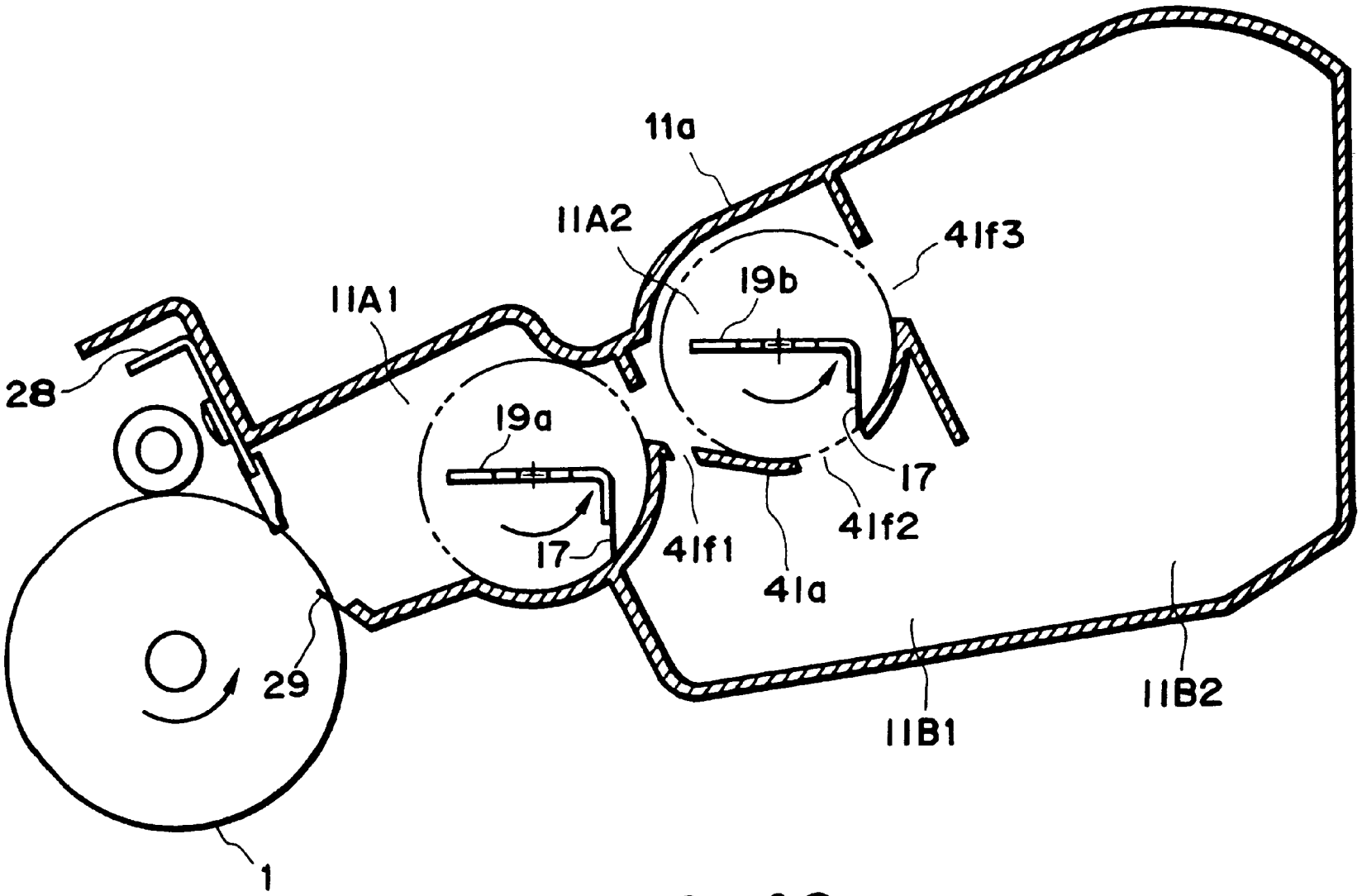
FIG. 46 is a schematic section of a modified version of the waste toner container portion illustrated in FIG. 30.

As illustrated in FIG. 30, the toner conveying portions 11A1 and 11A2 are provided with rotational plates 19*a* and 19*b,* respectively, which have a sweeper blade 17 as a toner conveying means. The rotational plate 19*a* rotates by receiving the driving force directly from an unillustrated apparatus main assembly side driving shaft located in the rear relative to the direction perpendicular to the surface of FIG. 29. The force for driving the rotational plate 19*b* is indirectly transmitted to the rotational plate 19*b* from the driving shaft for the rotational plate 19*a,* through a gear train, to rotate the rotational plate 19*b* in the counterclockwise direction, that is, the same direction as the rotational direction of the rotational plate 19*a.* The positional relationship between the first and second rotational plates 19*a* and 19*b* is such that the first rotational plate 19*a* is on the photosensitive drum side, and the second rotational plate 19*b* is behind the first rotational plate 19*a* as seen from the photosensitive drum 1, and that the rotational center of the second rotational plate 19*b* is located higher than that of the first rotational plate 19*a.* In other words, this embodiment of the cleaning device 6 is structured so that the waste toner is lifted to a higher point of the toner storage portion 11B2 in steps while the waste toner is first conveyed by the first rotational plate 19*a,* entering the chamber in which the second rotational plate 19*b* is disposed, and then, is conveyed further rearward by the second rotational blade 19*b,* being swept upward. With this arrangement of the toner conveying portions 11A1 and 11A2, the capacity of the toner conveying portion 11A in terms of the rearward conveyance of the waste toner increases, rendering it more difficult for the waste toner to accumulate in the toner conveying portion 11A1, next to the photosensitive drum 1. Therefore, it is possible to maintain stable toner cleaning performance throughout the service life of the photosensitive drum 1. The effects of dividing the toner storage portion 11B into the first and second toner storage portions 11B1 and 11B2 with the use of the partitioning member 41*d* in this embodiment are the same as the effects of the division in the first embodiment. It should be noted here that this embodiment may be modified as illustrated in FIG. 46; it is unnecessary to partition the toner storage container 11B with the partitioning member 41*b*.

As is evident from the above descriptions, according to the present invention, a process cartridge comprising a photosensitive drum capable of withstanding an extremely large number of printing cycles, and a photosensitive member cleaning portion, is provided with a partitioning member which divides the waste toner container of the photosensitive drum cleaning portion into a top portion which conveys the waste toner, and a bottom portion which stores the waste toner; a partitioning member which divides the waste toner storage portion into two or more smaller waste toner storage portions connected in the toner conveying direction; a partitioning member which divides the toner conveying portion into two or more smaller toner conveying portions connected in the toner conveying direction; and rotational plates as toner conveying means. Therefore, even when the process cartridge is removed, moved around, and reinstalled, during the maintenance performed in the middle of an image forming operation, the waste toner removed from the photosensitive drum 1 does not shift to the photosensitive drum side opening of the waste toner container, and the adjacencies thereof. Consequently, the opening and the adjacencies thereof are always kept clear of the waste toner, and it is possible to prevent the waste toner from leaking from the adjacencies of the opening Thus, the apparatus can be comfortably used even when the operation is continued for a longer period of time.

According to another aspect of the present invention, the partitioning member which divides the toner conveying portion of the waste toner container into top and bottom halves is provided with a plurality of openings which measure substantially the same in the lengthwise direction as the internal space of the waste toner container; the number of the locations at which the waste toner is passed from the toner conveying portion to the toner storage portion becomes plural. Therefore, it is possible to reduce the degree of unevenness with which the waste toner is accumulated in comparison with the partitioning member with a single opening. As a result, it becomes less likely for dead spaces to be created in the waste toner storage portion, making it possible to efficiently store the waste toner in the limited space of the waste toner storage portion.

According to another aspect of the present invention, a waste toner container is provided with a pair of translucent windows as a part of a detection system (for detecting the full state of the toner storage portion), which are disposed at the rearmost portion of the toner storage portion of the waste toner container partitioned into top and bottom halves by a partitioning member, and a leveler blade which is disposed in the toner storage portion as means for leveling the waste toner accumulated in the toner storage portion. Therefore, the possibility that the means for detecting the full state of the toner storage portion will malfunction because of the waste toner which adheres to the translucent window even when an ample space for toner accumulation is left in the toner storage portion is eliminated, improving the accuracy with which the full state of the toner storage portion is detected.

Further, the direction in which the aforementioned leveling blade is rotated is such a direction that the waste toner is moved away from the translucent windows for detecting the full state of the toner storage portion. Therefore, the waste toner does not collect on the windows and the adjacencies thereof unless the toner storage portion becomes full, eliminating the chance that the means for detecting the full state of the toner storage portion is caused to malfunction by the waste toner which collects on the windows in spite of the availability of an ample space for waste toner accumulation. Consequently, the accuracy with which the full state of the toner storage portion is detected is improved.

Further, the present invention is characterized in that the partitioning member which horizontally partitions the internal space of the waste toner container into the toner conveying portion and the toner storage portion, and the shell of the waste toner container, are manufactured as separate components, and the bracket plate 41*i* of the partitioning member is provided with insertion guides, that is, holes cut in the bracket plate 41*i* to be coupled with positioning projections 11*p* provided on the container shell side. Therefore, the configuration of the waste toner container does not become complicated, affording more latitude in design. In addition, the insertion guide cut in the back plate of the partitioning member makes it easier to accurately position the partitioning member in the waste toner container 11*a*, improving assembly efficiency, and also, reducing the number of assembly errors.

Further, the waste toner container partitioning member which is separate from the waste toner container shell is provided with a structure which temporarily fixes the position of the rotational shaft of the toner conveying rotational plate relative to the partitioning member, and the rotational plate is engaged with the positioning mechanism before the waste toner container partitioning member is assembled into the waste toner container shell. Therefore, when assembling the waste toner container partitioning member into the waste toner container shell, the rotational plate is automatically and accurately positioned relative to the waste toner container shell at the same time as the position of the partitioning member is accurately fixed relative to the waste toner container shell. Consequently, the rotational plate can be easily and accurately assembled into the waste toner container shell, improving assembly efficiency.

Further, the aforementioned partitioning member which is separate from the waste toner container shell is provided with a structure which temporarily fixes the position of the rotational shaft of the cleaning roller for a photosensitive drum, and the cleaning roller is attached to the structure before the waste toner container partitioning member is inserted into the waste toner container shell. Therefore, when assembling the waste toner container partitioning member into the waste toner container shell, the cleaning roller is automatically and accurately positioned relative to the waste toner container shell at the same time as the position of the partitioning member is accurately fixed relative to the waste toner container shell. Consequently, the cleaning plate can be easily and accurately assembled into the waste toner container shell, improving assembly efficiency.

Further, the aforementioned partitioning member which is separate from the waste toner container shell is provided with a structure which fixes the position at which the cleaning roller is rotated to clean the photosensitive drum. Therefore, a steady contact pressure can be maintained between the photosensitive drum and the cleaning roller. In addition, the structure eliminates the need for a dedicated structure for positioning the cleaning roller, and consequently reduces the component count, as well as contributing to the structural simplification of the apparatus.

Structure of Electrical Terminal

Next, referring to FIGS. 10–12, 20, 22–24, connection and positioning of the terminals which electrically connect the process cartridge B and the image forming apparatus main assembly 14 as the former is installed into the latter will be described.

Figure 11:
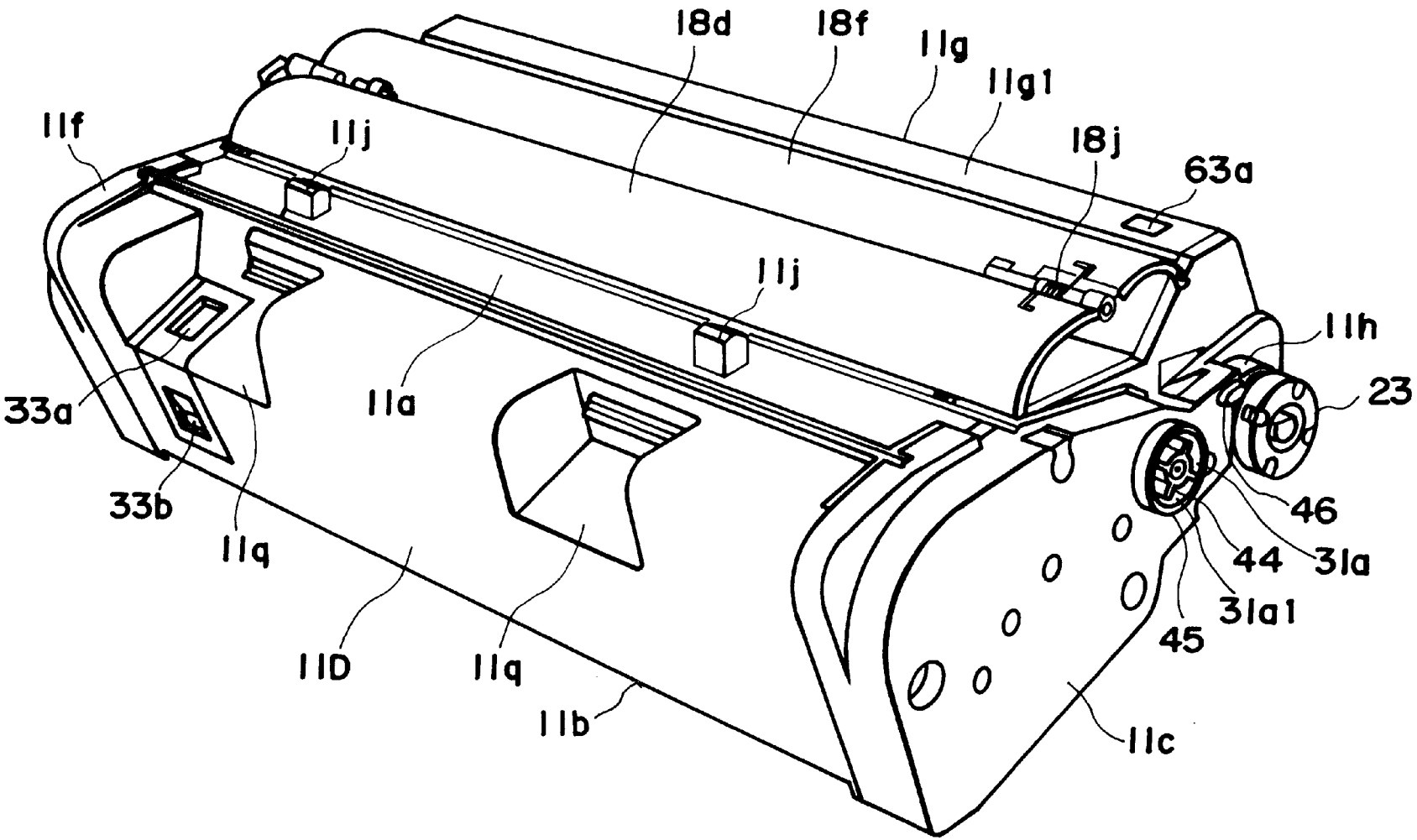
FIG. 11 is a perspective view of the process cartridge illustrated in FIG. 3, as seen from the right rear.
Figure 12:
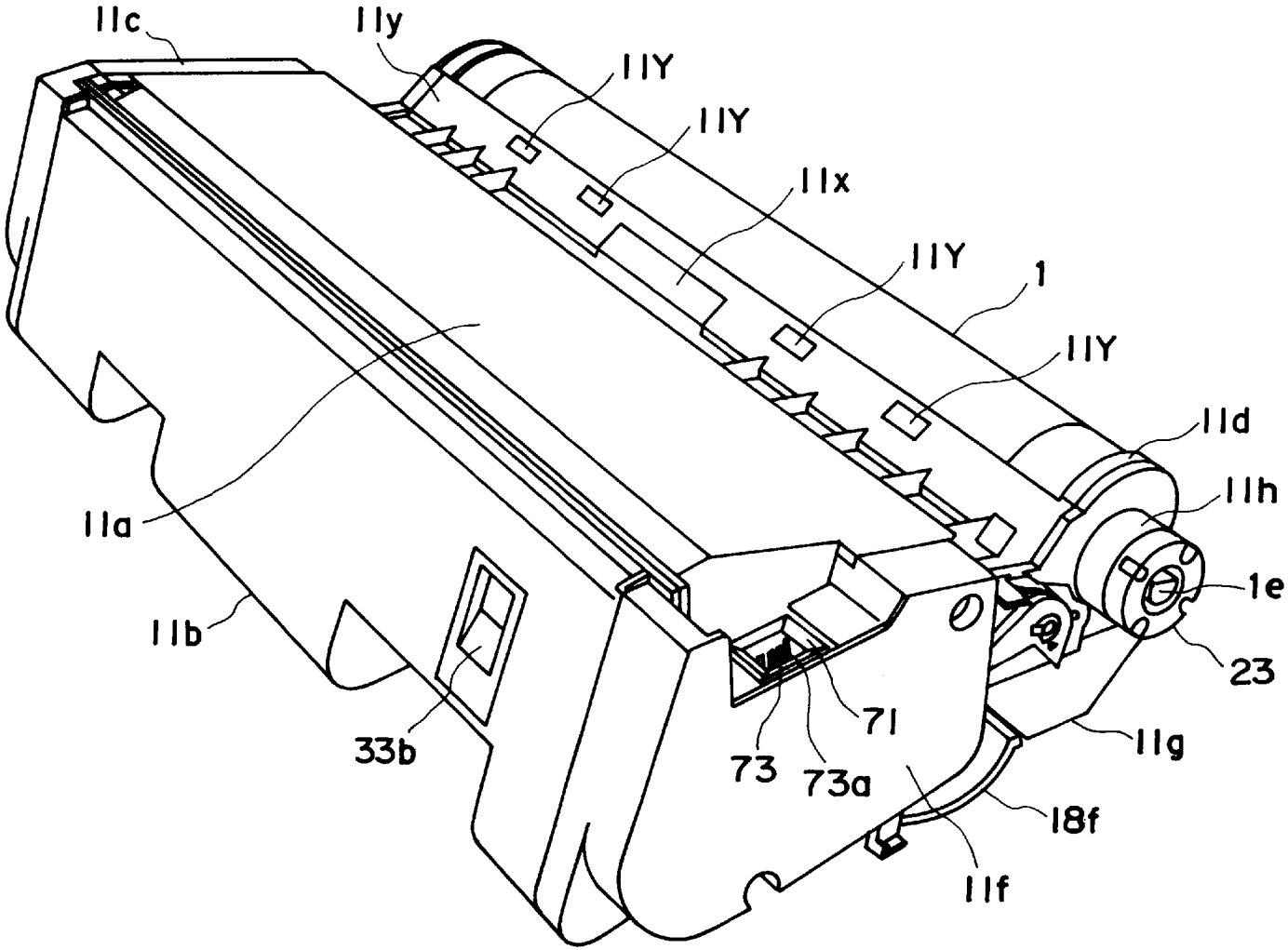
FIG. 12 is a perspective view of the process cartridge illustrated in FIG. 3, being inversely placed, as seen from the bottom left.
Figure 13:
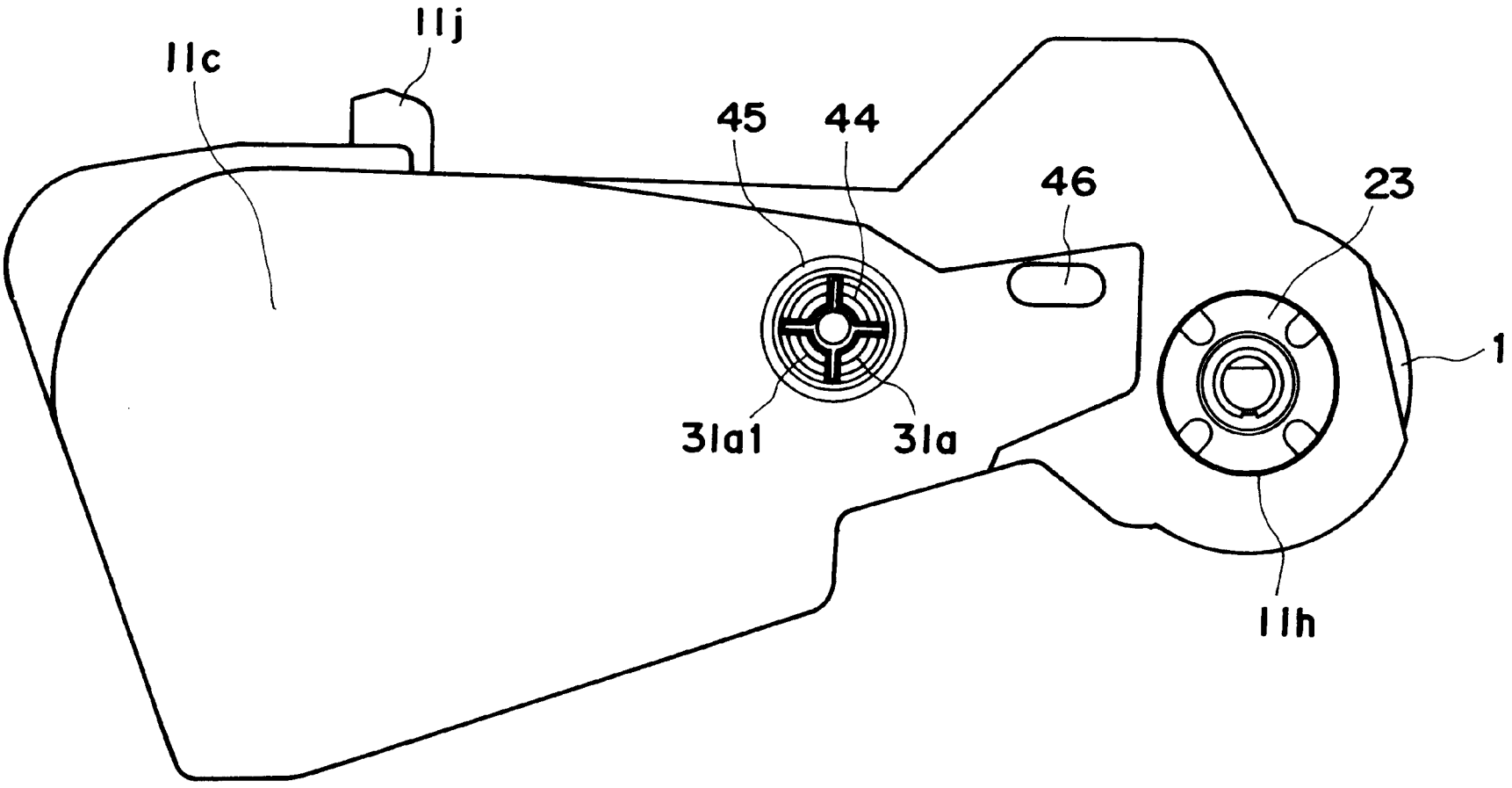
FIG. 13 is a schematic side view of a process cartridge, on the side on which an installation guide portion is disposed.

Referring to FIGS. 10–12, the process cartridge B is provided with a plurality of electrical terminals. They are: (1) an electrically conductive terminal 61 as a grounding terminal which is constituted of the surface of the lengthwise end of the drum support shaft 1*d*, on the side opposite to the side on which the process cartridge B receives driving force, and is electrically connected to the photosensitive drum 1 to ground the photosensitive drum 1 to the apparatus main assembly 14; (2) an electrically conductive charge bias terminal 63 electrically connected to the metallic shaft of the charge roller 2*c* to apply charge bias to the charge roller 2*c* from the apparatus main assembly 14; and (3) a connector 71 through which the data pertaining to the process cartridge B are transmitted from the apparatus main assembly 14 to the memory of the process cartridge B to be stored therein.

The aforementioned grounding terminal 61 is constituted of the end surface of the drum support shaft 1*e* which supports the photosensitive drum 1 on the cartridge frame 11, and makes contact with the grounding terminal 61 positioned on the axial line of the photosensitive drum 1. The grounding terminal 61 on the apparatus main side is formed of metallic material.

The grounding terminal 61 is constituted of the end surface of the support shaft 1*e* located at the center of the cylindrical guide 11Z disposed outward side of the cylindrical positioning boss 11*h*.

Therefore, the grounding terminal 61 is prevented from being accidentally damaged while the process cartridge B is inserted into, or removed from, the cartridge guide 50, or while the process cartridge B is handled after it is removed from the cartridge guide 50. When the process cartridge B is installed into, or removed from, the apparatus main assembly 14, the cylindrical guide 11Z and the axle coupler 23 are guided by the cartridge guide 50. The positioning bosses 11*h*, and the guide 11Z, which are disposed at the corresponding lengthwise end of the photosensitive drum 1, are integrally formed with the cartridge frame 11, and composed of plastic material. The diameters of the axle coupler 23 and the guide 11Z are slightly smaller than the diameter of the positioning boss 11*h*.

Referring to FIG. 20 which is a lengthwise section of the photosensitive drum 1, and FIG. 21, (a) which is a cross-section of the photosensitive drum 1 taken at the point indicated by an arrow mark C in FIG. 20, a grounding plate if is fitted in the aluminum cylinder 1*c*, being in contact with, and elastically flexed against, the aluminum cylinder 1*c* and the drum support shaft 1*e* (grounding terminal 61).

The grounding plate 1*f* comprises projections 1*h* which are constituted of the corresponding circular edges thereof. The grounding plate 1*f* makes contact with the aluminum cylinder by these projections. The projections 1*h* are separated from the main portion of the grounding plate 1*f* by a groove 1*g*. When the grounding plate 1*f* is out of the aluminum cylinder 1*c*, the distance between the two tips of the projection 1*h* is slightly greater than the internal diameter of the aluminum cylinder 1*c*.

The grounding plate 1*f* comprises a hole 1*j* through which the drum support shaft 1*e* is put, and a plate spring portion 1*k* which extends to the center of the hole 1*j* which substantially coincides with the center of the end surface of the drum support shaft 1*e*. The tip of the plate spring portion 1*k* is bent, constituting an actual contact portion 1*k*1.

The grounding plate 1*f* is fixed to the drum flange 1*b* on the non-driven side by heat welding or the like, and the drum flange 1*b* is fixed to the end portion of the aluminum cylinder 1*c* by crimping, gluing, or the like fixing method. In this state, the tip of the projection 1*h* bites into the aluminum cylinder 1*c*, becoming fixed thereto. The drum flange 1*a* on the driven side is fixed to the other end of the aluminum drum cylinder 1*c*. The actual contact portion 1*k*1 of the plate spring portion 1*k* comes in contact with the end surface of the drum support shaft 1*e* as the drum support shaft 1*e* is put through the aluminum cylinder 1*c*.

The grounding plate 1*f* is formed of electrically conductive elastic material, for example, stainless steel plate, phosphor bronze plate, or beryllium bronze plate, and the aluminum cylinder 1*c* and the drum support shaft 1*e* (grounding terminal 61) are electrically connected through the grounding plate 1*f*.

Referring to FIGS. 10 and 11, the charge bias terminal 63*a* is exposed at the top surface 11*g*1 of the charging device cover 11*g* which is a part of the cartridge frame 11. The cross-section of the charging device cover 11*g*, perpendicular to the lengthwise direction, is trapezoidal, and the top surface of the charge bias terminal 63*a* is substantially in the same plane as the flat top surface 11*g*1 of the charging device cover 11*g*.

Referring to FIG. 3 which is a cross-section of the process cartridge B, the charging device cover 11*g* comprises a hook 11*g*2 which is integrally formed and projects from the inward surface of the charging device cover 11*g*. In the space enclosed by the charging device cover 11*g*, the photosensitive drum side end of the top wall of the waste toner container 11*a* is bent vertically upward, constituting a vertical wall 11*s*, and then is horizontally bent leftward in the drawing, creating a space 11*t*. This horizontal portion extending leftward, that is, the wall portion above the space 11*t* is provided with a cover anchoring hole 11*u*, and the hook 11*g*2 of the charging device cover 11*g* is engaged in this hole 11*u*. This hole 11*u* is located straight above the snap-fitting positioning portion 41*k* which prevents the waste toner container partitioning member 41 from slipping out of the shell of the waste toner container 11*a*, and therefore, it is possible to put the tip of a screwdriver, for example, through this hole 11*u* to push down the snap-fitting positioning portion 41*k* so that the waste toner container partitioning member 41 can be pulled out of the shell of the waste toner container 11*a*. Both of the side plates of the charging device cover 11*g*, located at the corresponding lengthwise ends, are provided with two unillustrated dowels, and these dowels are fitted in the corresponding round and elongated blind holes 11*c*5 and 11*c*6 provided on the inward surfaces of the gear cover 11*c* and the side cover 11*f* (FIG. 43, in which the round and elongated blind holes 11*c*5 and 11*c*6 of the side cover 11*f* are not illustrated).

The details of the aforementioned charge bias terminal 63 are illustrated in FIGS. 22 and 23 which illustrate the bearing portion which supports the charge roller 2*c*.

The waste toner container 11*a* is provided with the bearing guide 111, which is formed as a part of the charging device support portion 11*e* which is a part of each of the lengthwise ends of the vertical wall 11*s* located above the photosensitive drum 1. The bearing guide 111 is connected to the drum support portion 11*d* by being integrally molded with the drum support portion 11*d*. Its cross-section parallel to the side wall of the waste toner container 11*a* becomes narrower on the side away from the photosensitive drum 1, and its contour coincides with that of the charging device cover 11*g*. The vertical cross-section, perpendicular to its trapezoidal section, of the top portion of the bearing guide 111 is rectangular, and this top portion of the bearing guide 111 constitutes a charge bias terminal supporting portion 11*v*. On the non-driven side, the top portion (unillustrated) of the bearing guide 111 is recessed from the aforementioned trapezoidal contour, and the charge bias terminal 63 is disposed at the lengthwise end portion of the bearing guide 111.

The charge bias terminal 63 is constituted of a strip of metallic plate such as stainless steel plate, phosphor bronze plate, or phosphor beryllium plate, and is bent in the direction parallel to the lengthwise edges thereof The charge bias terminal supporting portion 11*v* is provided with a projection 11*v*1, which projects upward and perfectly aligns with the hole in which the charge bias terminal 63 fit. Also, the charge bias terminal supporting portion 11*v* is provided with a dowel 11*v*2, which projects outward in the lengthwise direction, and a dowel 11*v*3, which projects toward the photosensitive drum 1 from the compound spring's seat portion 26 of the charge bias terminal supporting portion 11*v*.

The charge bias terminal 63 is provided with an anchoring hole 63*c*, which is located at the substantial center of the charge bias terminal 63 in the longitudinal direction thereof, and from the edge of which slits 63*b* are extended. The top half of the charge bias terminal 63 relative to the anchoring hole 63*c* is bent along the contour of the top portion of the charge bias terminal supporting portion 11*v* and the contour of the top projection 11*v*1, reaching as far as the inward side of the top projection 11*v*1, and the portion corresponding to the top surface of the top projection 11*v*1 constitutes the charge bias contact point 63*a*. The bottom half of the charge bias terminal 63 is bent along the contour of the bottom portion of the charge bias terminal supporting portion 11*v*, reaching the inward end of the bottom wall of the charge bias terminal supporting portion 11*v*. This end of the charge bias terminal 63 is provided with a hole 63*d*. Thus, the charge bias terminal 63 is attached to the charge bias terminal supporting portion 11*v*, with the dowels 11*v*2 and 11*v*3 tightly fitted, by pressing, in the anchoring hole 63*c* and the hole 63*d*, respectively.

The compound spring 26 is constituted of a compression spring portion 26*a*, and a contact spring portion 26*b* which diagonally stretches downward from the end turn portion of the top end of the compression spring portion 26*a* and presses upon the charge roller shaft 2*a*. The contact spring portion 26*b* extends beyond the contact point between the charge roller shaft 2*a* and the contact spring portion 26*b*, bending upward slightly beyond the contact point, extending upward along the bearing guide 111, and bends again in the direction away from the bearing guide 111. On the non-driven side, the spring which elastically presses the charge roller shaft 2*a* toward the photosensitive drum 1, is constituted of only a compression spring portion 26*a*.

Because the charge bias terminal 63 is structured as described above, as the dowel 11*v*2 is inserted all the way to its base in the anchoring hole 63*c* by pressing the charge bias terminal 63 onto the charge bias terminal supporting portion 111 while holding wide the open end portions of the substantially U-shaped charge bias terminal 63 against the elastic force thereof, the external contact point portion 63*a* and the end hole 63*d* automatically engage with the top projection 11*v*1 and the dowel 11*v*3, respectively, due to the resiliency of the charge bias terminal 63, making it extremely simple to attach the charge bias terminal 63 to the waste toner container 11*a*.

The surface of the charge bias contact point 63*a* descends starting from the trailing end to the leading end relative to the horizontal direction in which the cartridge guide 50 is pushed into the apparatus main assembly 14, and as the cartridge guide 50 is pushed into the apparatus main assembly 14, the charge bias contact point 63*a* comes in contact with the charge bias contact point 64 on the main assembly side, and pushes it against the elastic force of the spring 64*a* of the charge bias contact point 64 on the main assembly side. The photosensitive layer, that is, the surface layer, of the photosensitive drum 1 is uniformly charged through the charger roller 2*c* as voltage composed by superposing AC voltage and DC voltage is applied to the charge roller 2*c* from the power source controlled by the controller of the apparatus main assembly 14, through the charge bias contact point 64, the charge bias terminal 63, and the contact point spring 26*b*. In other words, as the charge bias contact point 63*a*, and the charge bias contact point on the apparatus main assembly side, are placed in contact with each other, AC voltage and DC voltage are applied in the superposing manner from the apparatus main assembly 14 to the charge roller 2*c*.

Process Cartridge Memory

In the case of the image forming apparatus in this embodiment, after the functions of the built-in components of the process cartridge B deteriorate with usage, the process cartridge B is entirely replaced. The operation for replacing the process cartridge B is a simple operation in which the image forming apparatus main assembly is opened with a single touch; the old cartridge is removed from inside the apparatus main assembly; and a fresh process cartridge is installed. In other words, this operation can be easily carried out by the user himself/herself, rendering the image forming apparatus maintenance free in practical terms.

Further, in order to improve the utility of an image forming apparatus by further developing the aforementioned prior arts, it is possible to add the following features and functions.

(1) A process cartridge is provided with an electronic device such as an electronic memory, so that data pertaining to manufacturing conditions of each process cartridge can be written into the electronic device at the time of production and/or shipment, and these written data can be referred to by the image forming apparatus side to form images under the conditions most suitable to each process cartridge, after the process cartridge is installed.

(2) The number of image formation cycles or the cumulative operation time for each job is recorded in the memory of each process cartridge, to inform the user of the cumulative usage time for each cartridge.

(3) The diagnostic data pertaining to the image forming apparatus main assembly are retained in the memory of each process cartridge, so that a service provider can efficiently service each process cartridge by referring to these data when an anomaly occurs, or at maintenance time; each process cartridge is provided with a trouble shooting function.

In order to provide an image forming apparatus with the above described features and functions, an electronic device, that is, a nonvolatile memory, such as an EPROM or the like, is mounted in a unit, such as a process cartridge, removably installable in the main assembly of an image forming apparatus.

Figure 39:
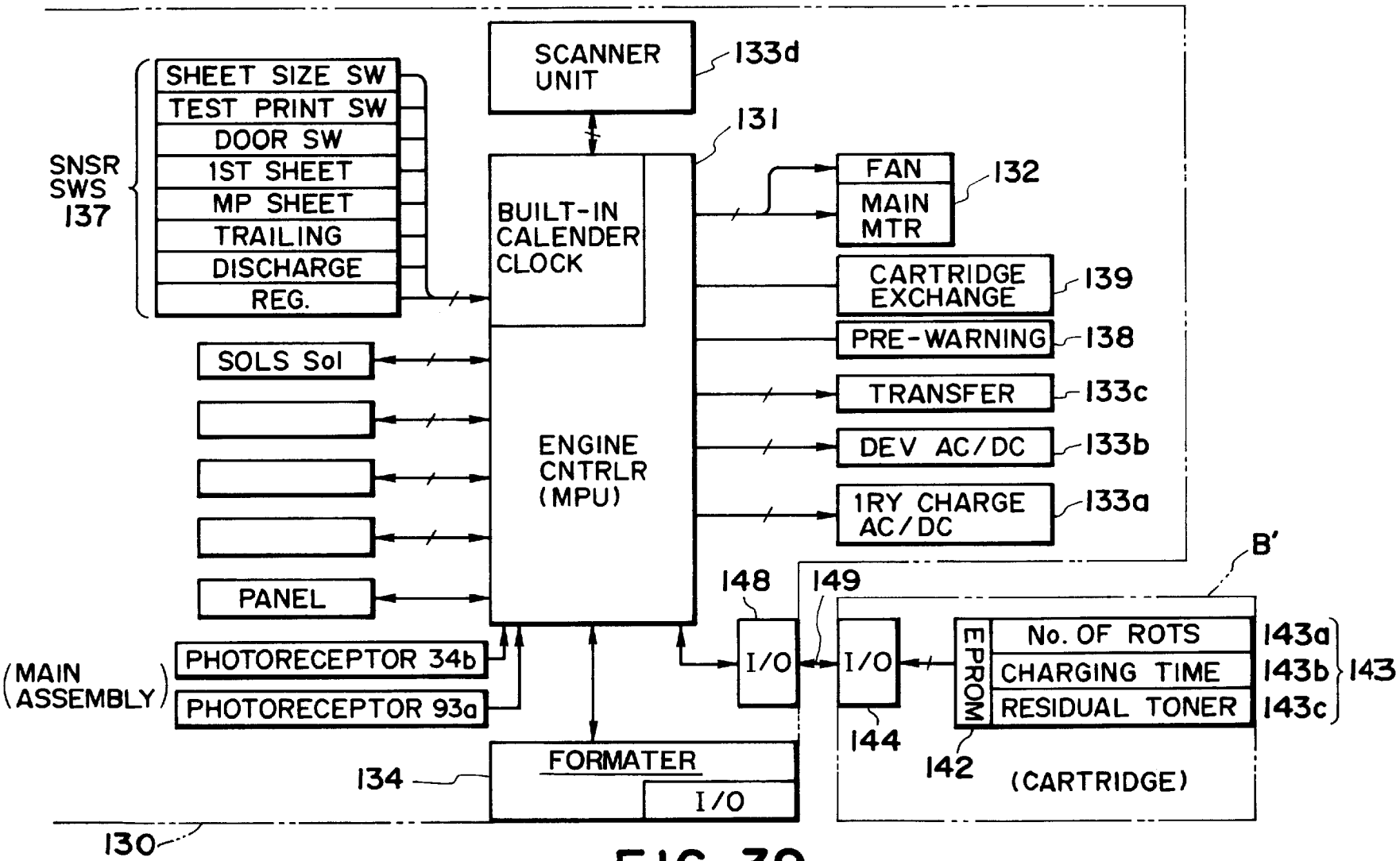
FIG. 39 is a block diagram for the control of an image forming apparatus.

FIG. 39 is a block diagram which depicts the control of the image forming apparatus and the process cartridge, in this embodiment. This drawing depicts the general control exclusive of the power control or the like. First, the basic control of an image forming apparatus will be described.

Referring to FIG. 39, the portions of the image forming apparatus main assembly, in which an electronic device is mounted, are surrounded by double dot chain lines 130. The engine controller (MPU) 131 has a computational function, a memory function, an internal clock, and an input-output function, and is normally in the form of an ASIC or the like. To this engine controller 131, a control block 132 for the main motor, a control block 133*a* for the primary charge voltage and the primary charge current, a control block 133*b* for development bias, a control block 133*c* for the first and second transfer voltages, and a control block 133*d* for the scanner are connected, and these units are controlled according to the programs stored in the engine controller 131.

At various locations in the image forming apparatus main assembly 14, one of the sensors in a sensor switch group 137 is disposed. The output of the sensor switch group 137 is transmitted to the engine controller 131 so that the operational states of the various portions can be monitored by the engine controller 131 throughout each printing operation sequence. Also, a formatter 134 is connected to the engine controller 131. The formatter 134 is a device which controls the signal traffic between the input/output ports of peripheral devices, and the engine controller 131, stores printing formats, and develops the printing formats into image data. In other words, it functions as a pre-processor for the engine controller 131.

Referring to FIG. 39, the portion surrounded by the double dot chain line designated with a referential figure B' corresponds to the portion mounted in the process cartridge B. Upon installation of the process cartridge B into the image forming apparatus main assembly 14, the circuit on the engine controller side and the circuit of the portion B' mounted in the process cartridge side become connected at an I/O connector portion 149 (connectors 71 and 72); the input/output device (I/O port) 148 on the engine controller side becomes connected to the input/output device (I/O port) 144 on the process cartridge side by way of the I/O connector portion 149, enabling the engine controller 131 to look up the data stored in the memory device 142.

Next, the data 143 which is stored in the memory device 142 mounted in the process cartridge B will be described.

In the memory device 142 such as an EPROM or the like, the rotation count 143*a* (cumulative) of the photosensitive drum 1, and the length (cumulative) in time the photosensitive drum 1 remained charged by the charge roller 2*c,* are stored By referring to these data, the remaining service life of the photosensitive drum 1 can be predicted Also in the memory device 142, a datum 143*c* pertaining to the filling-up of the toner storage portion 11B (11B3) with the waste toner is stored. It should be noted here that this datum 143*c* is transmitted to the engine controller (MPU) 131 by the signal from the light detector element 34*b* provided on the apparatus main assembly side, and then is stored in the memory device 142 through the input/output device 148 and the I/O connector portion 149.

Meanwhile, as the rotation count 143*a* of the photosensitive drum 1, and the length 143*b* in time the photosensitive drum remained charged by the charge roller 2*c,* reach the first predetermined value, a cartridge replacement warning 138 is displayed, and then, as they reach the second predetermined value, a cartridge replacement prompt 139 is displayed.

Similarly, upon receiving the datum indicating the filling-up of the container from the light detector element 34*b,* the engine controller (MPU) 131 displays the cartridge replacement warning 138. In addition, as the image formation count reaches a predetermined value, it also displays the cartridge replacement warning 138.

Further, after displaying the cartridge replacement prompt 139, the engine controller (MPU) 131 prohibits continuation of image formation. This is for the purpose of preventing the formation of inferior images.

As described before, it is in the memory device 142 of the process cartridge B that the aforementioned various data are stored, and therefore, even if the process cartridge B is removed from the apparatus main assembly 14 of one image forming apparatus, and then is installed in the apparatus main assembly 14 of another, or in the same image forming apparatus, the status of the process cartridge B can be accurately conveyed to the apparatus main assembly 14.

In this embodiment, an EP-ROM is employed as the memory device 142. Also, in order to reduce the number of the problems traceable to contact failure, the number of contact points is reduced by employing a serial port as the input/output device 144 through which the input/output data are exchanged between the engine controller 131 of the image forming apparatus main assembly 14 and the computing device 141 of the process cartridge B.

The aforementioned portion B' of the control circuit, which is mounted in the process cartridge B, is in the form of an IC and is contained in the connector 71 on the cartridge side.

In the embodiment described above, the process cartridge B is provided with an electronic device such as a memory IC, and the data detected on the process cartridge side, and the data on the apparatus main assembly side, are sent to the memory IC and stored therein, so that the status of the process cartridge B can be recognized by the engine controller 131 upon installation of the process cartridge B into the apparatus main assembly 14.

In order to send information to the memory IC, or extract information therefrom, the process cartridge B and the apparatus main assembly 14 are provided with the connectors 71 and 72, respectively.

As is evident from the preceding embodiments of the present invention, the first object of the present invention is to assure that the connector on the process cartridge side and the connector on the apparatus main assembly side of an image forming apparatus are desirably connected when a process cartridge is installed in the apparatus main assembly of the image forming apparatus by pivoting the process cartridge about the axial line of the photosensitive drum while installing the process cartridge.

The second object of the present invention is to prevent the capacity of the waste toner container from being affected by the provision of the connector, and this object is accomplished by placing the process cartridge side connector on the side plate of the waste toner container.

The third object of the present invention is to cause the grounding terminal to be connected before the rest of terminals to assure that the memory IC is protected. This object is accomplished by positioning the grounding terminal at one end of the rotational axis about which a process cartridge is pivoted during the installation thereof.

The fourth object of the present invention is to protect the memory IC from damages traceable to assembly processes or contact with the user. This object is accomplished by providing a waste toner container with a side cover which covers the connector which is equipped with a memory IC and is attached to the side plate of the waste toner container.

The fifth object of the present invention is to prevent an assembly mistake pertaining to a memory equipped connector which is attached to the side plate of a waste toner container.

Figure 32:
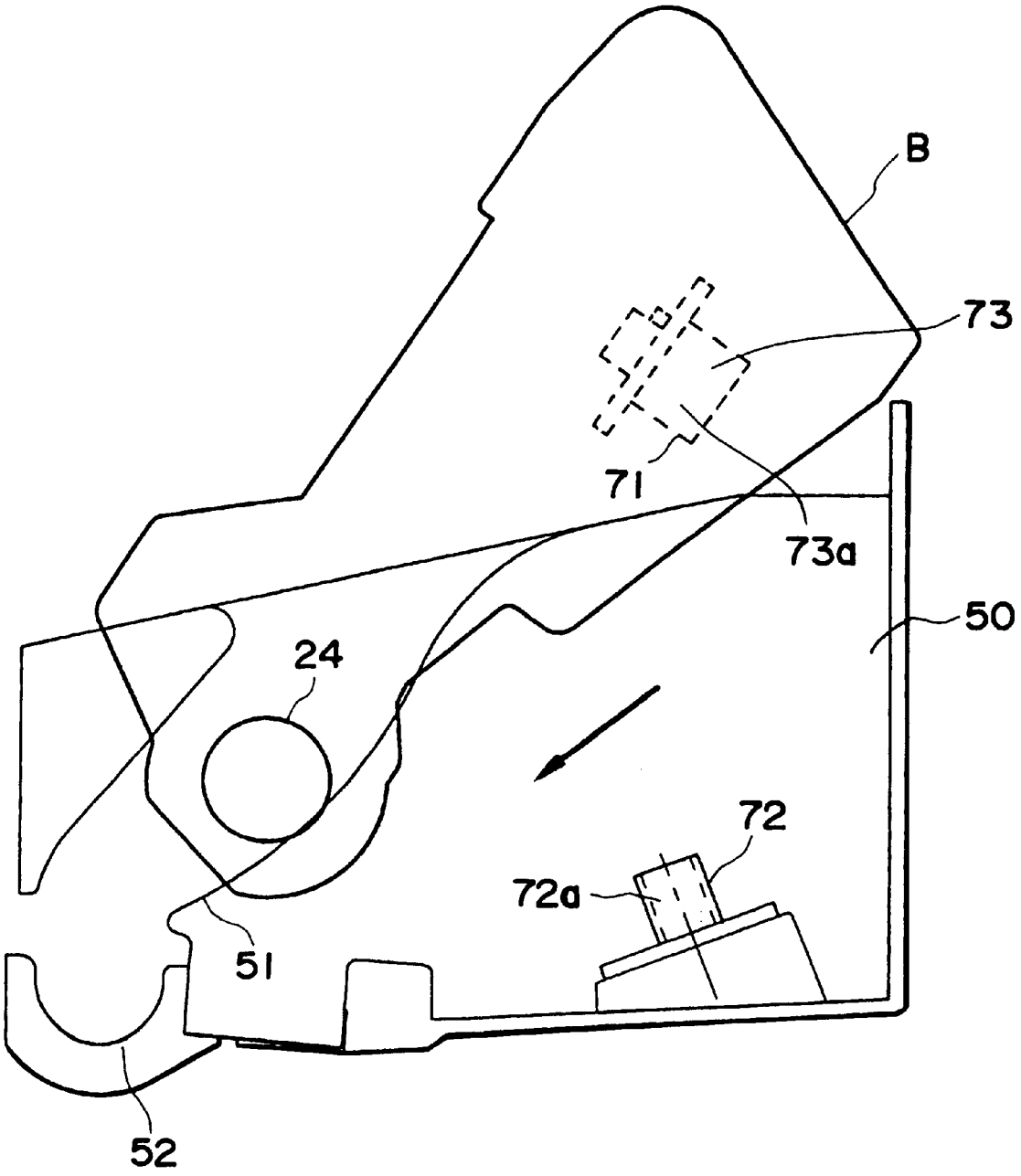
FIG. 32 is a schematic drawing which depicts the initial stage of the coupling of the connector on the process cartridge side with the connector on the apparatus main assembly side.

FIG. 12 is a perspective view of the rear and non-driven sides of an inversely placed process cartridge B. The connector 71 on the process cartridge side is provided with an electronic device such as an IC memory. In order to allow this IC memory and the apparatus main assembly 14 to exchange input/out data, the connector 71 on the process cartridge side, and the connector 72 on the apparatus main assembly side illustrated in FIGS. 32–34, become connected when the process cartridge B is placed in the cartridge guide 50 to be installed in the apparatus main assembly 14; they become connected before the cartridge guide 50 is pushed into the apparatus main assembly 14.

On the non-driven side, the connector 71 is attached to the side plate of the process cartridge B, with the connector terminal 73 exposed downward. In order to realize this arrangement, the side plate 11*k* of the waste toner container 11*a* is provided with a connector mount 11*w* which projects outward.

Next, the connector 71 of the process cartridge B will be described.

The connector 71 is of a type which comprises the electronic device B' such as a RAM or a nonvolatile ROM capable of storing, in advance, information necessary for desirable image formation, and also capable of storing the data obtained through image forming operations. These information and data are exchanged between the process cartridge B and the apparatus main assembly 14 at the time of the process cartridge installation, so that the engine controller 131 can recognize the current status of the process cartridge B.

Figure 33:
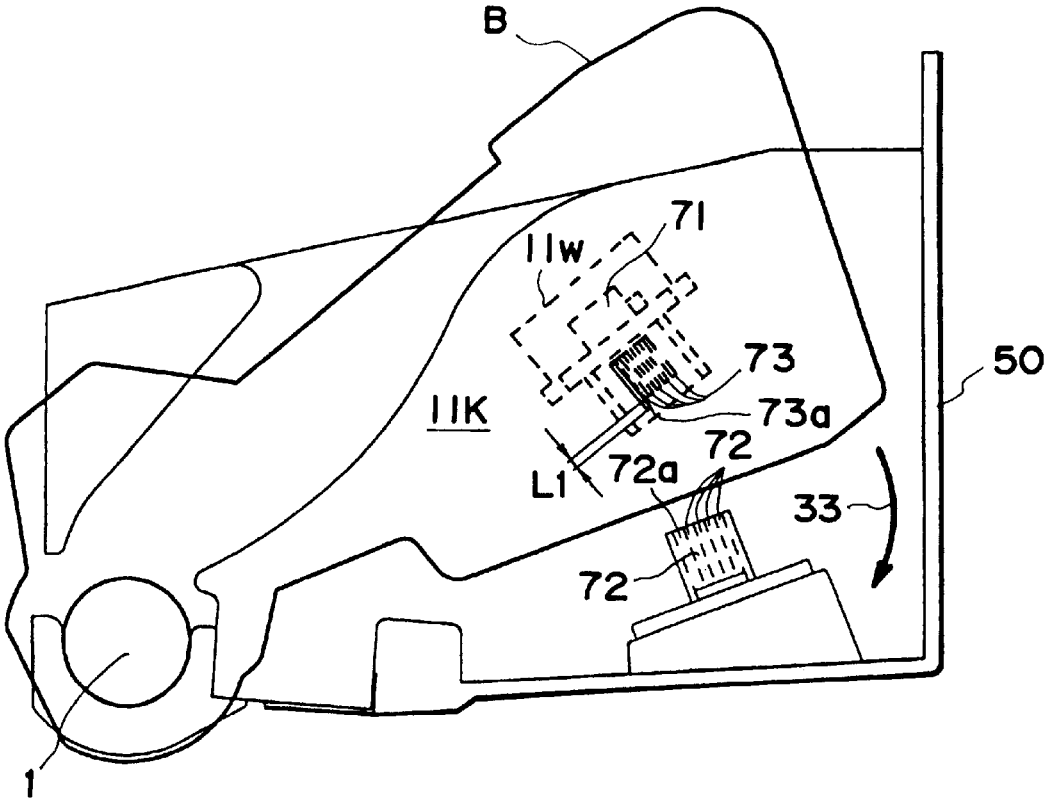
FIG. 33 is a schematic drawing which depicts the second stage of the coupling of the connector on the process cartridge side with the connector on the apparatus main assembly side.
Figure 34:
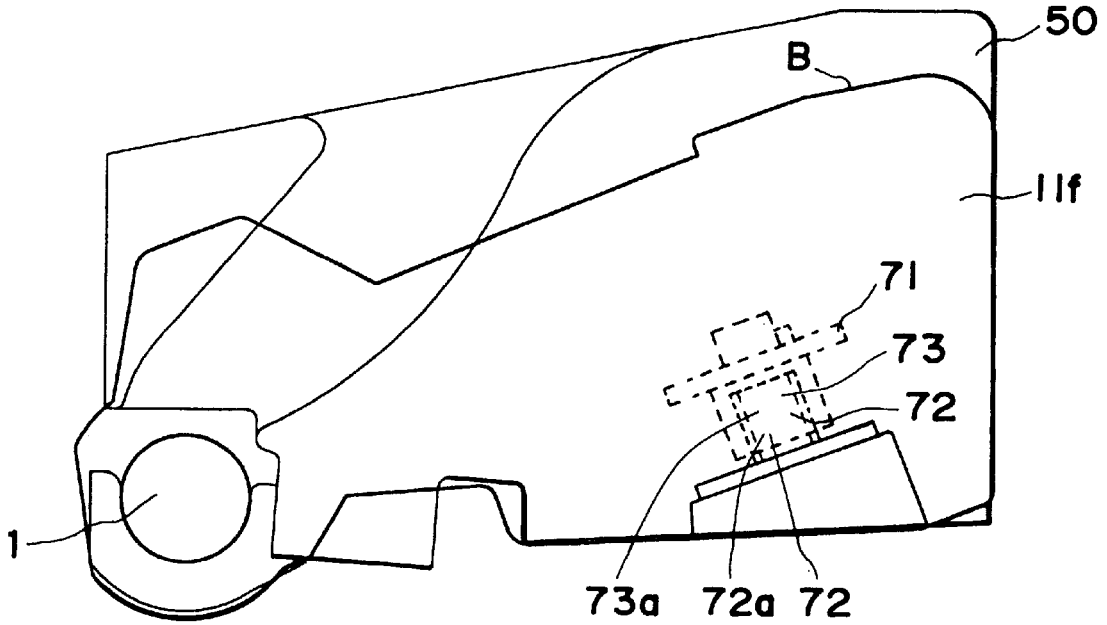
FIG. 34 is a schematic drawing which depicts the final stage of the coupling of the connector on the process cartridge side with the connector on the apparatus main assembly side.

Referring to FIG. 33, the connector 71 is structured to assure that desirable electrical connection is established between the connector 71, and the connector 72 on the apparatus main assembly side, as illustrated in FIG. 34, by the moment generated as the process cartridge B pivots about the axial line of the photosensitive drum 1 due to its own weight.

Next, it will be described where the connector 71 is attached.

Figure 35:
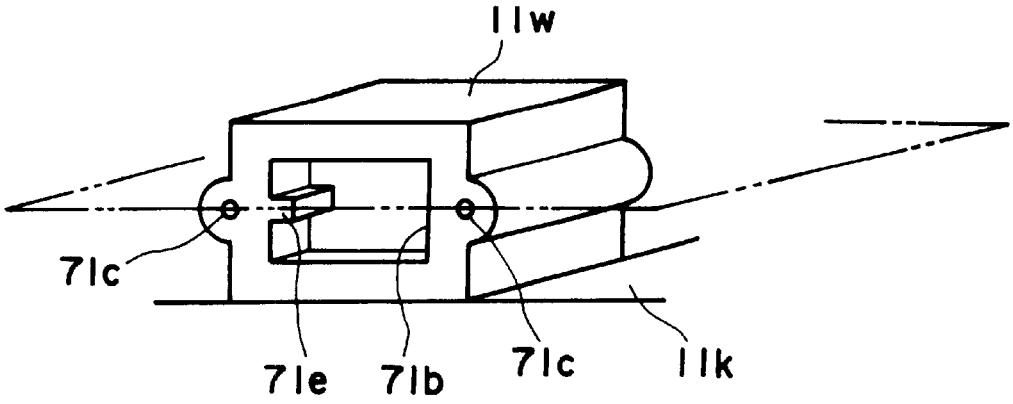
FIG. 35 is a perspective view of the connector socket of a process cartridge.

Referring to FIG. 35, the connector 71 is attached to the side plate 11*k* of the waste toner container 11*a,* with the connector terminal 73, which comes in contact with its counterpart on the apparatus main assembly side, facing downward. More specifically, the connector 71 is attached to the outward surface of the side plate 11*k* which is substantially in the same plane as the drum supporting portion 11*d* of the waste toner container 11*a*. Therefore, it is possible for the connector 71 to be mounted without reducing the waste toner capacity of the waste toner container 11*a,* and obviously, to be connected to the connector 72 by the movement of the process cartridge B during the installation thereof.

Further, it is rendered difficult for the use to touch the connector 71 by covering the connector 71 with the side cover 11*f* after the connector 71 is attached to the side plate 11*k* of the waste toner container 11*a*. Therefore, the electronic device B' such as an IC memory is protected from static electricity or the like.

Referring to FIG. 34, the connector 71 engages with the connector 72 on the apparatus main assembly side after it enters the space within the side cover 11*f*.

Next, it is described in more detail how the connector 71 is connected to the connector 72 on the apparatus main assembly side.

Referring to FIG. 33, among a group of terminals 73 within the connector 71, the grounding terminal 73*a* is located closest to the axial line of the photosensitive drum 1.

This is due to the fact that such positioning of the grounding terminal 73*a* assures that the grounding terminal 73 will always be the first one to be connected as the process cartridge B pivots, in the direction indicated by arrow 33 (FIG. 33), about the positioning boss 11*h* when the process cartridge B is installed in the apparatus main assembly 14.

Therefore, it is assured that the memory is protected to prevent memory destruction. If the ground terminal contact point 72*a* is rendered several millimeters L1 longer than the rest of the terminals 73, so that it projects above the others, it will be more certain that the memory is protected.

Figure 36:
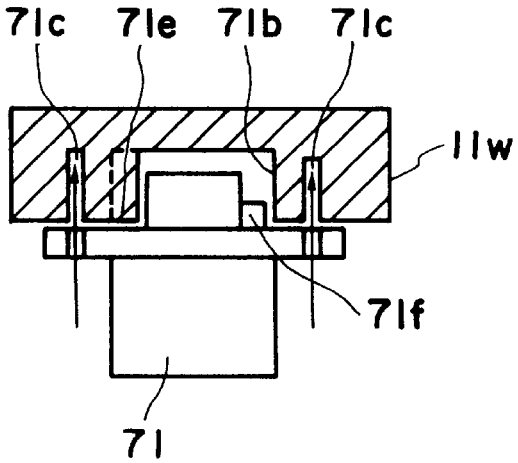
FIG. 36 is a cross-section of the connector socket illustrated in FIG. 35, taken at the plane indicated in the same drawing.
Figure 37:
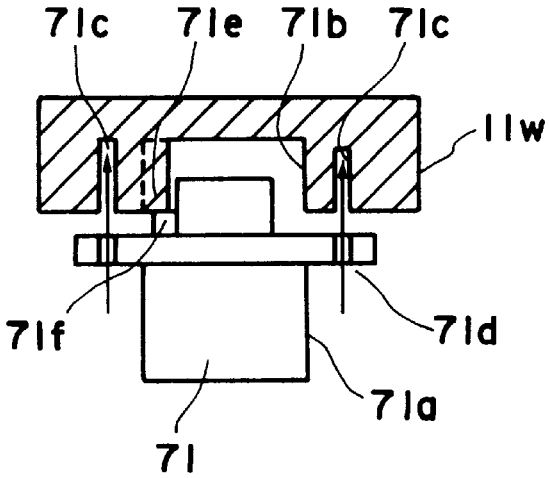
FIG. 37 is a cross-section of the connector socket illustrated in FIG. 35, taken at the plane indicated in the same drawing.
Figure 38:
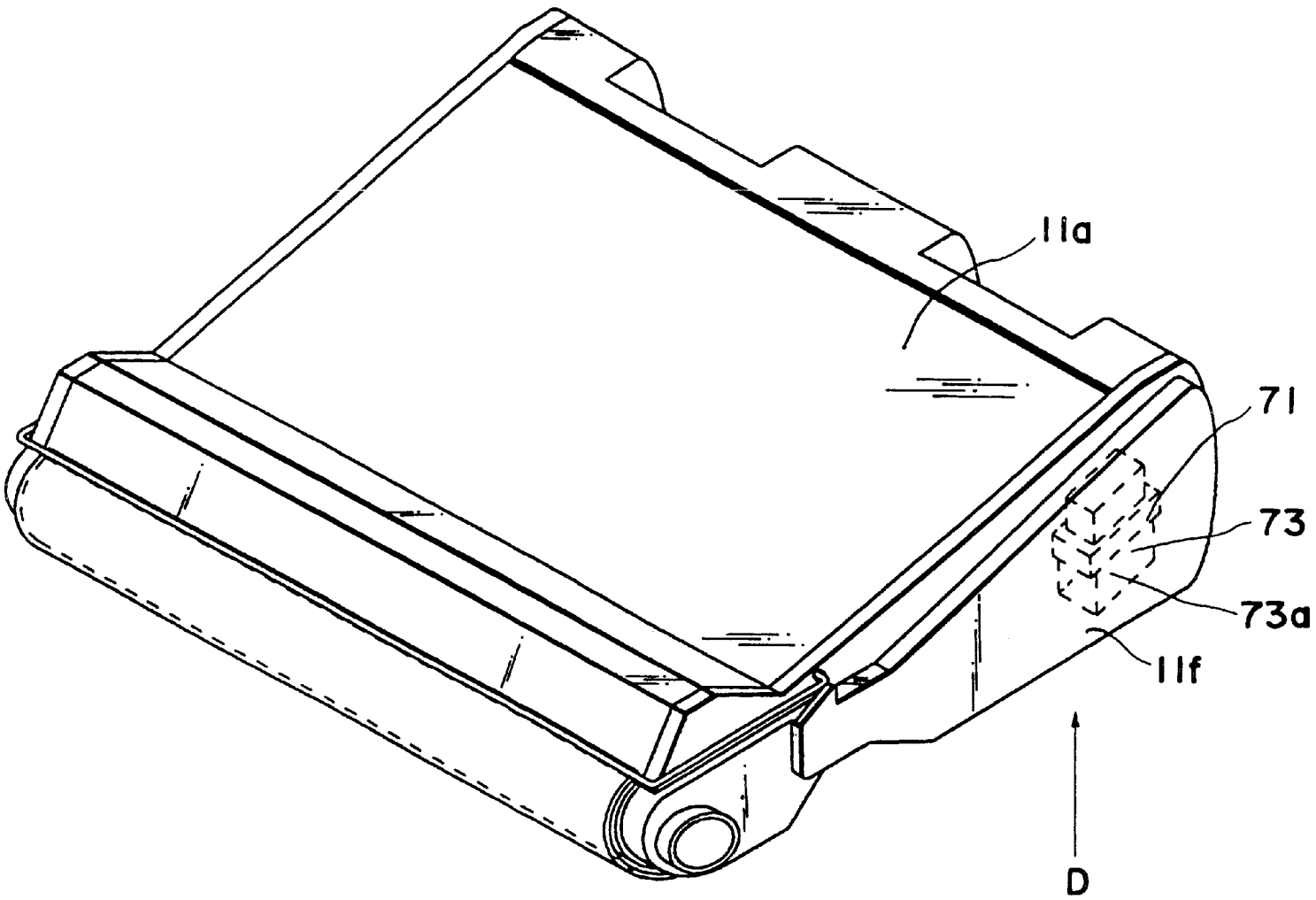
FIG. 38 is a schematic perspective view of a process cartridge, which shows the connector location.

Next, it will be described in detail how the connector 71 is attached to the waste toner container 11*a*. The connector mount 11*w* for the connector 71 is illustrated in FIG. 38. It is pointed by an arrow mark D, and is in the form of a phantom drawing. FIG. 35 is a perspective view of the connector mount for the connector 71 illustrated in FIG. 38. The cross-section of the connector mount 11*w* at the plane passed through the longitudinal axial lines of two tapping holes 1*c* is symmetrical, except for the rib portion, in terms of the tapping holes 71*c,* a hole 71*b* in which the connector 71 is inserted, a connector mount main structure 71*a,* and small screw holes 71*d* which align with the correspondent tapping holes 71*c*. The rib 71*e* is in the connector insertion hole 71*b*. The rib 71*e* extends in the same direction as the two tapping holes 71*c* and aligns in a straight line with them. Referring to FIGS. 36 and 37, which are sections of the connector mount 11*w,* the connector 71 is provided with a projection 71*f*. FIG. 36 depicts the correct state of engagement between the connector 71 and the connector mount 11*w*. If an attempt is made to engage the two components while placing the projection 71*f* as depicted in FIG. 37, that is, while placing the projection 71*f* on the side opposite to the side depicted in FIG. 36, the projection 71*f* interferes, preventing the connector 71 from being inversely engaged.

With the provision of the above described structure, it is assured that desirable electrical connection is established between the two connectors as the process cartridge B is pivoted about the axial line of the photosensitive drum 1 to be installed in the image forming apparatus main assembly 14.

Further, according to the above structure, the process cartridge side connector 71 is placed on the side plate 11*k* of the waste toner container 11*a,* and therefore, the waste toner capacity of the waste toner container 11*a* is not reduced.

Further, the grounding terminal 73*a* is placed closest to the pivotal axis of the process cartridge B among the group of terminals 73, causing the grounding terminal 73*a* to be engaged with its counterpart before the others, and therefore, it is assured that the memory IC or the like is protected.

Further, the connector 71 is covered with the side cover 11*f* after it is attached to the side plate 11*k* of the waste toner container 11*a*. Therefore, the memory IC or the like is protected since the cover 11*f* prevents the user from accidentally coming in contact with the memory IC or the like.

Further, in order to engage the connector 71 in the connector insertion hole 71*b* of the connector mount 11*w*, the connector 71 must be correctly oriented to prevent the projection 71*f* provided on the connector 71 from interfering with the rib 71*e* provided in the connector insertion hole 71*b* of the connector mount 11*w*, and therefore, the connector 71 is prevented from being erroneously engaged.

The process cartridge described in the foregoing comprises:

an electrophotographic photosensitive drum 1;

a charging roller 2*c*, contacted to said electrophotographic photosensitive drum 1, for charging said electrophotographic photosensitive drum, wherein said charging roller 2*c* is covered by a cartridge frame (e.g. charger cover) 11*g* projected from a surface which takes an upper position when said process cartridge is mounted to the main assembly of said apparatus;

a cleaning member (e.g. cleaning roller 27 and/or cleaning blade 28) for removing toner remaining on said electrophotographic photosensitive drum 1;

a toner accommodating portion 11B for accommodating toner removed from said electrophotographic photosensitive drum 1 by said cleaning member 27, 28;

a rotatable member (e.g. shaft coupling member) 23, provided at the other longitudinal end side of said electrophotographic photosensitive drum and coaxial with said electrophotographic photosensitive drum, for receiving driving force for rotating said electrophotographic photosensitive drum from the main assembly when said process cartridge is mounted to the main assembly, wherein said electrophotographic photosensitive drum is rotated by rotation of said rotatable member 23 by the driving force from the main assembly;

a memory element (e.g. memory device) 142 for storing an integrated charging time of said charging roller and an integrated number of rotations of said electrophotographic photosensitive drum;

a grounding contact 61, provided coaxially with said electrophotographic photosensitive drum at one longitudinal end side of said electrophotographic photosensitive drum, for electrically grounding said electrophotographic photosensitive drum to the main assembly, when said process cartridge is mounted to the main assembly;

a charging bias contact 63*a*, provided at the other longitudinal end side of said electrophotographic photosensitive drum and on a substantially top surface 11*g*1 of the projected cartridge frame, for receiving a charging bias applied to said charging roller from the main assembly when said process cartridge is mounted to the main assembly;

a connector 71 having a connecting contacts, at one longitudinal end side of said electrophotographic photosensitive drum, for electrical connection with the main assembly to transmit information stored in said memory element 142 when said process cartridge is mounted to the main assembly, wherein said connector 71 is disposed on a lower portion and faced downwardly when said process cartridge is mounted to the main assembly, wherein said connector 71 is disposed at a longitudinal end side of said toner accommodating portion 11B and outside said toner accommodating portion.

The process cartridge described in the foregoing comprises:

a cartridge frame 11;

an electrophotographic photosensitive drum 1;

a charging roller 2*c*, contacted to said electrophotographic photosensitive drum, for charging said electrophotographic photosensitive drum;

a cleaning member (e.g. cleaning roller 27 and/or cleaning blade 28) for removing toner remaining on said electrophotographic photosensitive drum 1;

a toner accommodating portion 11B for accommodating toner removed from said electrophotographic photosensitive drum by said cleaning member 27, 28;

a memory element (e.g. meaning device) 142 for storing an integrated charging time of said charging roller 2*c* and an integrated number of rotations of said electrophotographic photosensitive drum 1;

a positioning portion (e.g. boss) 11*h*, coaxial with said electrophotographic photosensitive drum 1 and projected from said cartridge frame 11 at each of longitudinal end portion of said electrophotographic photosensitive drum, for engagement with a positioning member (e.g. U-groove) 52 provided in the main assembly to correctly position said process cartridge when said process cartridge B is mounted to a mounting position of the main assembly 14;

a grounding contact 61, provided coaxially with said electrophotographic photosensitive drum 1 at one longitudinal end side of said electrophotographic photosensitive drum, for electrically grounding said electrophotographic photosensitive drum 1 to the main assembly 14, when said process cartridge B is mounted to the main assembly 14;

a connector 71 including a plurality of connecting contacts 73, arranged along a line substantially perpendicular to a longitudinal direction of said electrophotographic photosensitive drum 1 at one longitudinal end side of said photosensitive drum, for electrical connection with the main assembly 14 to transmit to the main assembly information stored in said memory element 142 when said process cartridge B is mounted to the main assembly 14, wherein a connecting contacts 73*a* of the plurality of connecting contacts 73 which closest to said electrophotographic photosensitive drum is a contact for electrically grounding a substrate of said memory element, said grounding contact 73*a* being projected outwardly beyond the other contact, wherein said connector is disposed on an outside of said toner accommodating portion 11B at a longitudinal end side of said toner accommodating portion, and when said process cartridge is mounted to the main assembly 14, said connector 71 takes a lower position while facing downward; and wherein said process cartridge is mounted to the main assembly by rotating it downwardly about said positioning portion 11*h*; when said process cartridge B is rotated downwardly, said ground contact 73*a* is brought into contact to a corresponding contact 72*a* of the main assembly sooner than another contact 73 of said connector is brought into contact to a corresponding contact 72 of the main assembly In this embodiment, the grounding contact 73*a* is projected beyond the other contact 73 by approx. 1.0–2.0 mm (L1).

Color Density Adjustment Apparatus

According to the present invention, the density and tone of each primary color of an image formed on recording medium are adjusted by the engine controller 131. More specifically, a test pattern is developed on the photosensitive drum 1 for each primary color, and the density of each test pattern is detected Then, the detected density is used by the engine controller 131 for the adjustment.

Figure 40:
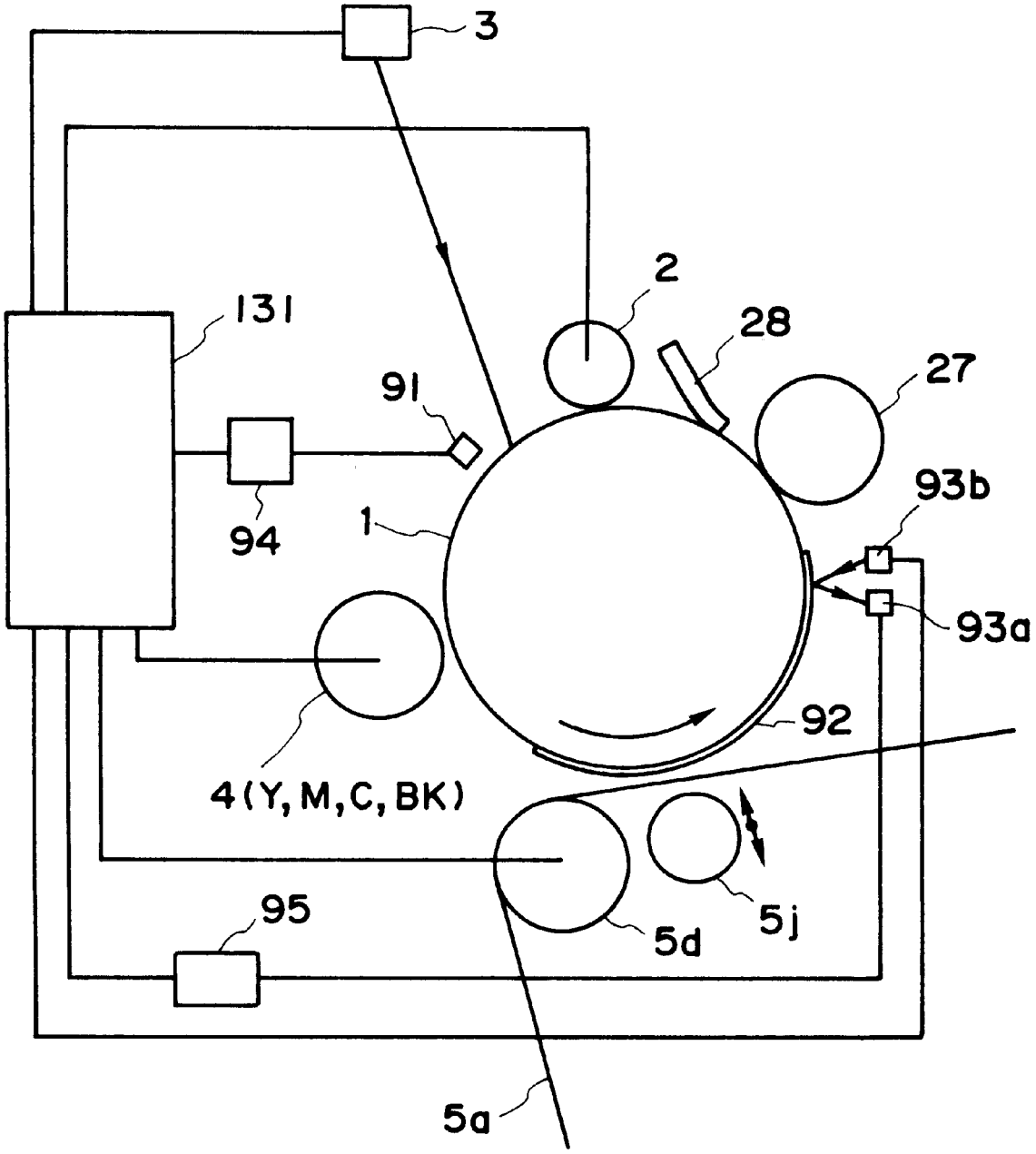
FIG. 40 is a schematic drawing which depicts the test pattern reader system of an image forming apparatus in accordance with the present invention.

Referring to FIG. 40, a surface potential detector 91 which detects the surface potential of the photosensitive drum 1 after primary charging is connected to the engine controller 131 through a surface potential detector 94 (potentiometer). A reference numeral 93 designates a pattern reader 93 which reads a test pattern 92, that is, a toner image, formed on the photosensitive drum 1 using one of the developing devices 4Y, 4M, 4C and 4Bk. The pattern reader 93 comprises a reading sensor 93*a* and a lamp 93*b*. The reading sensor 93*a* is a light receptor such as a CCD. The lamp 93*b* projects light which is reflected by the test pattern 92 and is received by the receptor 93*a*. The test pattern 92 read by the reading sensor 93*a* is converted into density signals through a density conversion circuit 95, and the density signals are inputted into the engine controller 131.

The detected toner density is processed by the engine controller 131 to be used for controlling the image forming means, more specifically, for controlling the potential level, the LUT toner density, the transfer current level, and the like.

Referring to FIG. 12 which is a perspective view of an inversely placed process cartridge, the aforementioned pattern reader 93 is positioned to face a rectangular opening 11*x* through which the photosensitive drum 1 is exposed. The opening 11*x* is cut in a wall portion 11*y* which descends (ascends in FIG. 12) toward the photosensitive drum 1 from the portion on which the squeegee sheet 29 is glued to the waste toner container 11*a*.

Figure 47:
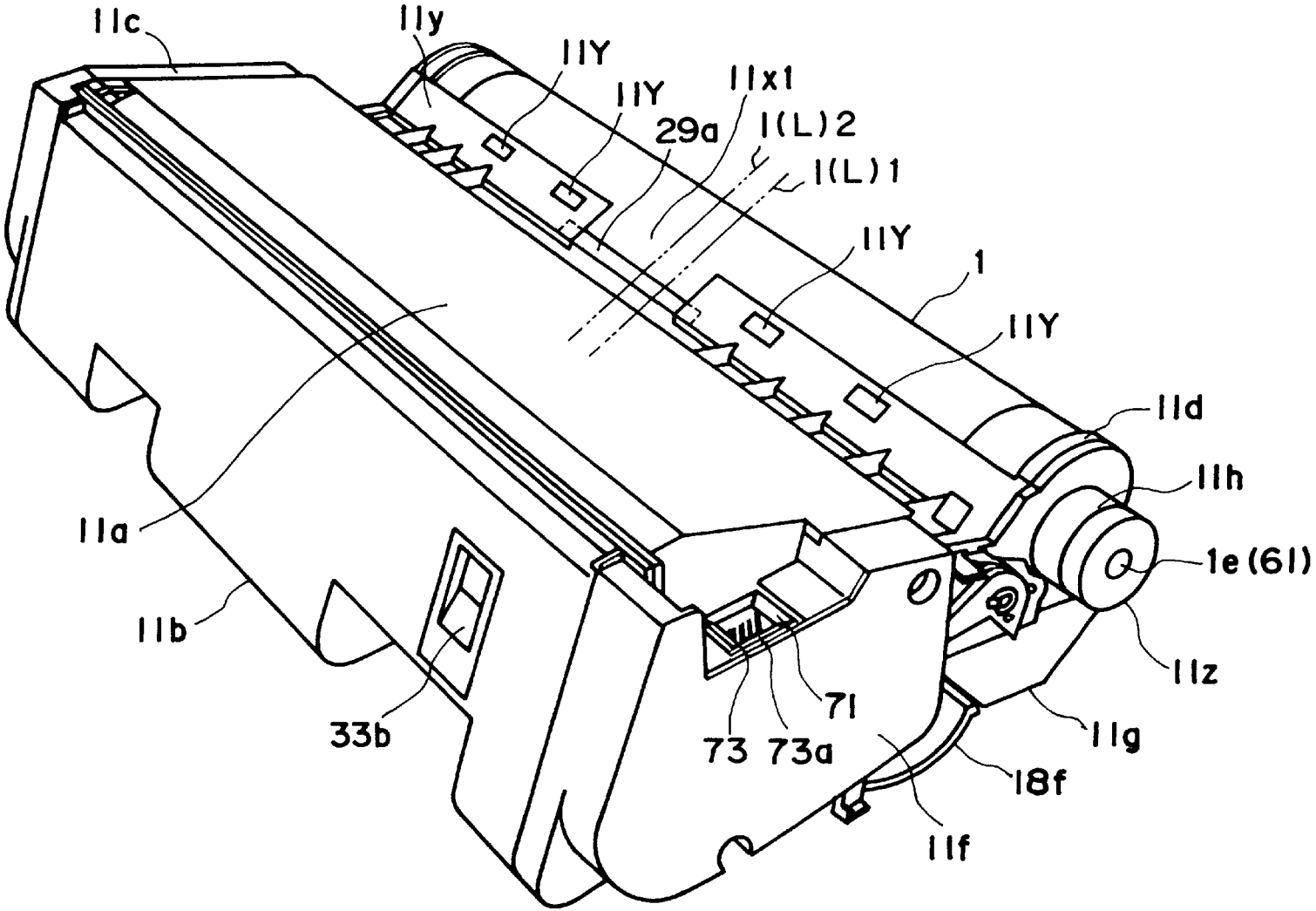
FIG. 47 is a perspective view of a modified version of the process cartridge illustrated in FIG. 12.

FIG. 47 depicts an example of a cartridge frame in which instead of a rectangular opening, a recess 11*x*1 is cut as the exposure region.

Figure 41:
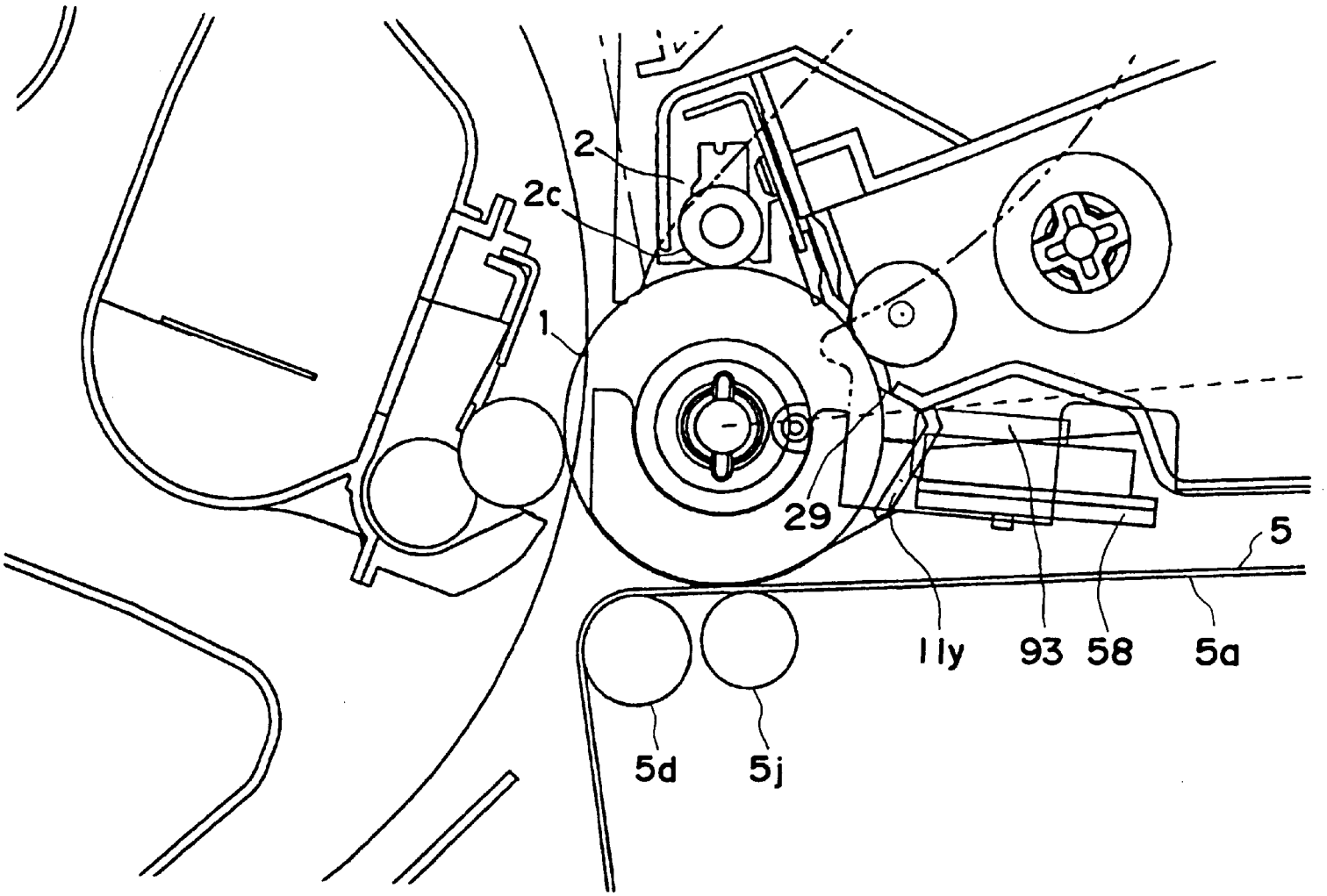
FIG. 41 is a side elevation of the test pattern reader and the adjacencies thereof.

FIG. 41 is a vertical section of a portion of the image forming apparatus A, inclusive of the pattern reader 92 and the adjacencies thereof.

As illustrated in FIG. 41, the pattern reader 93 is fixed to the bottom plate 58 of the cartridge guide 50 which can be pushed into, or pulled out of, the apparatus main assembly 14 in the direction of an arrow mark in the drawing.

The lamp of the pattern reader 93 of the lamp 93*b* projects light toward the photosensitive drum 1. The reading sensor 93*a* is located at a position at which it can receive the light which is projected from the lamp 93*a* and reflected by the peripheral surface of the photosensitive drum 1. The light from the lamp 93*b* and its reflection on the peripheral surface of the photosensitive drum 1 go through the same opening 11*x*. The opening 11*x* is located on the upstream side relative to the rotational direction of the photosensitive drum 1.

The test pattern 92 is a toner image formed by any one of the developing devices 4Y, 4M, 4C and 4Bk, on the photosensitive drum 1 uniformly charged by the charging device 2, in the same manner as a toner image of a target image is formed, but when the test pattern toner image passes the region in which the photosensitive drum 1 opposes the transfer unit 5, the pressing roller 5*j* retracts from the photosensitive drum 1 so that the intermediary transfer belt 5*a* forms a flat surface between the driver roller 5*b* and the follower roller 5*d*, providing a small gap between the transfer belt 5*a* and the photosensitive drum 1. The test pattern 92 passes through this gap, is read by the pattern reader 93, passes between the photosensitive drum 1 and the squeegee sheet 29, and then, is removed from the photosensitive drum 1 by the cleaning roller 27 and the cleaning blade 28. Instead of causing the pressing roller 5*j* to retract, voltage having the same polarity as the toner of the test pattern 92 may be applied to the follower roller 5*d* so that the test pattern passes through the transfer station.

Because the opening 11*x* for color density detection is located on the immediately upstream side of the squeegee sheet 29 as described above, the presence of the test pattern reader 93 does not interfere with the charging device 2 (charge roller 2*c*), the developing device 4, and the transfer unit 5, in terms of their movements relative to the photosensitive drum 1; neither does it interfere with the positioning of the exposure window.

Further, because the opening 11*x* for detecting the color density of a toner image is located at a position which corresponds to the substantial middle point of the photosensitive drum 1 in the lengthwise direction, average color density can be detected.

A referential FIG. 11*y* designates an opening for a jig. When the squeegee sheet 29 is glued to the cartridge frame 11, a jig is engaged in the opening 11*y* to flex the cartridge frame 11 away from the photosensitive drum 1 so that the squeegee sheet 29 can be glued to the cartridge frame 11 without creating loose spots.

The process cartridge described in the foregoing comprises:

cartridge frame 11;

electrophotographic photosensitive drum 1;

a driving force receptor portion 23 for receiving driving force for rotating said electrophotographic photosensitive drum 1 from the main assembly 14 when said process cartridge B is mounted to the main assembly, wherein said driving force receptor portion 23 is provided at one longitudinal end of said electrophotographic photosensitive drum;

a charging member (e.g. charging roller) 2*c* for charging said electrophotographic photosensitive drum 1;

a cleaning member (e.g. cleaning roller 27 and/or cleaning blade 28) for removing toner deposited on said electrophotographic photosensitive drum 1;

a toner accommodating portion 11B for accommodating the toner removed from said electrophotographic photosensitive drum 1 by said cleaning member 27, 28;

a first flexible sheet (e.g. receptor sheet) 21 contacted to said electrophotographic photosensitive drum 1 in a longitudinal direction of said electrophotographic photosensitive drum 1 to direct to said toner accommodating portion 11B the toner removed from said electrophotographic photosensitive drum 1 by said cleaning member 27, 28, wherein said first flexible sheet 21 is contacted to said electrophotographic photosensitive drum so as to pass the toner deposited on said electrophotographic photosensitive drum;

a cut-away portion 11*x*1, provided in a cartridge frame 11, for exposing a part of said electrophotographic photosensitive drum to permit, when said process cartridge B is mounted to the main assembly 14 of said apparatus, detecting means (e.g. lamp and photodetector) 93*a*, 93*b* provided in the main assembly to detect a density of a toner image formed on said electrophotographic photosensitive drum, to project light emitted from the detecting means (lamp) 93*b* to a toner image formed on said electrophotographic photosensitive drum, and to direct the light reflected by the toner image to the detecting means 93*a*, wherein said cut-away portion 11*x*1 (FIG. 47) is formed in such a portion of the cartridge frame as takes a bottom position when said process cartridge B is mounted to the main assembly and is extended in a longitudinal direction of said electrophotographic photosensitive drum 1, and said cut-away portion is disposed upstream of a position where said first flexible sheet is provided in a rotational direction of said electrophotographic photosensitive drum;

a second flexible sheet 29*a* mounted to said cartridge frame along said cut-away portion 11*x*1.

The second flexible sheet 29*a* receives the toner leaked from the cut-away portion 11*x*1. By doing so, the toner is prevented from centering toward the detection element 93*a* and 93*b*. The longitudinal center 12 of the cut-away portion is deviated toward the driving force receiving portion 23 from the longitudinal center 11 of the photosensitive drum 1. The light from the lamp 93*b* is projected substantially on the longitudinal center 11 of the photosensitive drum 1. The center 12 of the cut-away portion 11*x*1 functions properly because the detection elements 93*a* and 93*b* are faced to the cut-away portion 11*x*1. The above described bottom portion of the cartridge frame 11 is provided with a recess 11*a*3 extended along the length of the drum 1. From a short side end of the recess 11*a*3, a wall 11*y* extends downwardly around the drum 1. The cut-away portion 11*x*1 is formed in a part of the downward wall 11*y* in the longitudinal direction. The detection members 93*a* and 93*b* are disposed in the recess 11*a*3.

The first and second flexible sheets are of plastic material and have surfaces which are roughened, so that reflection of the light from the lamp 93*b* by the second flexible sheet can be prevented.

Drum Shutter Structure

When the process cartridge B is out of the apparatus main assembly 14, a drum shutter 18 covers the peripheral surface of the photosensitive drum 1 to prevent the photosensitive drum 1, in particular, its photosensitive layer, from being damaged due to the handling of the process cartridge B, and to prevent the photosensitive layer from deteriorating due to exposure to external light. As the process cartridge B is in the apparatus main assembly 14, it retracts so that the peripheral surface of the photosensitive drum 1 is exposed to the developing device 4 and the transfer unit 5.

Figure 5:
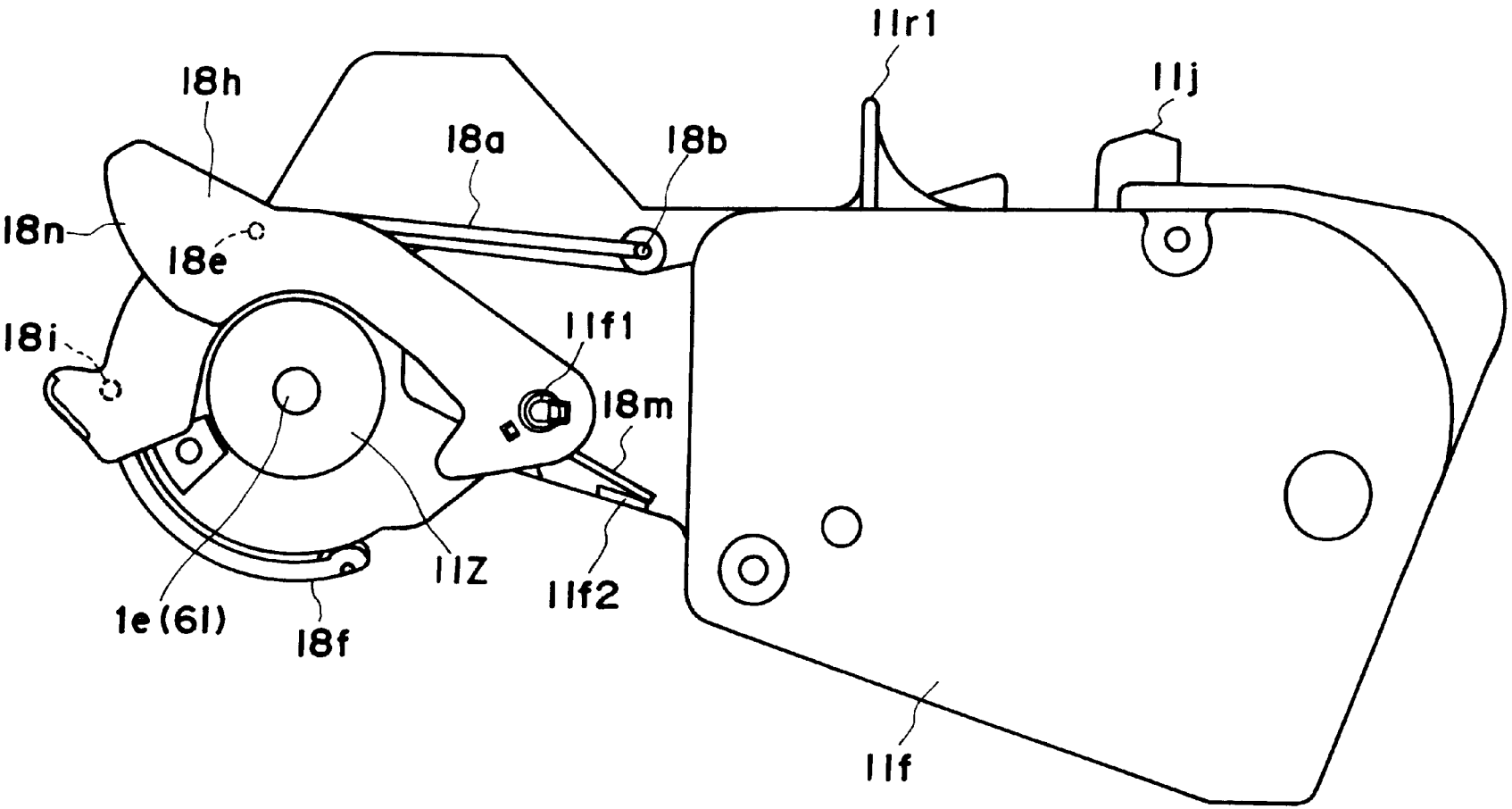
FIG. 5 is a left-hand side view of the process cartridge illustrated in FIG. 3.

FIGS. 4 and 5 are side views of the driven and non-driven sides, respectively, of the process cartridge B. On each of the driven and non-driven sides, a base shaft 18*b* integral with an arm 18*a* is fitted in a hole of the gear cover 1*c* or the side cover 11*f*. The end of the arm 18*a*, that is, the end opposite to the base shaft 18*b*, is integral with a shaft 18*c*, which extends to the opposite side where it is integral with the corresponding end of the arm 18*a* on this side. A first shutter cover 18*d* of the drum shutter 18 is rotatively mounted on this shaft 18*c*, and is coupled with a second shutter cover 18*f* of the drum shutter, with the use of a pin shaft 18*e*. As seen from the lengthwise end, when the drum shutter is closed, the first and second shutter covers 18*d* and 18*f* form together an arc having a radius larger than the photosensitive drum 1, and cover together the peripheral surface of the photosensitive drum 1 as well as the outward side of the drum supporting portion 11*d*, on both lengthwise ends. The bottom edge 11*d*1 of the drum supporting portion lid forms an arc whose center coincides with the center of the photosensitive drum 1, and the front edge of the drum supporting portion 11*d* is straight. The second shutter cover 18*f* is provided with an arc-shaped shoe 18*g*, which is integrally formed with the second shutter cover 18*f* and fits the bottom edge 11*d*1 and the periphery of the lengthwise end of the photosensitive drum 1. On the non-driven side, an operational arm 18*h* is fitted around a shaft 11*f*1 integrally formed with the side cover 11*f*. The operational arm 18*h* is connected to the base side of the second shutter cover 18*f*, with the use of a shaft 18*i* which is coaxial with the shaft 18*e*.

Referring to FIG. 11 which is a perspective view of the process cartridge B as seen from the right rear, each pin shaft 18*e* is fitted with a torsion coil spring 18*j*, one end of which presses on the outward surface of the first shutter cover 18*d*, and the other end of which presses on the outward surface of the second shutter cover 18*f*. Therefore, the first and second shutter covers 18*d* and 18*f* are kept under constant pressure capable of rotating them about the pin shaft 18*e* in the direction to cause their inward surfaces to close onto each other.

Referring to FIG. 5, the operational arm 18*h* is provided with a boss (not visible in the drawing), which is located on the base portion of the operational arm 18*h*, and around which a torsional coil spring 18*j* is fitted. One end of the coil spring 18*j* is anchored to a spring seat 11*f*2 integrally formed with the side cover 11*f*, and the other end is anchored to the operational arm 18*h*. In FIG. 5 which shows the non-driven side of the process cartridge B, the operational arm 18*h* is under such pressure that is directed to rotate the operational arm 18*h* about the axle 11*f*1. The operational 18*h* is provided with a cam portion 18*n*, which comes in contact with a stopper on the apparatus main assembly side as the process cartridge B placed in the cartridge guide 50 is advanced into the apparatus main assembly 14.

After the occurrence of the contact between the cam portion 18*n* of the operational arm 18*h* and the stopper on the apparatus main assembly side, the process cartridge B is pushed farther into the apparatus main assembly 14 to be properly positioned. As the process cartridge B is pushed, the operational arm 18*h* is caused to rotate upward against the elastic force of the torsional coil spring 18*m* about the shaft 11*f*1 because the forward movement of the operational arm 18*h* is blocked by the stopper. As a result, the shafts 18*i* and 18*e* are moved upward.

As the shafts 18*i* and 18*e* are moved upward, the first and second shutter covers 18*d* and 18*f* are pulled upward. Consequently, the base side end of the first shutter cover 18*d* moves upward, following the same arc-like locus as the shaft 18*c*, which rotates upward about the base side shaft 18*b*, follows; the second shutter cover side end of the first shutter cover 18*d*, and the base side end of the second shutter cover 18*f*, move upward, following the same arc-like locus as the shafts 18*i* and 18*e*, which are moved upward in a manner of rotating about the shaft 11*f*1 by the upward rotational movement of the operational arm 18*a*, follow; and the shoe 18*g* of the second shutter cover 18*f*, which is located on the side opposite to the first shutter cover 18*d*, follows the bottom edge 11*d*1 of the drum support portion 11*d* and the periphery of the lengthwise end of the photosensitive drum 1, in contact with them. Meanwhile, the first and second shutter portions 18*d* and 18*f* move upward while remaining close to the peripheral surface of the photosensitive drum 1, the edge of the drum support portion, and the top portion of the cartridge frame due to the elastic force of the torsional coil spring 18*j*. As a result, the drum shutter 18 exposes the photosensitive drum 1, and retracts behind the charging device cover 11*g* as illustrated in FIG. 11 which is a perspective view of the process cartridge B as seen from the right rear.

As described above, according to the present invention, the arm 18*a*, the operational arm 18*h*, the first shutter cover

18*d,* and the waste toner container 11*a* to which the gear cover 11*c* and the side cover 11*f* have been attached, constitute a four joint linkage mechanism, wherein the first and second shutter covers 18*d* and 18*f* are kept under the pressure generated by the torsional coil spring in the direction to cause the two shutter covers to rotate about the shaft 18*i* (18*e*), which connects the two shutter covers, in a manner of causing their inward surfaces to fold onto each other Therefore, even while the first and second shutter covers 18*d* and 18*f* are moved enough to expose more than half the peripheral surface of the photosensitive drum 1, their loci remain close to the peripheral surface of the photosensitive drum 1; in other words, they do not affect the positioning of the developing device 4, the transfer unit 5, and the like, provided on the apparatus main assembly side. Further, they remain close to the top surface of the waste toner container 11*a* after their retraction.

According to the present invention, the driving force can be assuredly received from the main assembly of the apparatus when the process cartridge is mounted to the main assembly of the apparatus.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, comprising:

a cartridge frame;

an electrophotographic photosensitive drum;

a cleaning member for removing toner remaining on said electrophotographic photosensitive drum;

a transporting member for transporting the toner removed from said electrophotographic photosensitive drum by said cleaning member;

a positioning portion for positioning said process cartridge when said process cartridge is mounted to a mounting position of the main assembly of said apparatus, said positioning portion being engageable with a main assembly positioning member provided in the main assembly of said apparatus, and is projected from said cartridge frame coaxially with said electrophotographic photosensitive drum at one longitudinal end side of said electrophotographic photosensitive drum;

a drum driving force receiving member for receiving driving force for rotating said electrophotographic photosensitive drum from the main assembly when said process cartridge is mounted to the mounting position of the main assembly, said drum driving force receiving member being juxtaposed with said positioning member coaxially with said electrophotographic photosensitive drum and is projected outwardly beyond said positioning member;

a transporting member driving force receiving member for receiving driving force for rotating said toner transporting member from the main assembly when said process cartridge is mounted to the mounting position of the main assembly, wherein said transporting member driving force receiving member is disposed at the same cartridge frame side as a side where said drum driving force receiving member is disposed in a longitudinal direction of said electrophotographic photosensitive drum.

2. A process cartridge according to claim 1, wherein said positioning portion is circular in shape, and said drum driving force receiving member is a rotatable member provided coaxially with said electrophotographic photosensitive drum, said rotatable member having a hole at a position away from its center, and said hole being engaged with a driving force transmission member of the main assembly when the driving force for rotating the electrophotographic photosensitive drum is received when said process cartridge is mounted to the mounting position of the main assembly.

3. A process cartridge according to claim 1, wherein said drum driving force receiving member is a circular member and includes a shaft at the center of the circular member, a disk coaxial with said electrophotographic photosensitive drum and a hole formed in an outer periphery portion of the disk, wherein when the driving force for rotating said electrophotographic photosensitive drum is received from the main assembly when said process cartridge is mounted to the mounting position of the main assembly, the hole is engaged with a driving force transmission member of the main assembly.

4. A process cartridge according to claim 3, wherein the disk is integrally molded from resin material.

5. A process cartridge according to claim 1, 2, 3 or 4, wherein said transporting member driving force receiving member is engaged with an engageable member of the main assembly having two or four fingers, when the driving force for rotating said toner transporting member is received from the main assembly when said process cartridge is mounted to the mounting position of the main assembly.

6. A process cartridge according to claim 5, wherein said transporting member driving force receiving member includes a rotatable member of resin material having a plurality of plate-like members arranged in its radial direction.

7. A process cartridge according to claim 5, wherein said transporting member driving force receiving member is projected outwardly beyond said drum driving force receiving member from said cartridge frame.

8. A process cartridge according to claim 5, wherein said positioning portion is integrally formed with said cartridge frame.

9. A process cartridge according to claim 5, wherein said transporting member driving force receiving member is enclosed with a circular portion at its end portion, wherein said circular portion is projected outwardly from said cartridge frame, and said circular portion is integrally molded with said cartridge frame.

10. A process cartridge according to claim 1, wherein said process cartridge is mounted to the main assembly of said apparatus in a direction crossing with said electrophotographic photosensitive drum, and wherein said transporting member driving force receiving member is disposed upstream of said drum driving force receiving member in a mounting direction of said process cartridge.

11. A process cartridge according to claim 1, wherein a diameter of a rotatable member of said drum driving force receiving member is larger than a diameter of a rotatable member of said transporting member driving force receiving member.

12. A process cartridge according to claim 1, further comprising a charging member for charging said electrophotographic photosensitive drum.

13. An electrophotographic image forming apparatus for forming an image on a recording material, to which a process cartridge is detachably mountable, comprising:

a. a mounting portion for detachably mounting a process cartridge, which includes:

a cartridge frame;

an electrophotographic photosensitive drum a cleaning member for removing toner remaining on said electrophotographic photosensitive drum;

a toner transporting member for transporting the toner removed from said electrophotographic photosensitive drum by said cleaning member;

a positioning portion for positioning said process cartridge when said process cartridge is mounted to a mounting position of the main assembly of said apparatus, said positioning portion being engageable with a main assembly positioning member provided in the main assembly of said apparatus, and is projected from said cartridge frame coaxially with said electrophotographic photosensitive drum at one longitudinal end side of said electrophotographic photosensitive drum;

a drum driving force receiving member for receiving driving force for rotating said electrophotographic photosensitive drum from the main assembly when said process cartridge is mounted to the mounting position of the main assembly, said drum driving force receiving member being juxtaposed with said positioning member coaxially with said electrophotographic photosensitive drum and is projected outwardly beyond said positioning member;

a transporting member driving force receiving member for receiving driving force for rotating said toner transporting member from the main assembly when said process cartridge is mounted to the mounting position of the main assembly, wherein said transporting member driving force receiving member is disposed at the same cartridge frame side as a side where said drum driving force receiving member is disposed in a longitudinal direction of said electrophotographic photosensitive drum;

said apparatus further comprising:

b. a drum driving force transmission member for transmitting driving force to said drum driving force receiving member of said process cartridge mounted to said mounting position in a longitudinal direction of said electrophotographic photosensitive drum;

c. a transporting member driving force transmission member for transmitting driving force to said transporting member driving force receiving member of said process cartridge to said mounting position in a longitudinal direction of said electrophotographic photosensitive drum;

d. a transporting member for transporting the recording material.

14. An apparatus according to claim 13, wherein said transporting member driving force transmission member has an engageable member having two fingers.

15. A driving force transmitting method for transmitting driving force from a main assembly of an electrophotographic image forming apparatus to a process cartridge, which cartridge includes:

an electrophotographic photosensitive drum;

a cleaning member for removing toner remaining on said electrophotographic photosensitive drum;

a toner transporting member for transporting the toner removed from said electrophotographic photosensitive drum by said cleaning member;

a positioning member for positioning said process cartridge when said process cartridge is mounted to a mounting position of the main assembly of said apparatus, said positioning member being engageable with a main assembly positioning member provided in the main assembly of said apparatus, and is projected from said cartridge frame coaxially with said electrophotographic photosensitive drum at one longitudinal end side of said electrophotographic photosensitive drum;

a drum driving force receiving member for receiving driving force for rotating said electrophotographic photosensitive drum from the main assembly when said process cartridge is mounted to the mounting position of the main assembly, said drum driving force receiving member being opposed to said positioning member coaxially with said electrophotographic photosensitive drum and is projected outwardly beyond said positioning member;

a transporting member driving force receiving member for receiving driving force for rotating said toner transporting member from the main assembly when said process cartridge is mounted to the mounting position of the main assembly;

wherein the driving force is transmitted to said drum driving force receiving member by a driving force transmission member provided in the main assembly of said apparatus, and the driving force is transmitted to said transporting member driving force receiving member by an engageable member provided in the main assembly of said apparatus and having two fingers.

16. A process cartridge detachably mountable to a main assembly of an electrophotographic image forming apparatus, comprising:

a cartridge frame;

an electrophotographic photosensitive drum;

a charging member for charging said electrophotographic photosensitive drum;

a cleaning member for removing toner deposited on said electrophotographic photosensitive drum;

a toner transporting member for transporting the toner removed from said electrophotographic photosensitive drum by said cleaning member away from said electrophotographic photosensitive drum;

a first positioning portion for positioning said process cartridge when said process cartridge is mounted to a mounting position of the main assembly, said first positioning portion being engageable with a main assembly positioning member provided in the main assembly of said apparatus, and is projected outwardly from said cartridge frame coaxially with said electrophotographic photosensitive drum at one longitudinal end side of said electrophotographic photosensitive drum, wherein said first positioning portion is integrally molded with said cartridge frame;

a second positioning portion for positioning said process cartridge when said process cartridge is mounted to the mounting position of the main assembly, said second positioning portion being engageable with a main assembly positioning member provided in the main assembly of said apparatus, and is projected outwardly from said cartridge frame coaxially with said electrophotographic photosensitive drum at the other longitudinal end side of said electrophotographic photosensitive drum, wherein said second positioning portion is integrally molded with said cartridge frame;

a drum driving force receiving member for receiving driving force for rotating said electrophotographic photosensitive drum from the main assembly when said process cartridge is mounted to the mounting position of the main assembly, said drum driving force receiving member being juxtaposed with said first positioning portion coaxially with said electrophotographic photosensitive drum and is projected outwardly beyond said first positioning portion;

a toner transporting member driving force receiving member for receiving driving force for rotating said toner transporting member from the main assembly of said apparatus when said process cartridge is mounted to the mounting position of the main assembly, wherein said toner transporting member driving force receiving member is disposed at the same cartridge frame side as a side where said drum driving force receiving member is disposed in a longitudinal direction of said electrophotographic photosensitive drum;

a circular portion projected from said cartridge frame along a circumference of an end portion of said toner transporting member driving force receiving member, wherein said circular portion is integrally molded with said cartridge frame;

wherein said drum driving force receiving member is projected outwardly from said cartridge frame beyond said first positioning portion, wherein said drum driving force receiving member is disposed upstream of said toner transporting member driving force receiving member in a direction of mounting of said process cartridge to the main assembly, and wherein said process cartridge is mounted to the main assembly in a direction crossing with the longitudinal direction of said electrophotographic photosensitive drum.

17. A process cartridge according to claim 16, wherein said drum driving force receiving member is a circular member and includes a shaft at the center of the circular member, a disk coaxial with said electrophotographic photosensitive drum and a hole formed in an outer periphery portion of the disk, wherein when the driving force for rotating said electrophotographic photosensitive drum is received from the main assembly when said process cartridge is mounted to the mounting position of the main assembly, the hole is engaged with a driving force transmission member of the main assembly.

18. A process cartridge according to claim 17, wherein the disk is integrally molded from resin material.

19. A process cartridge according to claim 17 or 18, wherein said transporting member driving force receiving member is engaged with an engageable member of the main assembly having two or four fingers, when the driving force for rotating said toner transporting member is received from the main assembly when said process cartridge is mounted to the mounting position of the main assembly.

20. A process cartridge according to claim 19, wherein said transporting member driving force receiving member includes a rotatable member of resin material having a plurality of plate-like members arranged in its radial direction.

21. A process cartridge according to claim 16, wherein a diameter of a rotatable member of said drum driving force receiving member is larger than a diameter of a rotatable member of said transporting member driving force receiving member.

22. An electrophotographic image forming apparatus for forming an image on a recording material, to which a process cartridge is detachably mountable, comprising:

a. a mounting member for mounting the process cartridge, which includes:

a cartridge frame;

an electrophotographic photosensitive drum;

a charging member for charging said electrophotographic photosensitive drum;

a cleaning member for removing toner deposited on said electrophotographic photosensitive drum;

a toner transporting member for transporting the toner removed from said electrophotographic photosensitive drum by said cleaning member away from said electrophotographic photosensitive drum;

a first positioning portion for positioning said process cartridge when said process cartridge is mounted to a mounting position of the main assembly of said apparatus, said first positioning portion being engageable with a main assembly positioning member provided in the main assembly of said apparatus, and is projected outwardly from said cartridge frame coaxially with said electrophotographic photosensitive drum at one longitudinal end side of said electrophotographic photosensitive drum, wherein said first positioning portion is integrally molded with said cartridge frame;

a second positioning portion for positioning said process cartridge when said process cartridge is mounted to the mounting position of the main assembly of said apparatus, said second positioning portion being engageable with a main assembly positioning member provided in the main assembly of said apparatus, and is projected outwardly from said cartridge frame coaxially with said electrophotographic photosensitive drum at the other longitudinal end side of said electrophotographic photosensitive drum, wherein said second positioning portion is integrally molded with said cartridge frame;

a drum driving force receiving member for receiving driving force for rotating said electrophotographic photosensitive drum from the main assembly when said process cartridge is mounted to the mounting position of the main assembly, said drum driving force receiving member being juxtaposed with said first positioning portion coaxially with said electrophotographic photosensitive drum and is projected outwardly beyond said first positioning portion;

a toner transporting member driving force receiving member for receiving driving force for rotating said toner transporting member from the main assembly of said apparatus when said process cartridge is mounted to the mounting position of the main assembly, wherein said toner transporting member driving force receiving member is disposed at the same cartridge frame side as a side where said drum driving force receiving member is disposed in a longitudinal direction of said electrophotographic photosensitive drum;

a circular portion projected from said cartridge frame along a circumference of an end portion of said toner transporting member driving force receiving member, wherein said circular portion is integrally molded with said cartridge frame;

wherein said drum driving force receiving member is projected outwardly from said cartridge frame beyond said first positioning portion, wherein said drum driving force receiving member is disposed upstream of said toner transporting member driving force receiving member in a direction of mounting of said process cartridge to the main assembly, and wherein said process cartridge is mounted to the main assembly in a direction crossing with the longitudinal direction of said electrophotographic photosensitive drum;

said apparatus further comprising:

b. a drum driving force transmission member for transmitting driving force to said drum driving force receiving member of said process cartridge mounted to the mounting position in a longitudinal direction of said electrophotographic photosensitive drum c. a toner transporting member driving force transmission member for transmitting driving force to said toner transporting member driving force receiving member of said process cartridge mounted to said mounting position in the longitudinal direction of said electrophotographic photosensitive drum; and d. a transporting member for transporting the recording material.

23. A process cartridge according to claim 22, wherein said transporting member driving force transmission member has an engageable member having two fingers.

* * * * *

UNITED STATES PATENT AND TRADEMARK OFFICE

CERTIFICATE OF CORRECTION

PATENT NO. : 6,061,538
DATED : May 9, 2000
INVENTOR(S) : Takeshi Arimitsu et al.

It is certified that error appears in the above-identified patent and that said Letters Patent is hereby corrected as shown below:

Drawings,
Sheet 33, FIG. 39, "CALENDER" should read -- CALENDAR --, and "FORMATER" should read -- FORMATTER --.

Column 2,
Line 2, "rotation" should read -- rotate --.
Line 41, "is." should read -- is --.

Column 6,
Line 18, "mechanism" should read -- mechanism. --.
Line 23, "coated" should read -- coated. --.

Column 7,
Line 44, "roller 86," should read -- roller 8b, --.
Line 62, "position At" should read -- position. At --.

Column 9,
Line 19, "device 6" should read -- device 6. --.

Column 11,
Line 15, "arrow d" should read -- arrow α --.

Column 14,
Line 37, "member 14e" should read -- member 14c --.

Column 17,
Line 40, "direction;" should read -- direction, --.

Column 18,
Line 53, "from they are" should read -- they are from --.

Column 20,
Line 13, "driving gear" should read -- driving gears --.

Column 21,
Line 67, "waster" should read -- waste --.

Column 23,
Line 16, "storage 11B2" should read -- storage portion $11B_2$ --.
Line 60, "played" should read -- played. --.

UNITED STATES PATENT AND TRADEMARK OFFICE

CERTIFICATE OF CORRECTION

PATENT NO. : 6,061,538
DATED : May 9, 2000
INVENTOR(S) : Takeshi Arimitsu et al.

It is certified that error appears in the above-identified patent and that said Letters Patent is hereby corrected as shown below:

Column 25,
Line 27, "driving gear 38d," should read -- driving gear 31d, --.

Column 27,
Line 6, "drive input means" should be deleted.
Line 12, "drum" (second occurrence) should read -- member 23 is disposed in a longitudinal direction of said electrophotographic photosensitive drum; --.
Lines 12-65, should be deleted.

Column 28,
Line 58, "drum 1 with" should read -- drum 1. With --.

Column 29,
Line 62, "opening 11A1" should read -- opening 41*f* --.
Line 64, "opening 11A1" should read -- opening 41*f* --.

Column 30,
Line 2, "described" should read -- described. --.

Column 31,
Line 37, "opening" should read -- opening. --.

Column 33,
Line 60, "if" should read 1*f* --.

Column 35,
Line 26, "fit" should read -- fits --.

Column 36,
Line 3, "111" should read -- 11v --.

Column 40,
Line 1, "use" should read -- user --.

Column 41,
Line 56, "contacts," should read -- contact, --.

Column 42,
Line 41, "contacts" should read -- contact --.
Line 42, "which" should read -- which is --.

UNITED STATES PATENT AND TRADEMARK OFFICE

CERTIFICATE OF CORRECTION

PATENT NO. : 6,061,538
DATED : May 9, 2000
INVENTOR(S) : Takeshi Arimitsu et al.

It is certified that error appears in the above-identified patent and that said Letters Patent is hereby corrected as shown below:

Column 45,
Line 62, "lid" should read -- 11d --.

Column 46,
Line 26, "operational 18h" should read -- operational arm 18h --.
Line 51, "operational arm 18a," should read -- arm 18a, --.

Signed and Sealed this

Fifth Day of March, 2002

*Attest:*

*Attesting Officer*

JAMES E. ROGAN
*Director of the United States Patent and Trademark Office*